US010890294B2

(12) United States Patent
Santos et al.

(10) Patent No.: US 10,890,294 B2
(45) Date of Patent: Jan. 12, 2021

(54) VIRTUAL GASEOUS FUEL PIPELINE

(71) Applicant: NEARSHORE NATURAL GAS, LLC, Houston, TX (US)

(72) Inventors: Pedro T. Santos, Houston, TX (US); Scott Rackey, Bedford, MA (US); Jeremy Pitts, Boston, MA (US); Aaron Hilber, Houston, TX (US); Kolar L. Seshasai, Houston, TX (US); Pedro Vergel, Houston, TX (US); Jimmy Romanos, Houston, TX (US)

(73) Assignee: NEARSHORE NATURAL GAS, LLC, Houston, TX (US)

( * ) Notice: Subject to any disclaimer, the term of this patent is extended or adjusted under 35 U.S.C. 154(b) by 174 days.

(21) Appl. No.: 15/831,522

(22) Filed: Dec. 5, 2017

(65) Prior Publication Data

US 2018/0094772 A1 Apr. 5, 2018

Related U.S. Application Data

(62) Division of application No. 14/423,609, filed as application No. PCT/US2013/056456 on Aug. 23, 2013, now Pat. No. 9,863,581.

(Continued)

(51) Int. Cl.
*F17C 13/00* (2006.01)
*F17C 5/06* (2006.01)

(Continued)

(52) U.S. Cl.
CPC ..... *F17C 13/00* (2013.01); *F17C 5/02* (2013.01); *F17C 5/06* (2013.01); *F17C 7/00* (2013.01);

(Continued)

(58) Field of Classification Search
CPC .... F17C 5/06; F17C 7/00; F17C 13/00; F17C 13/001
See application file for complete search history.

(56) References Cited

U.S. PATENT DOCUMENTS 2,663,626 A 12/1953 Spangler et al.
4,139,019 A * 2/1979 Bresie ..... F17C 5/002 137/351

(Continued)

FOREIGN PATENT DOCUMENTS

CN 101213008 A 7/2008
CN 101566277 A 10/2009

(Continued)

OTHER PUBLICATIONS

Non-Final Office Action U.S. Appl. No. 14/423,609 dated Jan. 26, 2017.

(Continued)

*Primary Examiner* — Timothy L Maust
(74) *Attorney, Agent, or Firm* — Pillsbury Winthrop Shaw Pittman LLP

(57) ABSTRACT

Various embodiments provide an end-to-end gaseous fuel transportation solution without using physical pipelines. A virtual pipeline system and methods thereof may involve transportation of gaseous fuels including compressed natural gas (CNG), liquefied natural gas (LNG), and/or adsorbed natural gas (ANG). An exemplary pipeline system may include a gas supply station, a mother station for treating gaseous fuels from the gas supply station, a mobile transport system for receiving and transporting the gaseous fuels, and user site for unloading the gaseous fuels from the mobile transport system. The unloaded gaseous fuels can be further used or distributed.

6 Claims, 46 Drawing Sheets

Related U.S. Application Data

(60) Provisional application No. 61/787,503, filed on Mar. 15, 2013, provisional application No. 61/799,229, filed on Mar. 15, 2013, provisional application No. 61/737,531, filed on Dec. 14, 2012, provisional application No. 61/693,193, filed on Aug. 24, 2012.

(51) Int. Cl.
*F17C 7/00* (2006.01)
*F17C 5/02* (2006.01)

(52) U.S. Cl.
CPC ..... *F17C 2201/0109* (2013.01); *F17C 2201/035* (2013.01); *F17C 2201/054* (2013.01); *F17C 2205/0107* (2013.01); *F17C 2205/0111* (2013.01); *F17C 2205/0142* (2013.01); *F17C 2205/0146* (2013.01); *F17C 2205/0161* (2013.01); *F17C 2205/0176* (2013.01); *F17C 2205/0352* (2013.01); *F17C 2205/0397* (2013.01); *F17C 2221/033* (2013.01); *F17C 2223/0123* (2013.01); *F17C 2223/0161* (2013.01); *F17C 2223/033* (2013.01); *F17C 2223/035* (2013.01); *F17C 2225/0123* (2013.01); *F17C 2225/0161* (2013.01); *F17C 2225/033* (2013.01); *F17C 2225/035* (2013.01); *F17C 2227/0346* (2013.01); *F17C 2227/0397* (2013.01); *F17C 2250/034* (2013.01); *F17C 2250/036* (2013.01); *F17C 2250/043* (2013.01); *F17C 2250/0439* (2013.01); *F17C 2250/0443* (2013.01); *F17C 2250/0447* (2013.01); *F17C 2250/0456* (2013.01); *F17C 2250/0478* (2013.01); *F17C 2250/0652* (2013.01); *F17C 2265/061* (2013.01); *F17C 2265/063* (2013.01); *F17C 2265/065* (2013.01); *F17C 2270/0171* (2013.01); *Y10T 137/0318* (2015.04)

(56) References Cited

U.S. PATENT DOCUMENTS

| | | | | | |
|---|---|---|---|---|---|
| 4,507,259 | A | | 3/1985 | Cowell et al. | |
| 4,542,774 | A | | 9/1985 | Stavlo | |
| 5,373,702 | A | * | 12/1994 | Kalet | F17C 9/00 123/525 |
| 5,406,988 | A | | 4/1995 | Hopkins | |
| 5,409,046 | A | * | 4/1995 | Swenson | F17C 9/02 141/11 |
| 5,699,839 | A | * | 12/1997 | Dehne | F17C 6/00 141/18 |
| 5,771,946 | A | * | 6/1998 | Kooy | F17C 6/00 141/11 |
| 5,884,675 | A | | 3/1999 | Krasnov | |
| 5,935,305 | A | | 8/1999 | Tom et al. | |
| 5,954,099 | A | | 9/1999 | Princiotta | |
| 6,152,192 | A | | 11/2000 | Klotz | |
| 7,128,103 | B2 | * | 10/2006 | Mitlitsky | H01M 8/04089 141/248 |
| 7,168,464 | B2 | * | 1/2007 | Diggins | F17C 7/02 137/263 |
| 7,415,995 | B2 | * | 8/2008 | Plummer | F17C 6/00 141/192 |
| 7,624,770 | B2 | * | 12/2009 | Boyd | F17C 5/007 141/11 |
| 8,069,885 | B2 | | 12/2011 | Kederer | |
| 8,122,918 | B2 | | 2/2012 | Handa | |
| 8,443,820 | B2 | * | 5/2013 | Ulrey | F02M 21/0224 137/1 |
| 8,453,682 | B2 | | 6/2013 | Bonner | |
| 8,833,088 | B2 | * | 9/2014 | Bayliff | F17C 7/00 62/5 |
| 8,978,715 | B2 | | 3/2015 | Allidieres | |
| 8,999,278 | B2 | | 4/2015 | Chang et al. | |
| 2004/0194853 | A1 | | 10/2004 | Cuffari | |
| 2006/0153327 | A1 | | 7/2006 | Jiang | |
| 2010/0307636 | A1 | | 12/2010 | Uemura | |
| 2011/0284120 | A1 | | 11/2011 | Bonner et al. | |
| 2012/0031525 | A1 | | 2/2012 | Wonders | |
| 2013/0186132 | A1 | * | 7/2013 | Banszky | F25J 3/08 62/618 |
| 2013/0219955 | A1 | * | 8/2013 | Yoo | C10L 3/104 62/602 |
| 2015/0013829 | A1 | * | 1/2015 | Kuehl | F17C 5/06 141/4 |

FOREIGN PATENT DOCUMENTS

| | | | |
|---|---|---|---|
| DE | 29 46 176 | A1 | 5/1981 |
| DE | 10 2004 004 379 | A1 | 8/2005 |
| DE | 10 2007 023 821 | A1 | 11/2008 |
| DE | 10 2009 037 109 | A1 | 2/2011 |
| DE | 10 2009 036 072p | B3 | 4/2011 |
| DE | 10 2010 010 108 | A1 | 8/2011 |
| EP | 0 033 219 | A1 | 8/1981 |
| EP | 1 108 947 | A1 | 6/2001 |
| EP | 1 452 794 | A2 | 9/2004 |
| EP | 1722153 | | 11/2006 |
| EP | 2 390 550 | A1 | 11/2011 |
| GB | 1 208 751 | A | 10/1970 |
| GB | 2062205 | A | 5/1981 |
| GB | 2 264 271 | A | 8/1993 |
| JP | 2011-074925 | | 4/2011 |
| WO | WO 2010/078881 | A1 | 7/2010 |

OTHER PUBLICATIONS

International Search Report and the Written Opinion of the International Searching Authority as issued in International Patent Application No. PCT/US2013/056456, dated Jun. 17, 2015.

International Preliminary Report on Patentability as issued in International Patent Application No. PCT/US2013/056456, dated Jun. 16, 2015.

Office Action issued in Canadian Patent Application No. 2,748,367, dated Apr. 24, 2015.

Notice of Allowance issued in U.S. Appl. No. 14/423,609 dated Sep. 8, 2017.

Chinese Office Action dated Jan. 23, 2017 in corresponding Chinese Patent Application No. 201380055917.5.

Communication Pursuant to Article 94(3) EP Application No. 13 759 620.1 dated May 19, 2017.

Examination Report dated Oct. 10, 2017 in Australian Patent Application No. 2013305604.

Office Action dated Jun. 26, 2019 in related Canadian Patent Application No. 2,921,548, 3 pages.

Office Action dated May 17, 2019 in related Chinese Patent Application No. 201710694737.1, 17 pages.

Examination Report issued in corresponding Australian Patent Application No. 2018247201, dated Dec. 23, 2019.

Second Office Action issued in corresponding Chinese Patent Application No. 201710694737.1, dated Jul. 3, 2020.

* cited by examiner

Example with Ambient Temperature of 59F

| Pre-Letdown Pressure psia | Pre-Letdown Temperature °F | Cylinder Pressure psia | Pre-Letdown Temperature °F | Enthalpy Btu/Ibm | Inlet Gas Desity /Ibm/ft3 | % of Density (Max @ 59F) | Notes |
|---|---|---|---|---|---|---|---|
| 1626 | 59 | 115 | -40 | 316.37 | 0.4442 | 3.4% | Start of cylinder fill conditions, assume compression achieves cooling to ambient |
| 1871 | 59 | 265 | -40 | 308.62 | 1.0755 | 8.1% | Intermediate J-T cooled backpressure setting |
| 2153 | 59 | 415 | -40 | 300.54 | 1.7780 | 13.5% | |
| 2510 | 59 | 565 | -40 | 291.87 | 2.5707 | 19.5% | |
| 3615 | 59 | 822 | -40 | 275.30 | 4.2197 | 31.9% | Exhaustion of J-T cooling to get to a post-letdown temperature of -40F |
| 3615 | 59 | 1215 | -11 | 275.30 | 6.0933 | 46.1% | Allow natural decay of J-T cooling, start of cirulation cooling |
| 3615 | 59 | 1815 | 19 | 275.30 | 8.5045 | 64.4% | |
| 3615 | 59 | 2415 | 38 | 275.30 | 10.4150 | 78.8% | |
| 3615 | 59 | 3015 | 51 | 275.30 | 11.9480 | 90.4% | |
| 3615 | 59 | 3615 | 59 | 275.30 | 13.2120 | 100.0% | |

FIG. 3c

Example of Optimal Chill Fill Process with Cylinder Rating at 59F

| Pre-Letdown Pressure psia | Pre-Letdown Temperature °F | Cylinder Pressure psia | Pre-Letdown Temperature °F | Pre-Letdown Enthalpy Btu/Ibm | Inlet Gas Desity Ibm/ft3 | % of Density (Max @ 59F) | Notes |
|---|---|---|---|---|---|---|---|
| 5015 | 20 | 115 | -173 | 235.94 | 0.7265 | 5.5% | Start with a refrigerated storage vessel, mix post-letdown with recirculation to keep minimum temperatures at -40F so as to not affect materials. |
| 5015 | 20 | 415 | -123 | 235.94 | 2.8277 | 21.4% | |
| 5015 | 20 | 822 | -77 | 235.94 | 5.9573 | 45.1% | Exhaustion of J-T cooling to get to a post-letdown temperature of -40F |
| 5015 | 20 | 1215 | -46 | 235.94 | 8.1286 | 61.5% | Allow natural decay of J-T cooling, cool the recirculated circuit w/ chilled fluid |
| 5015 | 20 | 1815 | -18 | 235.94 | 10.9000 | 82.5% | |
| 5015 | 20 | 2015 | -12 | 235.94 | 11.5860 | 87.7% | Stop recirculation and allow internal temperature build naturally |
| 5015 | 20 | 2415 | -2 | 235.94 | 12.7660 | 96.6% | |
| 5015 | 20 | 3015 | 8 | 235.94 | 14.1920 | 170.4% | |
| 5015 | 20 | 3215 | 10 | 235.94 | 14.6010 | 110.5% | Start of recirculation for temperature mixing and equalization |
| 5015 | 20 | 3515 | 13 | 235.94 | 15.1650 | 114.8% | Reduce rate of fill to allow accuracy of flowmeter to be high |
| 5015 | 20 | 3615 | 14 | 235.94 | 15.3420 | 116.1% | Finish cycle, average cylinder internal temperature 59F based on total mass inserted |

FIG. 3d

Cascade Step Process At First User 130 Site Reverse Cascade

| | Vessel #1 | Vessel #2 | Vessel #3 | Vessel #4 | Vessel #5 | Vessel #6 | Vessel #7 | Vessel #8 |
|---|---|---|---|---|---|---|---|---|
| Pod #1 | Step #1 | #2 | #3 | #4 | #5 | #6 | #7 | #8 |
| Pod #2 | - | #9 | #10 | #11 | #12 | #13 | #14 | #15 |
| Pod #3 | - | - | #16 | #17 | #18 | #19 | #20 | #21 |
| Pod #4 | - | - | - | - | - | - | - | - |

Cascade Step Process At Second User 130 Site Reverse Cascade

| | Vessel #1 | Vessel #2 | Vessel #3 | Vessel #4 | Vessel #5 | Vessel #6 | Vessel #7 | Vessel #8 |
|---|---|---|---|---|---|---|---|---|
| Pod #1 | Step #22 | #23 | #24 | #25 | #26 | #27 | #28 | #29 |
| Pod #2 | #30 | #31 | #32 | #33 | #34 | #35 | #36 | #37 |
| Pod #3 | #38 | #39 | #40 | #41 | #42 | #43 | #44 | #45 |
| Pod #4 | #46 | #47 | #48 | #49 | #50 | #51 | #52 | #53 |

VIRTUAL GASEOUS FUEL PIPELINE

CROSS REFERENCE TO RELATED APPLICATIONS

This application is a Divisional Application of U.S. Ser. No. 14/423,609, filed on Feb. 24, 2015, which is the U.S. National Stage of PCT/US2013/056456, filed on Aug. 23, 2013, which claims the benefit of priority from U.S. Provisional Application No. 61/693,193, filed Aug. 24, 2012, titled "VIRTUAL GASEOUS FUEL PIPELINE," U.S. Provisional Application No. 61/737,531, filed Dec. 14, 2012, titled "VIRTUAL GASEOUS FUEL PIPELINE," U.S. Provisional Application No. 61/799,229, filed Mar. 15, 2013, titled "VIRTUAL GASEOUS FUEL PIPELINE," and U.S. Provisional Application No. 61/787,503, filed Mar. 15, 2013, titled "METHODS, MATERIALS, AND APPARATUSES ASSOCIATED WITH ADSORBING HYDROCARBON GAS MIXTURES," the entire contents of all of which are hereby incorporated by reference herein in their entirety.

BACKGROUND OF THE INVENTION

1. Field of the Invention

The present invention relates generally to virtual pipelines that are used to bridge gaps between gaseous fuel supply and users by transporting the gaseous fuel in a mobile gaseous fuel module from the gaseous fuel supply to the user without using a pipeline.

2. Description of Related Art

Gaseous fuels, such as natural gas, are typically transported by pipeline, although there are users of natural gas that periodically require natural gas supply in excess of the supply available through existing pipelines. In addition, there are areas in which natural gas service via pipeline is not available at all, due to remoteness, the high cost of laying pipelines, or other factors.

SUMMARY OF EMBODIMENTS OF THE INVENTION

In accordance with various embodiments of the disclosure, an end-to-end gaseous fuel transportation solution bridges a gap between a gas supply (e.g., a wellhead (gas, combined oil and gas, etc.), landfill, supply pipeline, a liquid natural gas (LNG) container or pipeline) or other synthetic processes such as Syngas, among others) and a pipeline supplying the user. One or more embodiments of the present disclosure provide a virtual pipeline system and methods thereof. The virtual pipeline system involves transportation of gaseous fuels including, but not limited to, compressed natural gas (CNG), liquefied natural gas (LNG), and/or adsorbed natural gas (ANG), without the use of physical pipelines.

These and other aspects of various embodiments of the present invention, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. In one embodiment of the invention, the structural components illustrated herein are drawn to scale. It is to be expressly understood, however, that the drawings are for the purpose of illustration and description only and are not intended as a definition of the limits of the invention. In addition, it should be appreciated that structural features shown or described in any one embodiment herein can be used in other embodiments as well. As used in the specification and in the claims, the singular form of "a", "an", and "the" include plural referents unless the context clearly dictates otherwise.

All closed-ended (e.g., between A and B) and open-ended (greater than C) ranges of values disclosed herein explicitly include all ranges that fall within or nest within such ranges. For example, a disclosed range of 1-10 is understood as also disclosing, among other ranged, 2-10, 1-9, 3-9, etc.

BRIEF DESCRIPTION OF THE DRAWINGS

For a better understanding of embodiments of the present invention as well as other objects and further features thereof, reference is made to the following description which is to be used in conjunction with the accompanying drawings, where:

FIGS. 3*c* and 3*d* illustrate the operation of the cooled loading system according to various embodiments.

DETAILED DESCRIPTION OF EXEMPLARY EMBODIMENTS OF THE INVENTION

One or more embodiments of the present invention provide a virtual pipeline system. In one embodiment, the virtual pipeline system may be used for end-to-end gaseous fuel transportation without using physical pipelines but using a mobile transport system, for example. As used herein, gaseous fuel encompasses both fuel that is in a pure gas phase, as well as fuel that includes both gas phase and liquid phase components (e.g., mixed natural gas that includes gas phase components (e.g., C5 and under components such as methane, ethane, propane, butane), as well as components that may be liquid at ambient temperature and pressure (e.g., hexane, octane, etc.)).

In one or more embodiments, the end-to-end gaseous fuel transportation may include gaseous fuel transportation, for example, between a gaseous fuel supply station (e.g., a supply pipeline or hub, a flare gas capture station, a gas-producing well, etc.) and an end user/customer; between a gaseous fuel supply station and a gaseous fuel distribution station, e.g., for further gaseous fuel dispensing to other end users or another gaseous fuel distribution station, etc.; and/or between a wellhead and a gathering point (e.g., a supply pipeline, LNG facility, etc.).

Figure 1A:
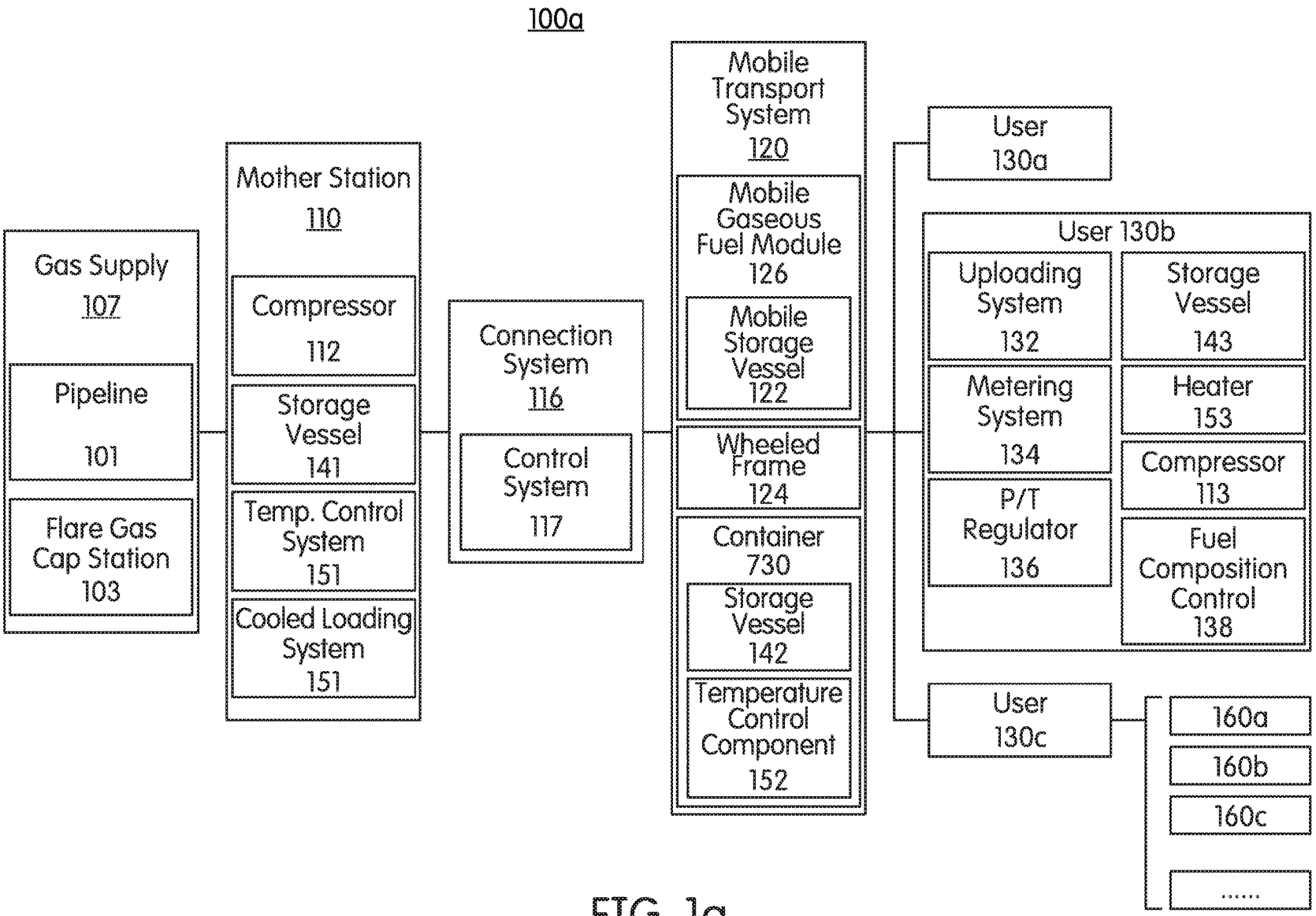
FIG. 1*a* is a schematic showing an exemplary virtual pipeline system in accordance with various embodiments of the present teachings.

FIG. 1*a* depicts an exemplary virtual pipeline system 100*a* in accordance with various embodiments of the present teachings. The exemplary virtual pipeline system 100*a* may include, for example, a gaseous fuel supply station 107, a mother station 110, a mobile transport system 120, and various users 130*a-c*, etc. Gaseous fuels, such as compressed natural gas can be transported from the gaseous fuel supply station 107 and/or mother station 110 to various users 130*a-c* using at least the mobile transport system 120 in the virtual pipeline system 100*a*.

The gaseous fuel supply station 107 may include, for example, a supply pipeline 101, a flare gas capture station 103, a land-fill gas collection system, a sewage treatment gas collection system, an agricultural gas collection system (e.g., methane from cow manure), and/or other possible stations for supplying gaseous fuel. A flare gas capture station 103 may be part of an on-shore or off-shore fossil fuel collection site (e.g., on-shore oil derrick, off-shore oil platform or hub). By placing a mother station 110 on a site such as an off-shore oil platform 107, natural gas that would have otherwise been wastefully flared may be collected. The use of a mother station 110 connected to such a gas supply 107 may be particularly useful in connection with gas supplies 107 that are too remote to warrant the construction of an actual gas pipeline connecting the supply 107 to users 130.

Mother Station

As shown in FIG. 1*a*, the mother station 110 may include a compressor 112, a storage vessel 141, a cooled loading system 114, and/or a temperature control component such as a heat pump or other active heat transfer system 151.

According to various embodiments, gaseous fuel (or other gaseous fluid(s)) is transferred from the pipeline 101 (or other gas supply 107) to the storage vessel 141 via the compressor 112 at a mass flow rate that is substantially lower than the mass flow rate used to transfer gaseous fuel from the storage vessel 141 (and/or the pipeline 101) to the vessels 122, 142 of the module 120. According to various embodiments the mass flow rate into the vessel 122, 142 (e.g., from the vessel 141 and/or the pipeline 101) is at least 25%, 50%, 75%, 100%, 125%, and/or 150% larger than the mass flow rate the pipeline 101 to the storage vessel 141. The lower mass flow rate into the vessel 141 can nonetheless keep up with the higher flow rate into the vessel 122, 142 because the flow into the vessel 122, 142 is intermittent, while the mass flow from the pipeline 101 may be continuous.

The on-site storage vessel 141 can serve multiple functions. It can allow balancing of demand to assure minimum gaseous fuel purchase costs by avoiding penalties from unbalanced usage. It can also allow price arbitrage if the price of the gas varies over time. It can also lower compressor capital costs because a smaller, less expensive compressor can gradually fill the on-site storage vessel 141 over a longer (e.g., continuous) time period. In contrast, in the absence of an on-site storage vessel 141, the compressor would operate only when a module 120 was on-site and ready to be filled. In the case where the mobile storage vessel 122, 142 filling demand is intermittent, the on-site storage vessel 141 can allow use of a small compressor 112 that runs continuously to fill and pressurize the storage vessel 141, rather than a large compressor 112 that only runs when the mobile storage vessel 122, 142 is filling. If the on-site storage vessel 141 pressure is higher than the trailer storage vessel 122, 142 pressure, and if the on-site storage volume is sufficiently high, then trailer storage vessels 122, 142 may be filled by simply blowing down from the high pressure on-site storage 141 to the low pressure mobile trailer vessel(s) 122, 142. This technique, e.g., decompression, also enables the utilization of JT cooling for the cooled loading process described in greater detail below.

Referring back to FIG. 1*a*, in one or more embodiments, when the on-site storage vessel 141 is in place, the mobile storage vessel (e.g., trailer) 122, 142 may be filled from the compressors 112, the storage vessel 141, or a combination thereof. Such a system has the added advantage that, in some cases, the mobile storage vessel 122, 142 may be filled more quickly than would be practical using only a direct connection from the gas supply 107 to the compressor 112 to the vessel 122, 142, due to the requirements of a very large and expensive compressor to achieve such fill rates. This is especially beneficial when simultaneously filling several mobile storage vessels.

In this manner, the stationary on-site storage vessel 141 can be used to smooth demand from vessel 122, 142 filling at a mother station 110. The vessel 141 may be at a substantially higher pressure than the maximum pressure of the mobile storage vessels 122, 142 to be filled. The vessel 141 may be at both substantially higher pressure and substantially higher volume than the mobile storage vessel 122, 142. According to various embodiments, before, during, and/or after loading of one or more vessels 122, 142 or modules 126 from the vessel 141, a pressure in the vessel 141 is at least 1000, 1250, 1500, 2000, 2400, 3000, 3600, 3800, 4000, 4500, and/or 5000 psig, and below 7000, 6000, and/or 5500 psig. According to various embodiments, maintaining the vessel(s) 141 at such high pressures removes excess enthalpy generated from the rise in pressure (for example, by dumping heat to the ambient environment using the compressor 112's heat exchangers), in turn, according to various embodiments, higher vessel 141 pressures may provide for higher density of storage and the "drive" force to allow for significant mass flow through the expansion J-T orifice/valve when loading the vessel(s) 122, 142 from the vessel 141. According to various embodiments, loading gaseous fuel from the vessel 141 to the vessel 122, 142 at high pressure may reduce erosion caused by high velocity flow, and may reduce fluid friction heating and losses.

According to various embodiments, an internal volume of the vessel 141 is at least 1,000, 1,500, 2,000, 2,500, and/or 3,000 gallons (liquid volume), and may be less than 10,0000, 7,500, 5,000, and/or 4,000 gallons.

The vessel 141 may be of sufficient size and pressure to completely fill the mobile storage vessel 122, 142 to full pressure while still maintaining a pressure above the fill pressure of the vessel 122, 142 (e.g., 3600 psi). In one or more embodiments, the filling of the mobile storage vessels 122, 142 of the mobile transport system 120 can be accomplished substantially faster than would be achieved through direct connection from the gas supply 107 through the compressor 112 to the vessels 122, 142.

Unless otherwise stated, all psi numbers are psig (pounds per square inch gauge), which is about 14.7 psi lower than the psia (pounds per square inch absolute) equivalent when at sea level. This difference is of course smaller at higher elevations.

Loading Gas from a Flare Gas Capture Station

Figure 1B:
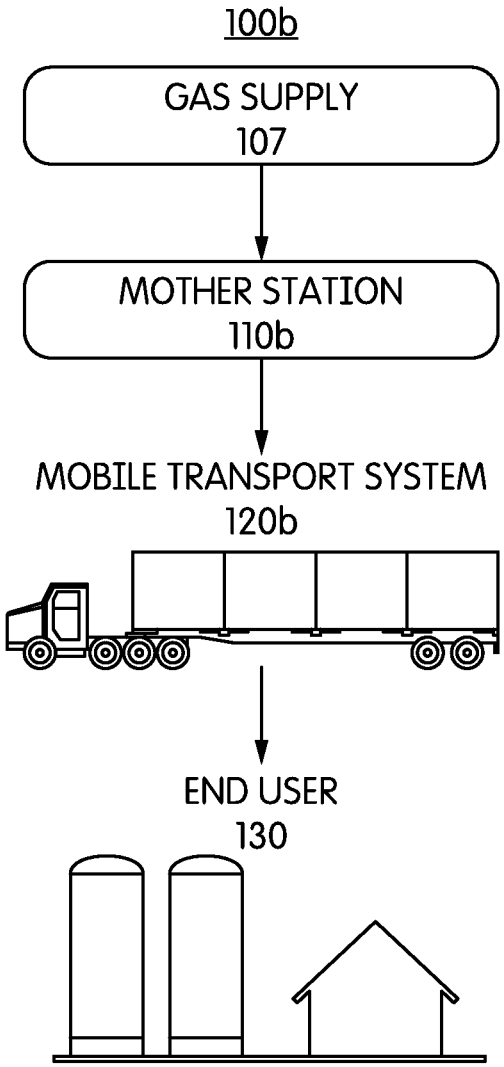
FIG. 1*b* is a schematic showing an exemplary virtual pipeline system for transporting gaseous fuel from a mother station to an end user by a mobile transport system in accordance with various embodiments of the present teachings.
Figure 1C:
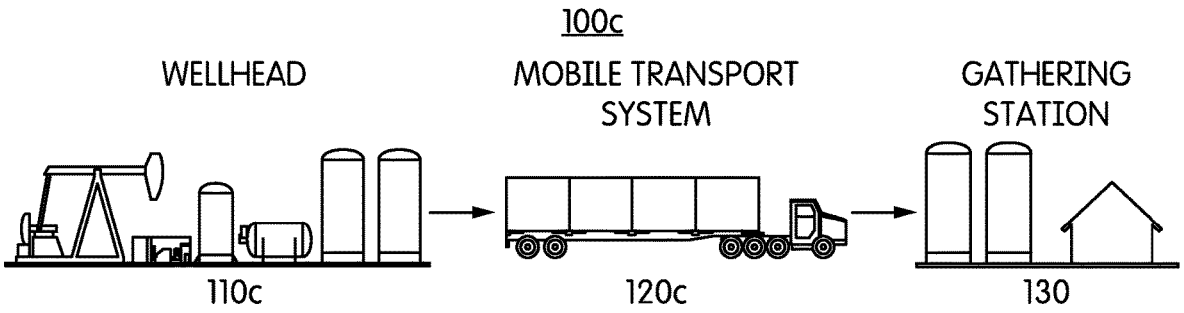
FIG. 1*c* is a schematic showing an exemplary virtual pipeline system for transporting gaseous fuel from a wellhead to a gathering station via a mobile transport system in accordance with various embodiments.
Figure 1D:
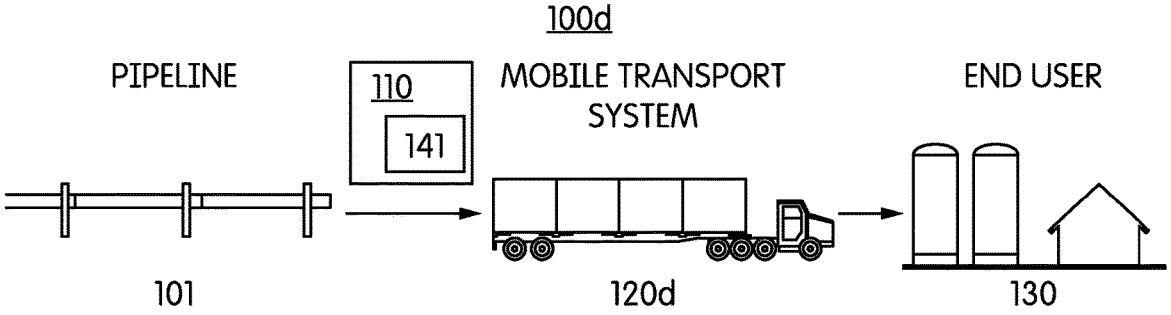
FIG. 1*d* is a schematic showing an exemplary virtual pipeline system for transporting gaseous fuel from a pipeline to an end user via a mobile transport system in accordance with various embodiments.
Figure 1E:
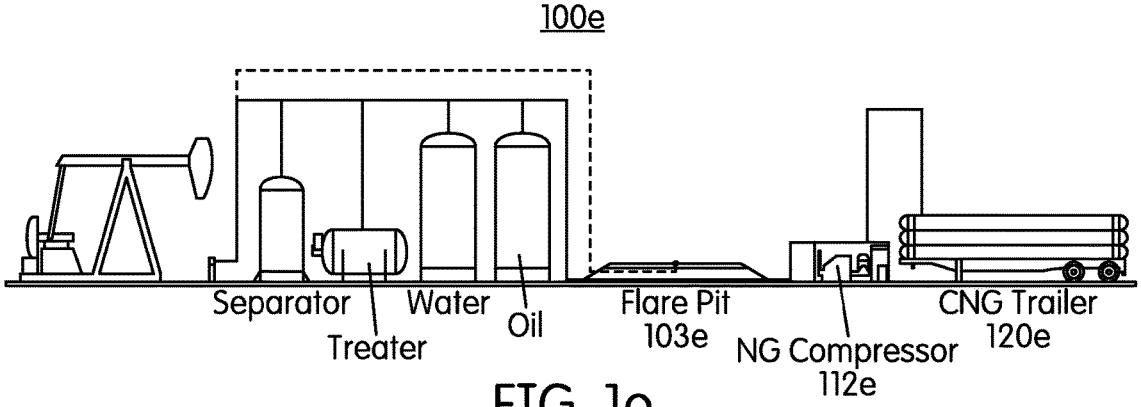
FIG. 1*e* is a schematic showing an exemplary virtual pipeline system for transporting gaseous fuel from a flare gas cap station to an end user via a mobile transport system in accordance with various embodiments.

FIG. 1*e* is a schematic showing an exemplary virtual pipeline system 100*e* for transporting gaseous fuel from a flare gas capture station 103*e* to an end user (not shown FIG. 1*e*) via a mobile transport system 120*e* in accordance with various embodiments. The gaseous fuel may be compressed by a compressor 112*e* prior to introduction to the mobile transport system 120*e*. The mobile transport system 120*e* (e.g., vessels 122, 142 mounted on a wheeled trailer, vessels of a module 126 that can be moved onto a wheeled vehicle such as a trailer or truck) may remain at the flare gas capture station 103*e* until filled with compressed gas.

Gas Connectors and Hoses

Figure 1F:
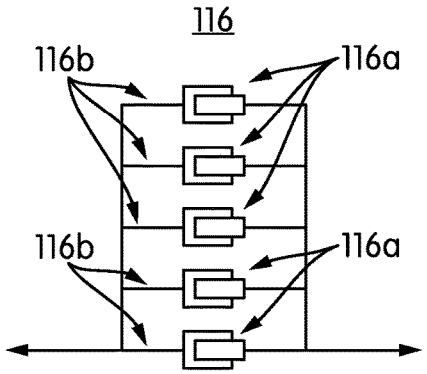
FIG. 1*f* is a schematic showing parallel breakaway connectors according to various embodiments.

In one or more embodiments, the systems 100*a-e* of FIGS. 1*a*-1*f* may have enlarged failsafe breakaway connectors 116*a* (see FIG. 1*f*).

As shown in FIG. 1*a*, the systems 100*a-e* of FIGS. 1*a*-1*e* may include a connection system 116 configured between the mother station 110 (e.g., the compressor 112 and/or the vessel 141) and the mobile storage vessel 122, 142 of the mobile transport system 120. The connection system 116 may be configured within or outside the mother station 110 and may include oversized hoses and connectors that facilitate high volumetric and/or mass flow rates. According to various embodiments, choke points in the flow path (e.g., ⅜ inch ID couplers) may be eliminated to enhance gas flow.

At high fill rates, the pressure drop across the connection system 116, e.g., a multiple connection system, between the mother station 110 and the mobile storage vessel 122, 142 can be a substantial limitation. These connections 116 can include the fittings, hoses, breakaway connectors, and/or hose-end fittings including NGV nozzles and/or receptacles and/or other high pressure fluid nozzles and/or receptacles. To address this, the connection system 116 may comprise multiple standard hoses ganged together in parallel or a combination of low pressure fittings with low pressure drop (e.g., liquid propane gas ("LPG") fittings) and high pressure fittings with higher pressure-drop. Use of such a combination may warrant the use of a control system 117 (which may be integrated into the controller 350 discussed below) to switch between the two sets as pressure rises above or falls below the maximum working pressure of the low pressure set. For a given mass flow rate, flow velocities and hence pressure drop are at their maximum when the pressure is low. Thus, using such a combination may take advantage of the low-pressure drop qualities of the low pressure fittings. In other words, the mother station 110 may include a multiple connection system 116 connected to a single mobile storage vessel 122, 142. In the multiple connection system 116, at least one connection uses a low pressure drop having low pressure fittings. The control system 117 may be used to switch flow and pressure to the connection set appropriate for the working pressure of the connection (e.g., using low pressure, low-pressure drop connections when a pressure in the vessel 122, 142 is below a threshold, and alternatively using high pressure, higher pressure drop connections when the pressure exceeds the threshold).

As shown in FIG. 1*f*, each breakaway connector 116*a* has a given force required to split the unit. To avoid having the required instantaneous breakaway force be the sum of all split forces of all individual parallel breakaway connectors 116*a*, the 'pig tails' 116*b* of each breakaway connector 116*a* may have a specific length unique relative to some or all other breakaway couplings in parallel on the same flow line. This would allow for each breakaway connector 116*a* to split individually (or in smaller groups). During a breakaway event, the individual breakaway connectors 116*a* would sequentially split or "unzip," which would thereby limit the overall force being applied to the flow line.

Alternatively, instead of using multiple parallel breakaway connectors 116*a*, a single breakaway connector with a larger cross-sectional flow area may be used. Such a breakaway is preferably designed for low-tension break-away while accommodating a high volume flow. According to various embodiments, the flow area of the breakaway is (a) at least 1, 1.5, 2, 3, and/or 4 square inches, (b) less than 10, 7, 6, 5, and/or 4 square inches, (c) between 1 and 10 square inches, or (d) within any range nested within any combination of these upper and lower numbers. According to various embodiments, the required breakaway force is between 10 and 10000, 5000, 4000, 3000, 2000, 1000, 500, 400, 300, 200, and/or 100 pounds. According to various embodiments, the breakaway force is less than 75, 60, 50, and/or 40% of the tensile strength of the surrounding hose/connector (e.g., at the crimp connection of the hose to the break-away connector), while still being higher than what a person would typically accidentally apply (e.g., at least 50, 75, 100, 150, and/or 200 pounds).

Figure 2A:
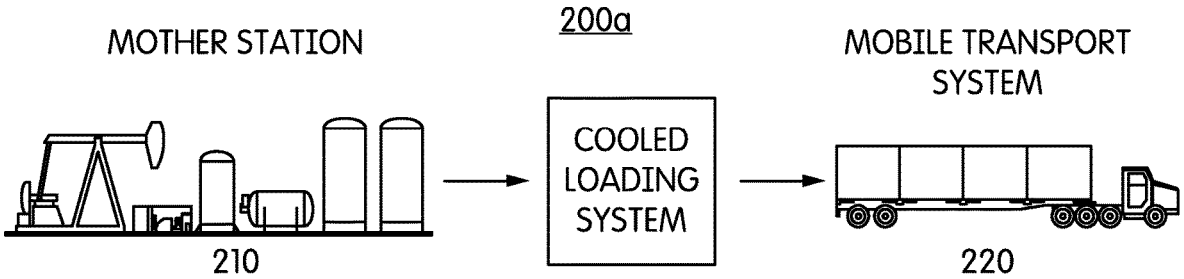
FIG. 2*a* is a schematic showing a cooled loading system in accordance with various embodiments of the present teachings.
Figure 2B:
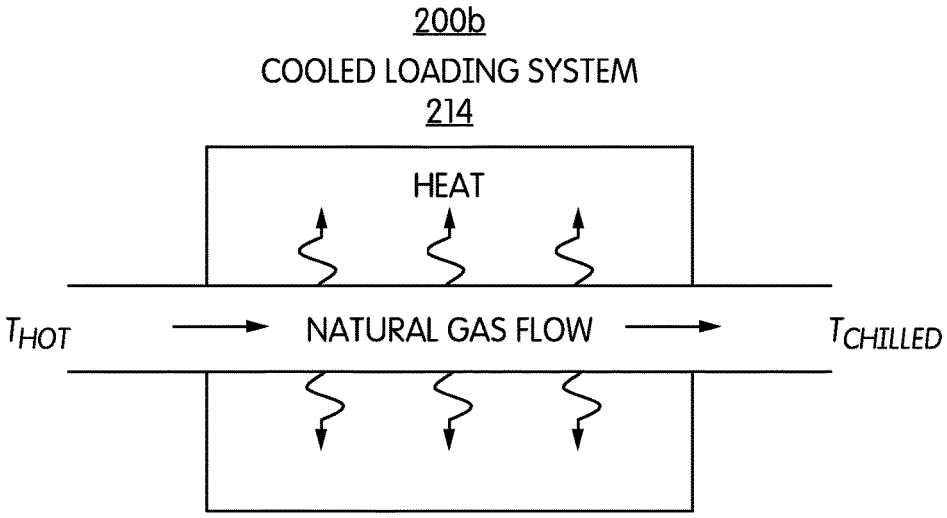
FIG. 2*b* is a schematic showing the cooled loading process in accordance with various embodiments of the present teachings.
Figure 2C:
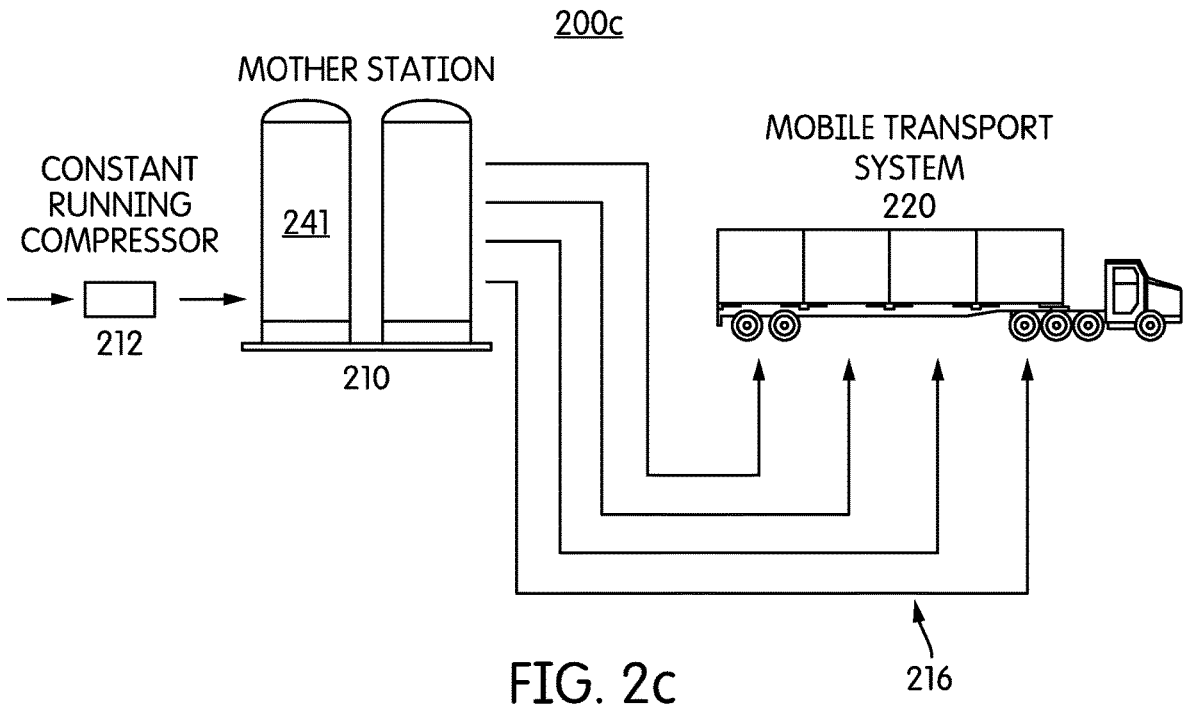
FIG. 2*c* is a schematic showing a mother station and a multiple connection system to connect the mother station with a mobile transport system in accordance with various embodiments of the present teachings.

FIG. 2*c* is a schematic showing a mother station 210 having a compressor 212, such as a constant running compressor, and a stationary storage vessel 241, which may be associated with the mother station 210 and located within or outside the mother station 210. A multiple connection system 216 can be used to connect the mother station 210 with one or more mobile storage vessels in the mobile transport system 220.

FIG. 2*a* is a schematic showing a cooled loading system 214 connecting a mother station 210 with a mobile transport system 220. In various embodiments, the cooled loading system 214 may be located within or outside the mother station 210 such that the gaseous fuel can be cooled and then filled into the mobile storage vessel of the mobile transport system 220. FIG. 2*b* is a schematic showing the cooled loading system 214 in great detail. Gaseous fuel having a high temperature, e.g., higher than an ambient temperature, may pass the cooled loading system 214 and be cooled after flowing there-through, e.g., having a temperature lower than the ambient temperature.

The same type of oversized hoses and connectors and/or multiple parallel hoses/connectors may be used at any other connection point between two components in any of the disclosed embodiments to improve flow through those connections (e.g., between and among any of the different vessels 122, 141, 142, 143, between the vessel(s) 122, 142 and the user site 130) according to various embodiments.

Live Pressurized Connections

Operations involving high pressure flammable gases typically use couplings that have to be vented (in between the connectors and at times all the gas in the hoses). Normally the differential pressure (high pressure filling supply versus empty trailer) multiplied times the face area of flow is equivalent to a very large force, which may be impossible to couple through manual means. In addition there are safety concerns in coupling a high pressure flammable gas with high forces involved in the area. To address these issues an automated, a mechanically powered connector may be used that would allow the coupling of the connector and receptacle while operating at full pressure. To guide the connector to the receptacle, dovetail or similar guides/pathways may be used to direct the coupling away from the operator in case of an accident but also to reduce/minimize the complexity and precision required in an automated system. To overcome the large differential pressures, several methods could be used including hydraulic power, the CNG pressure in a small power cylinder which then vents into the empty trailer, or an inflated balloon around the connectors which would reduce the effective differential pressure observed by blanketing the connection area and equalizing the connectors. Another method could be sequential actuation where a valve closes flow behind the receptacle and a small coupling is used to insert gas and equalize the pressures across the connector and receptacle, reducing/eliminating the differential pressures encountered.

According to various embodiments, the high pressure gas connection may (1) force any accidental decoupling to be far from the operator, (2) include guides that reduce the need for precision connections and careful approach to achieve connection, (3) include device(s) that reduce the apparent pressure differential between the couplings of the connection, (4) use couplers that use the differential pressure as drive force to perform the coupling operation, and/or (5) avoid venting any gas into the atmosphere and instead direct it to an empty trailer or to the mother station inlet pressure/compressor suction.

Mobile Transport System

Figure 4A:
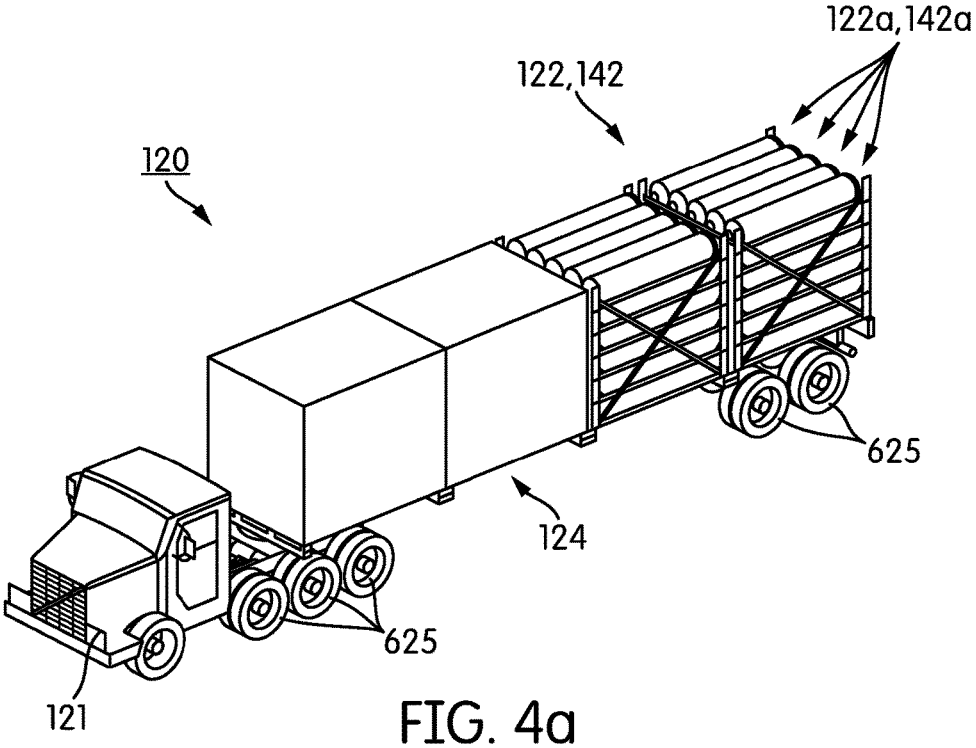
FIGS. 4*a*-4*b* are schematics showing an exemplary mobile transport system in accordance with various embodiments of the present teachings.
Figure 4B:
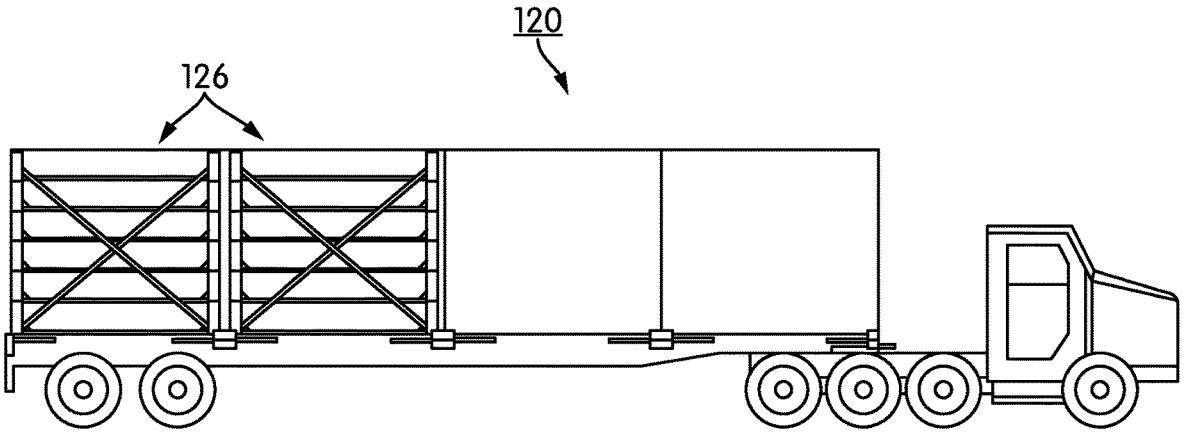
Figure 4C:
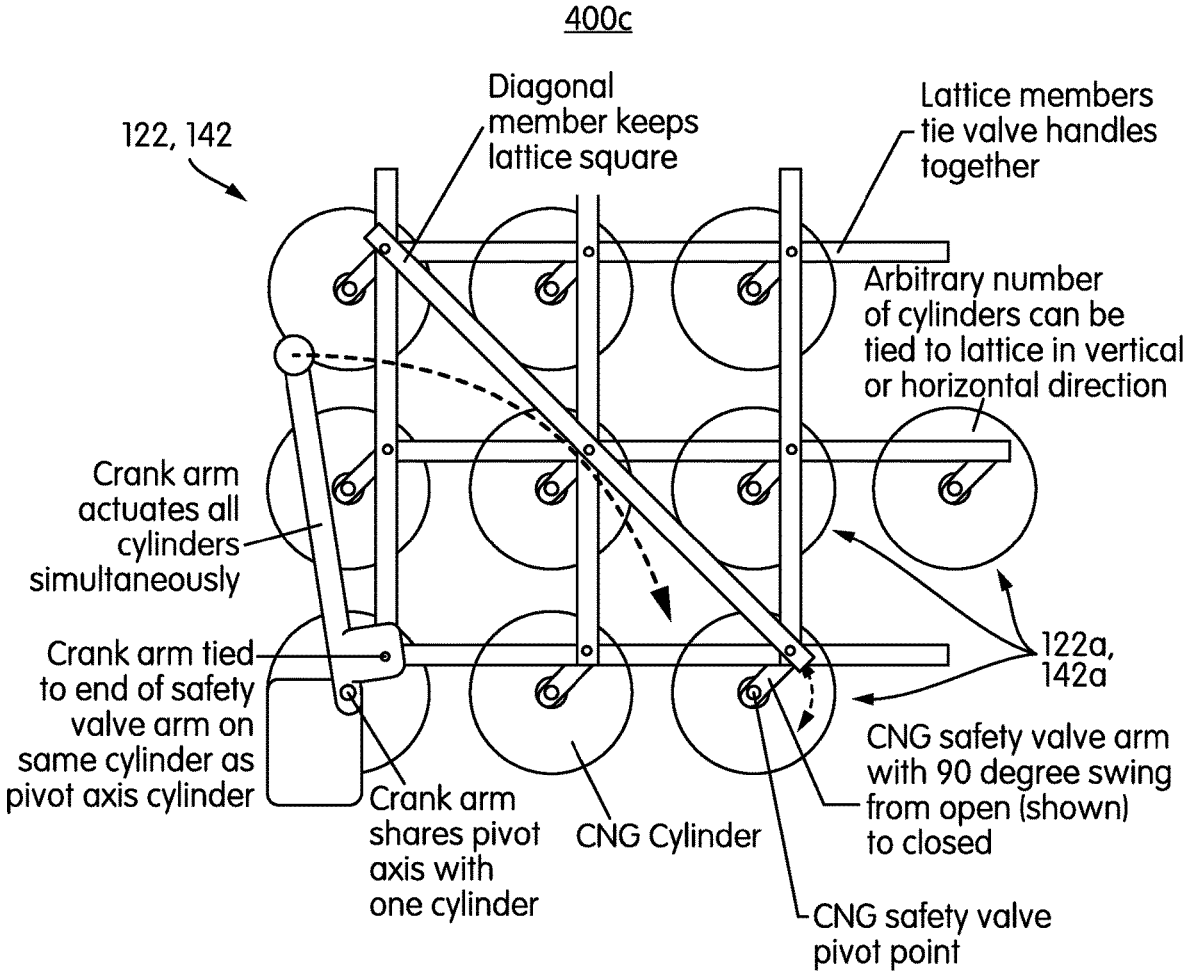
FIG. 4*c* is a schematic showing an exemplary valve system configured for multiple mobile storage vessels in accordance with various embodiments of the present teachings.
Figure 4D:
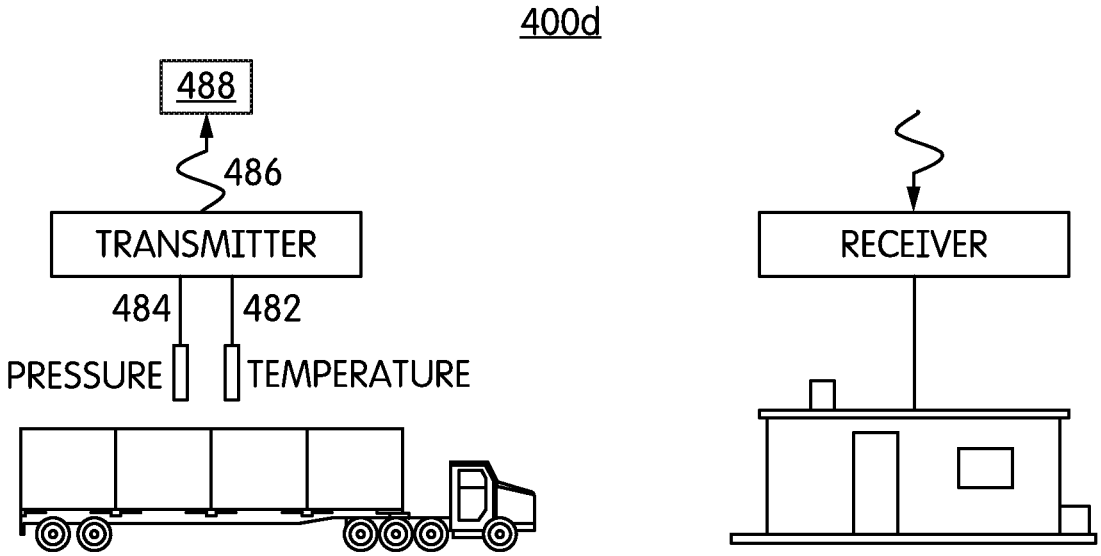
FIG. 4*d* is a schematic showing an exemplary system to monitor gaseous fuel in a mobile transport system in accordance with various embodiments of the present teachings.
Figure 4E:
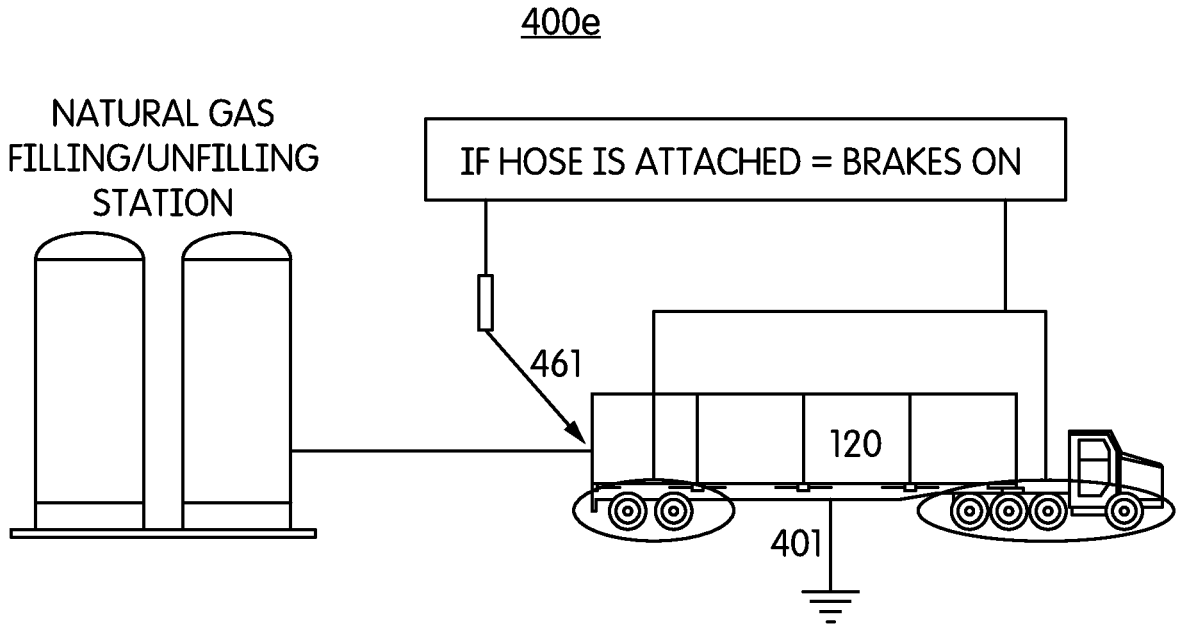
FIG. 4*e* is a schematic showing trailer brake/trailer-to-customer-pipe connection interlock in accordance with various embodiments of the present teachings.

Referring back to FIG. 1*a*, the mobile transport system 120 may include, a mobile gaseous fuel module 126 mounted on a wheeled frame 124 of a vehicle, such as an array of tubes mounted on a trailer or truck. In embodiments in which the mobile transport system 120 is a trailer, the trailer may be selectively connected to a large diesel tractor/truck 121 (see FIG. 4*f*) for transport between the gas supply 107/mother station 110 and the user 130 site. The mobile gaseous fuel module 126 may include a mobile storage vessel 122, e.g., a vessel or a cylinder that is mounted on a trailer. The mobile transport system 120 may optionally include a secondary mobile storage vessel 142, and/or a temperature control component 152 such as a cooler or a heater as desired. As illustrated for example in FIG. 7*g*, the mobile transport system 120 or one or more portions thereof may include an enclosed container 730 (e.g., an ISO box) that is mounted on the wheeled frame 124 and contains the vessels 122, 142. The container 730 may additionally house other components of the mobile transport system 120 (e.g., a temperature control component 452*h*, as illustrated in FIG. 4*h*).

In one or more embodiments, tube trailers may be used as a mobile gaseous fuel module. In general, tube trailers may be an expensive part if not the most expensive part of a virtual pipeline system and may constitute, e.g., more than 50% of the total capital investment and trailer transportation (e.g. trucking) costs and make up a substantial fraction of the virtual pipeline operating costs. For this reason, according to one or more embodiments, it is important to utilize the trailers to the greatest extent possible. Government regulations (e.g., Department of transportation (DOT)) limit the maximum pressure (regardless of temperature) that may be stored on a trailer. Therefore, it may be advantageous, according to one or more non-limiting embodiments, to fill the trailer to the maximum allowable pressure when transported to the users or customers.

Figure 5A:
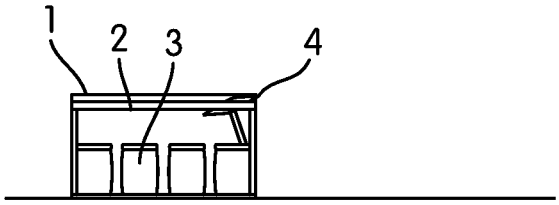
FIGS. 5*a*-5*h* are schematics showing an exemplary unloading process in accordance with various embodiments of the present teachings.
Figure 5B:
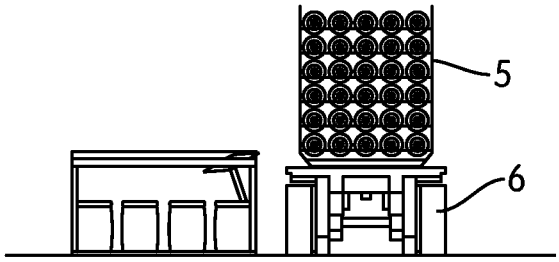
Figure 5C:
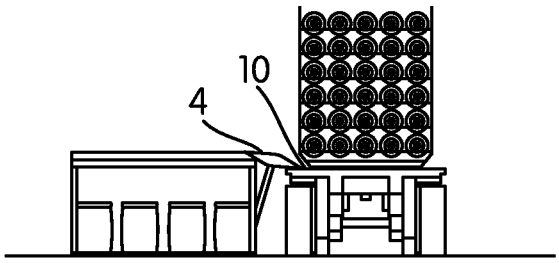
Figure 5D:
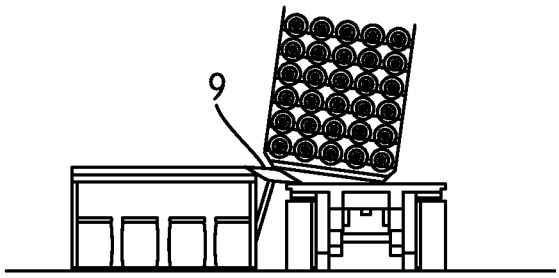
Figure 5E:
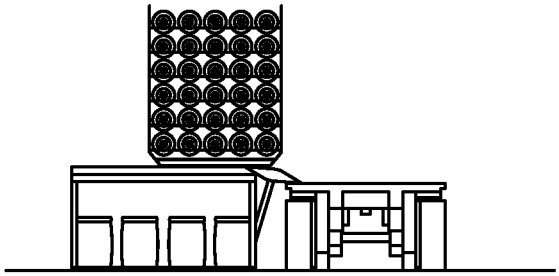
Figure 5F:
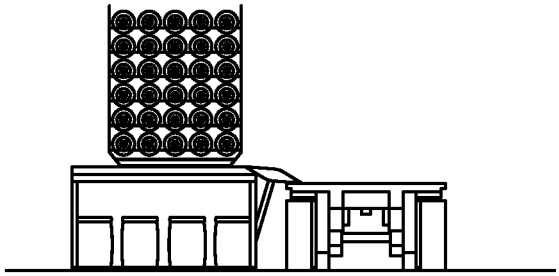
Figure 5G:
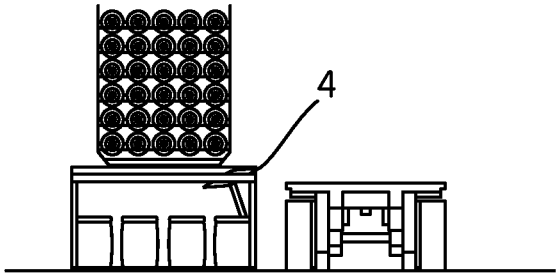
Figure 5H:
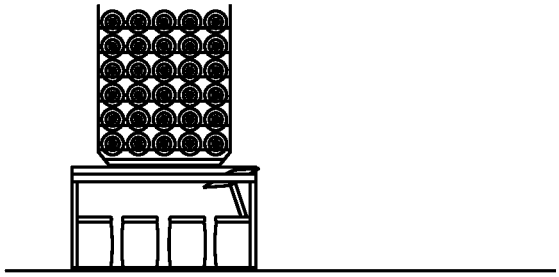
Figure 5I:
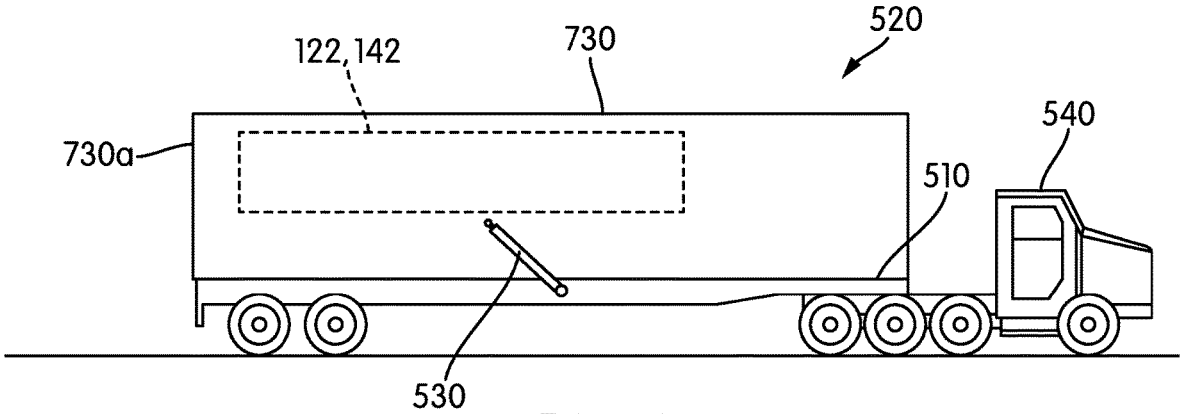
FIGS. 5*i-k* are schematics showing the operation of a mobile transport system tilting mechanism according to an embodiment of the present teachings.
Figure 5J:
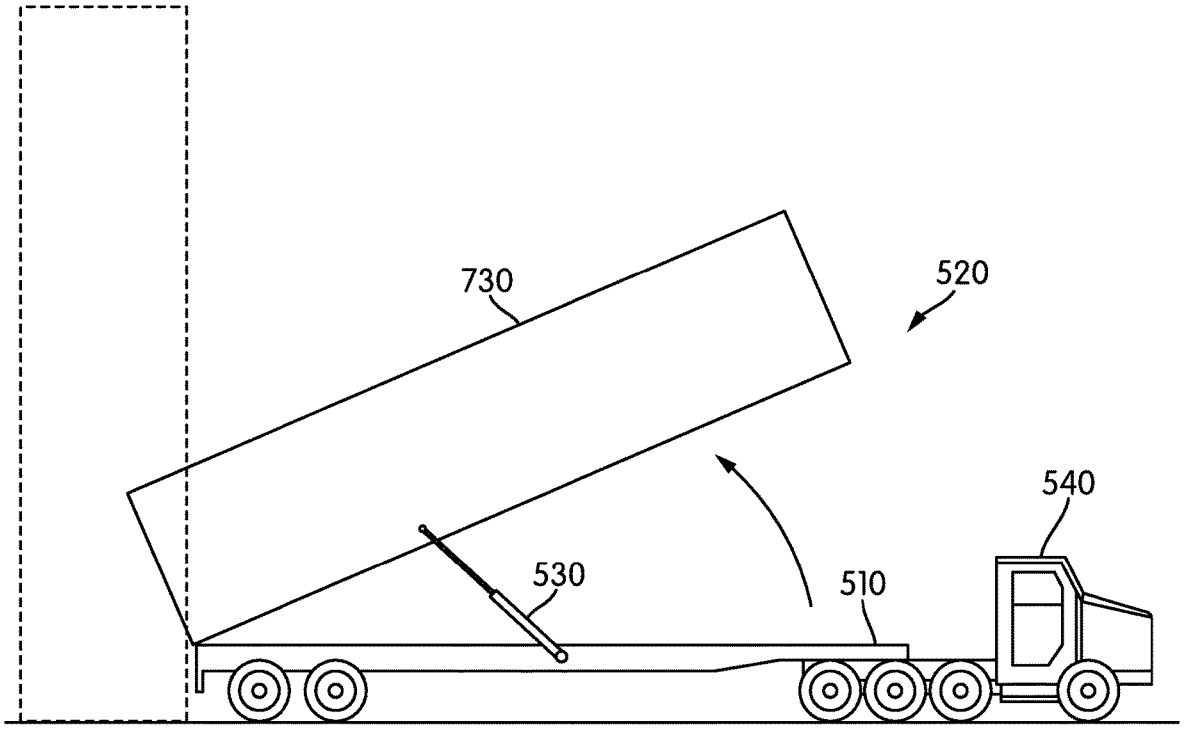
Figure 5K:
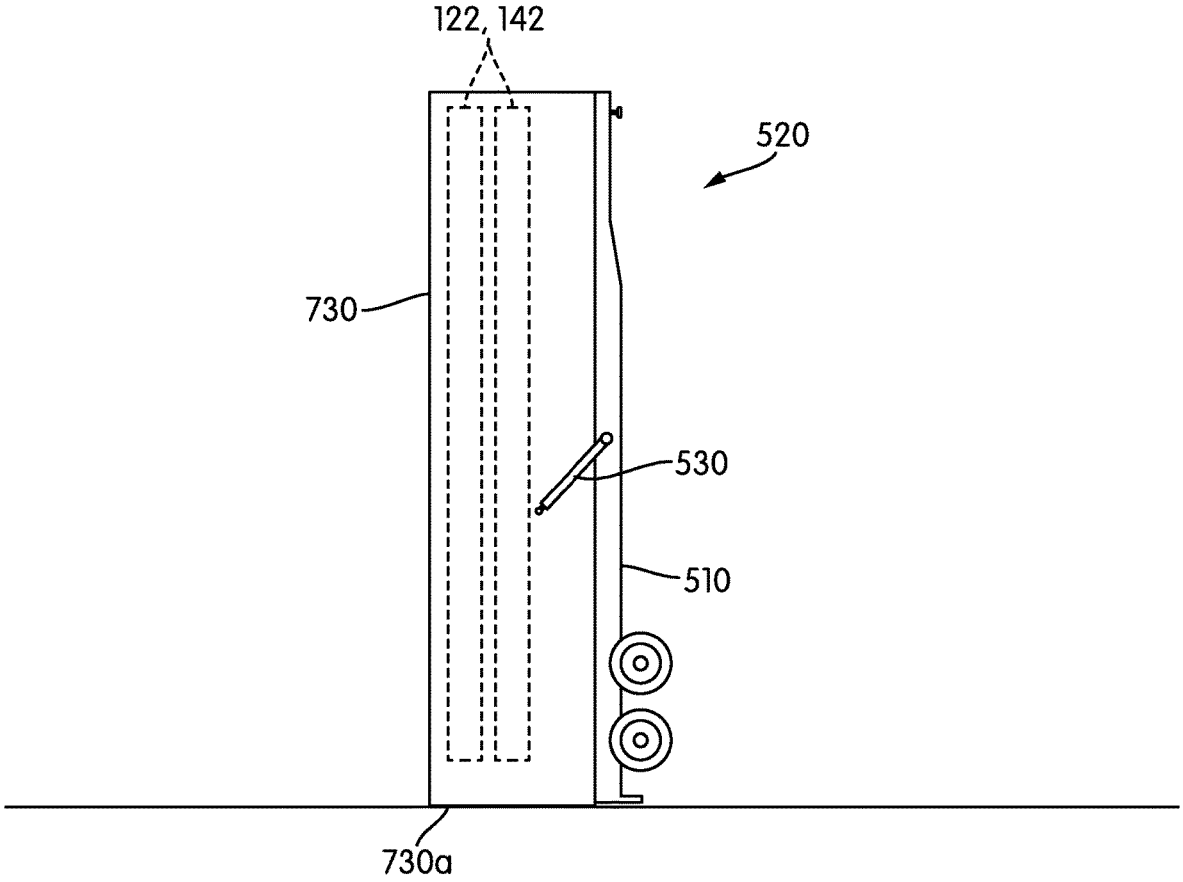
Figure 5L:
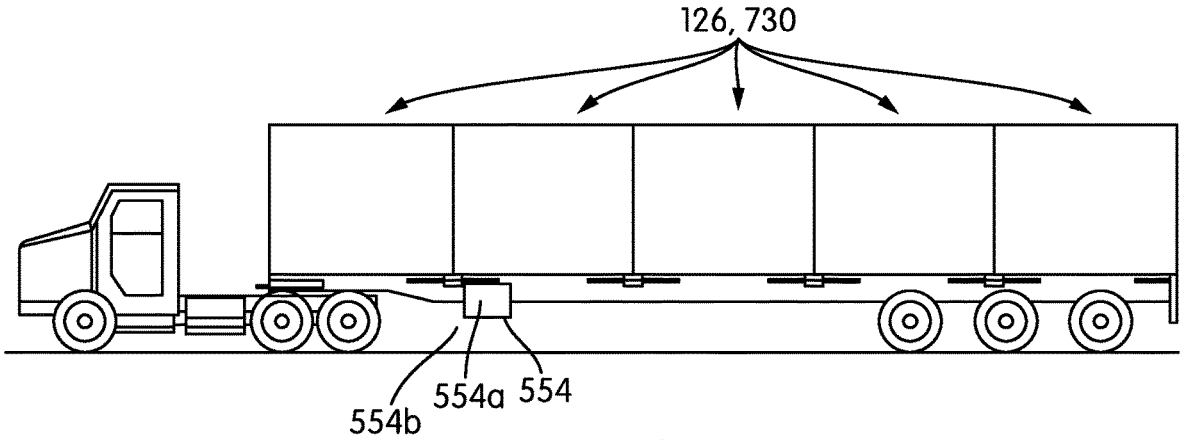
FIGS. 5*l-m* are schematics showing various features of mobile transport systems according to various embodiments of the present teachings.

As shown in FIG. 5*l*, the controls/connections 554 for the mobile transport system 120 may be positioned behind the driver's cab on the driver's side of the mobile transport system 120 (e.g., on the front left side of the mobile transport system in the U.S.). The controls/connections 554 may be disposed at a height that is accessible by the driver/user without using a ladder, steps, or reaching high overhead. According to various embodiments, the actuation points of the controls/connections 554 (e.g., connector ends, valve actuators, buttons, etc.) are accessible from the ground, which may avoid the having the operator walk on the trailer deck or reach above the trailer deck from the ground level, which pose safety and ergonomics issues. According to various embodiments, the actuation points of the controls/connections 554 (e.g., connector ends, valve actuators, buttons, etc.) are less than 8, 7, 6, and/or 5 feet above level ground upon which the system 120 is disposed. Manual control of, or connection to, each of the systems 120 or groups of vessels 122, 142 thereof may require several hoses of considerable length, additional time at fill/unload posts, and pose safety risks during and after connection. A single point interface 554 may be positioned in a location that may provide simpler and safer operator access, optimize logistics and trailer positioning, and facilitate direct line of sight from driver seat to connection for accurate and safe parking of the trailer that is part of or supports the mobile transport systems 120 at both filling and unloading sites 110, 130. The single interface 554 may also reduce the movement of the operator around the trailer 124 and all associated safety risks, and also optimizes the logistics by maximizing efficiency.

These controls/connections 554 may include, among others, hose hook-ups for connection to the mother station 110 and/or user site 130. For example, the controls/connections 554 may contain all gas connections on the trailer 124 (which may comprise one or multiple connections). Multiple or all vessels 122, 142 and associated manifolds may connect to this outlet(s) as described in other embodiments. The single interface 554 may also contain one or more electrical connections for station control of trailer tank head or manifold valves, information on stored gas properties (i.e. pressure, temperature, etc.) with a visual gauge or digital display, operator push-buttons for safety and/or ease of operating the valves, and provisions for static protection connection. The enclosure containing the operator interface equipment 554 may feature a door equipped with safety features which affect the trailer emergency brakes, as described in greater detail elsewhere herein.

Figure 5M:
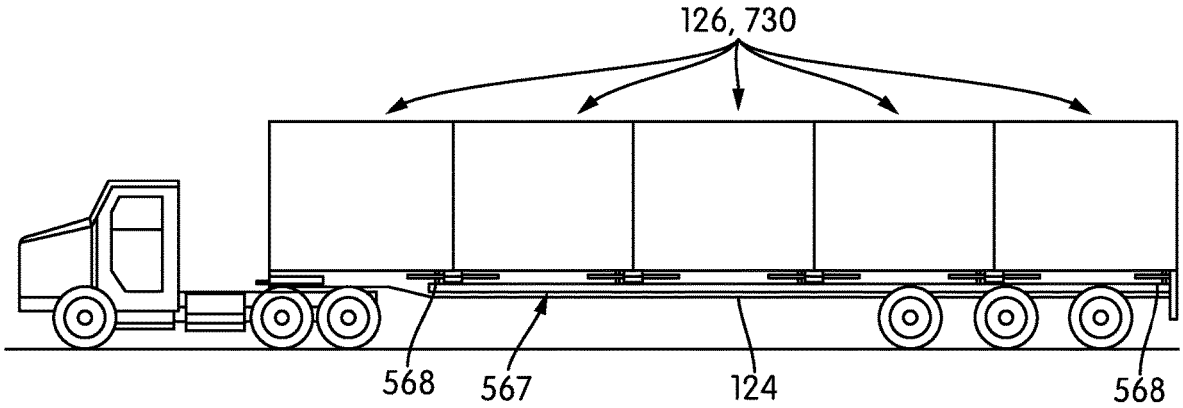

As shown in FIG. 5*m*, the trailer 124 chassis may be separable from the mobile storage modules 126, 730 to facilitate replacement of the chassis, which may wear out more quickly than the modules 126, 730. As shown in FIG. 5*m*, a single header 567 connects all vessels 122, 142 or groups of vessels in each module 126, 730 to facilitate a single operator interface 554 as described above. To increase the capacity of gas stored on each mobile storage trailer 124 and gas transported per unit of distance traveled, a trailer 124 may include of multiple modules 126, 730, as described above. Connecting to each module 126, 730 with individual hoses or piping may disadvantageous according to various embodiments (e.g., due to cost and/or time used to make and break such connections during loading and/or unloading). Also, spacing between modules 126, 730 may not be sufficient to facilitate a direct connection to each module 126, 730. A branch line 568 may run under the floor of the trailer 124 or through open space in each module 126, 730, with hard pipe or flexible hose connections to the vessels 122, 142 of each module 126, 730 along the length of the trailer 124. The mobile trailer assembly 120 may contain a branch line 568 for each flow path from the vessels 122, 142 of each module 126, 730 to the main header 567, thus facilitating an independent recycle loop header connected to the rear of all cylinders. The single header 567 may facilitate a single operator interface 554 as described above. Also, such an assembly 120 design may allow for standardization of module 126, 730 manufacturing and easy installation or removal of modules 126, 730 for maintenance or asset optimization reasons.

While various of the illustrated mobile transport systems 120 are wheeled trailers, other types of mobile transport systems 120 may be additionally and/or alternatively used without deviating from the scope of the present invention. For example, according to alternative embodiments, the mobile transport system 120 may comprise a rail car(s), a barge, a ship, etc.

Mobile Storage Vessel

Referring back to FIG. 1*a*, the exemplary virtual pipeline system 100*a* utilizes a mobile storage vessel 122, 142 in a mobile transport system 120 to transport gaseous fuel from one site (or end) to another. The mobile storage system 120 can take many forms, for example, as shown in FIGS. 4*a*-4*b*. In one embodiment, the mobile storage system 120 can be incorporated into a vehicle 124 such as a wheeled trailer (or a stand-alone truck). Because such mobile transport systems 120 tend to be expensive, it is advantageous according to one or more embodiments to minimize the time that they are being transported. This includes the time to connect and disconnect them from the loading site (e.g., the mother station 110 or the gaseous fuel supply station 107 in FIG. 1*a*) and the unloading sites (e.g., users 130*a*-*c* in FIG. 1*a*).

The virtual pipeline system 100*a* according to one or more embodiments utilizes the mobile gaseous fuel module 126, such as CNG trailers (i.e., CNG cylinders on trailers), to transport gaseous fuel at the lowest possible cost. To accomplish this, trailer utilization may be maximized according to one or more embodiments. The trailer design in FIGS. 4*a*-4*b* shows structural connections between cylinders and trailer, valves and tubing connections between cylinders, etc.

In various embodiments, the mobile storage vessel 122, 142 may itself comprise multiple storage vessels, e.g., multiple CNG cylinders. DOT regulations may require that each vessel or cylinder that makes up the vessel 122, 142 has its own shut off valve and that the valve be closed during transport. In some embodiments, the mobile storage system 120 can include, for example, about 4 or more separate CNG cylinders 122*a*, 142*a* (see FIG. 4*a*). In some embodiments, the mobile storage system 120 can include, for example, about 100 or more separate CNG cylinders 122*a*, 142*a* (see FIG. 4*a*). Different cylinders within the storage system 120 may have different sizes, shapes, diameters, or other parameters and may be positioned relative to each other so as to reduce or minimize unused space (e.g., by placing smaller diameter cylinders within the interstitial space between larger diameter cylinders). Having an operator or driver actuate each valve could take substantial time and lower the utilization of the trailer resulting in a more expensive system. In various embodiments, a mechanism is used to simultaneously actuate a plurality of (or all of) the shut-off valves of cylinders that make up the vessel(s) 122, 142. This could entail using a valve actuation system, where such system may comprise a linkage, gear train or some other mechanism, and/or an electric, pneumatic, or hydraulic actuator on each valve, and may involve linear (e.g., piston/cylinder) and/or rotary (e.g., motor) actuators. Two or more valves may alternatively be interconnected with a passive mechanism that allows the valves to be simultaneously actuated by a single operator or by a single actuation system. The mechanism may use levers and/or other systems that provide mechanical advantage to increase the torque to an extent required to simultaneously actuate the valves. The actuation may be gravity-assisted (e.g., relying on the weight of the human user). Such a mechanism can in turn be actuated manually or with the use of a powered actuation mechanism such as those described above. In turn the power for the actuation mechanism may be in the form of a manual hydraulic pump or other backup system. For example, FIG. 4*c* is a schematic showing an exemplary valve system 400*c* including multiple mobile storage vessels 122, 142 that each comprise multiple CNG cylinders 122*a*, 142*a*. The valve system 400*c* can provide a mechanism to simultaneously shut or open a desired number of valves or cylinders 122*a*, 142*a*. In various embodiments, the valve system 400*c* can be used to ensure that differing pressure capacity cylinders on a trailer are not filled past their individual limit. In various embodiments, two or more mobile storage vessels 122, 142 such as CNG cylinders 122*a*, 142*a* may be actuated simultaneously by the mechanical linkage shown in FIG. 4*c*, which may include one or more 4-bar linkages. The valve system 400*c* may include a manually operated handle in communication with the linkage. The valve system 400*c* may include an independent actuator on two or more valves. In some embodiments, all or substantially all of the vessels 122, 142 on a given mobile storage system 120 may be actuated by a single interconnected mechanism which may itself comprise multiple actuation mechanisms. In this way, the operator of the mobile storage system 120 may quickly fluidly connect or disconnect the mobile storage system to some other system such as a loading or unloading system. In other embodiments, smaller subsets of the valves of the vessels 122, 142 are ganged together (e.g., each row or column of vessels 122, 142).

The mobile storage system may also comprise a control system to control the valve actuation system. In the case where the valve actuation system is driven by a driving device (e.g. an electrical, mechanical, pneumatic or hydraulic actuator and associated systems and or mechanisms) and not a human operator, the combination of the control system and the actuation system may serve as an emergency safety device. For example, such a control system may be configured to shut fluidic connection to substantially all of the vessels in the event of an emergency situation (e.g., detection of fire, flood or seismic event). This may be of particular importance when the mobile storage system 120 is used to supply gas without operator supervision. In the event that an accident downstream of the mobile storage system results in a fire fed by the fuel contained in the mobile storage system gas (or may lead to such fire, e.g. in the event of an earthquake or flood), an automatic system downstream of the mobile storage system 120 (e.g. an end user fire detection system) may send a signal to the mobile storage system 120 to fluidly disconnect the fuel gas. Of course, such an automated control system may also shut fluidic connection in the event that the mobile storage system 120 is not connected to an approved loading or unloading device. In this way, such a system could assure that the valves remain closed during transport, as required by DOT regulations, even if the operator (e.g. tractor driver) forgets to manually signal the valve actuation system to actuate the valves to the closed position prior to transporting the mobile storage system 120 on the road. For example, such a system could be configured to prevent a third party driver from stealing gas by connecting to an unapproved unloading device because the signal used by the control system to enable actuation may be difficult to duplicate. In another example, the safety functionality is demonstrated in the case of accidental "drive away" events. If the driver accidentally drives away from a loading or unloading system without first disconnecting the mobile storage system 120 from the loading or unloading system, the automated actuation system may serve as an added safety feature by preventing release of fuel gas in the event that the breakaway connections (if any) fail to protect the other components during an accidental drive-away event.

According to various embodiments, the various individual storage vessels 122, 142 (e.g., cylinders) may be coupled into modules or pods (e.g., where each module or pod would occupy different sections of a trailer, different trailers or where different combinations of such modules or pods may be incorporated on a given trailer) which then allow easy customization into new geographical regions or applications without impairing the price of the asset and reflecting a modular approach to capacity optimization as well as targeting economies of scale in manufacturing by focusing on large quantities of modular units.

In various embodiments, to maximize trailer utilization, it is desirable to empty each trailer as much as practical prior to being picked up for refilling. The state of fill of trailer can be accurately determined by knowing the trailer's temperature and pressure. In order to coordinate the transportation of such vessels, it is often helpful to be able to monitor the pressure and temperature remotely, e.g. from a central dispatch center using wireless signal. To aid in such monitoring, the mobile storage vessels 122, 142 may be equipped with a monitor and relay system 400*d* used to monitor trailer gaseous fuel content as shown in FIG. 4*d*. For example, the system 400*d* may include, a temperature measurement/management device 482, a pressure measurement/management device 484, and an information transmission device 486 (e.g., transmitter using any suitable wired or wireless connection such as WIFI, WIMAX, cellular network, wireless data network, satellite, etc.) to relay the temperature and pressure readings back to one or more central dispatch centers. The system or device shown in FIG. 4*d* may remotely report the position of the mobile storage vessel or the mobile transport system, which can further include a location measurement device 488, which can monitor GPS signals, for example.

Safety Interlock/Warning System

Another factor with mobile transport system 120 (e.g., a truck loaded with tube trailers) is safety. When loading or unloading, such mobile transport systems are typically connected to a stationary loading or unloading station. This creates the risk that an operator can attempt to move the mobile storage vessel while still connected to a stationary system. This has the potential to damage equipment, injure personnel nearby, and/or create logistical delays as stranded equipment can block the regular delivery service. Although such connections are typically equipped with emergency break-away connectors, such accidents should be avoided. One particular device that can help reduce the occurrence of such drive-away accidents is a system to lock the brakes on the trailer 124 or tractor/truck when connected to a loading or unloading station. For example, FIG. 4*c* is a schematic showing trailer brake/trailer-to-customer-pipe connection interlock. Such a system 400*e* may include a valve that releases pneumatic pressure to the braking system (thereby locking the brakes of the tractor and/or trailer 124) when the trailer-to-customer or trailer-to-mother/filling-station pipe connection is made. Such a valve may be actuated, either mechanically, electrically, hydraulically or pneumatically. Such a valve may be actuated when the access panel to the connection fittings is open or when a sensor senses a trailer-to-customer-pipe or trailer-to-mother/filling-station gas line connection, and responsively locks the braking system or otherwise prevents the mobile storage system 120 from moving. Such a connection sensor may take any suitable form (e.g., a magnetic close-contact-based switch that senses when the trailer-to-customer/mother-station gas connection is made, a mechanical switch that is activated by the pipe fitting connection being made). In other embodiments, such a valve may be actuated by some other signal including but not limited to a sensor signal where such a sensor may detect any condition that may indicated a safety risk including but not limited to mechanical force on the connection system to the mobile storage system pressure in the connection system or some other signal.

Figure 11:
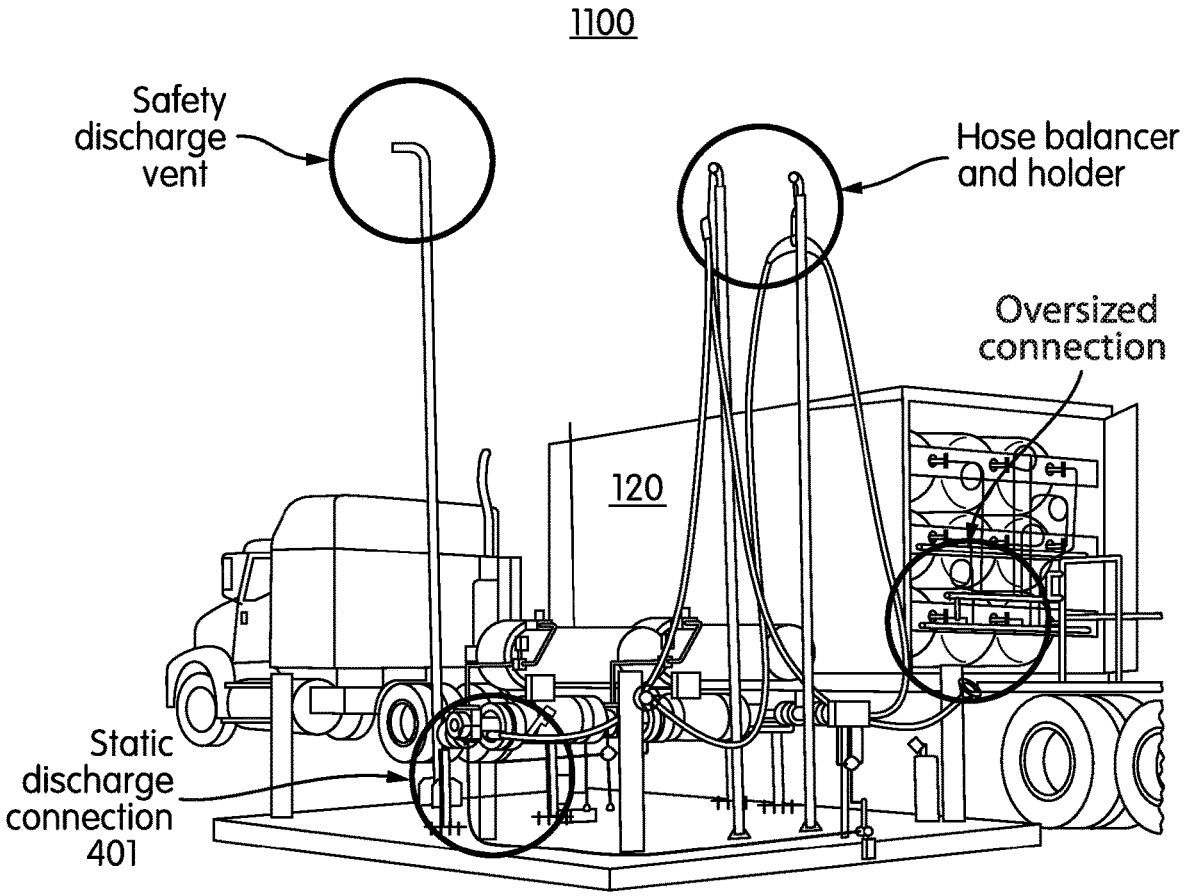
FIG. 11 is a schematic showing an exemplary loading/unloading station in accordance with various embodiments of the present teachings.
Figure 12:
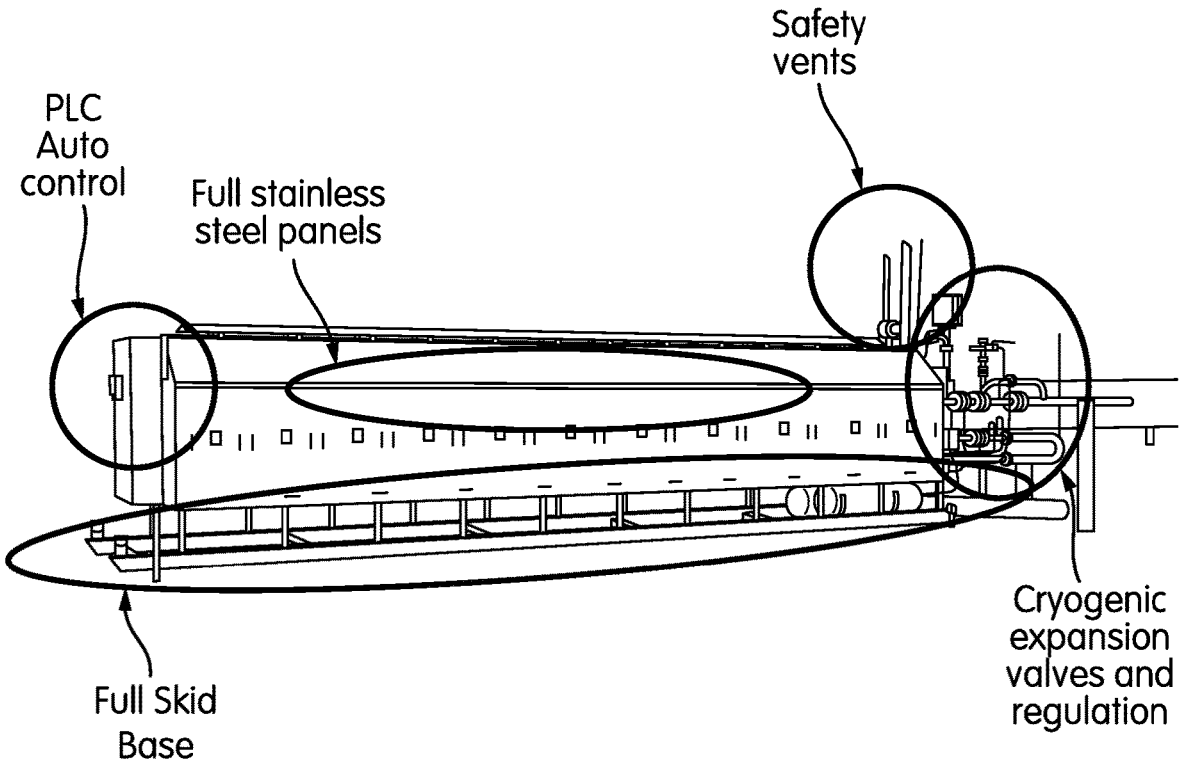
FIG. 12 is a schematic showing an exemplary unloading heater in accordance with various embodiments of the present teachings.

As shown in FIG. 4*c*, the interlock system 400*e* may also take into account a static discharge/grounding connection 401 (see FIG. 11) that should be made between the mobile transport system 120 and the ground before connecting the vessels 122, 142 to another line (e.g., the mother station 110 or user site 130). The system 400*e* senses whether the static discharge connection 401 is connected. If the system 400*e* senses that the static discharge connection 401 is connected, the system 400*e* locks the brakes, thereby preventing damage to the static discharge connector 401, which might otherwise occur if the mobile storage system 120 were moved before disconnecting the static discharge connector 401. Conversely, the system 400*e* may include a gas valve in the gas line 116 to prevent the flow of gas between the vessels 122, 142 and the connected line (e.g., the mother station 110 or user site 130) if the static discharge connection 401 has not been made.

Additionally and/or alternatively, the interlock system 400*e* may lock the tractor and/or trailer brakes when a sensor 554*b* senses that an access door 554*a* to the controls/connectors 554 (shown in FIG. 5*l* and discussed below) is open. According to various embodiments, the access door 554 must be open to facilitate gas and/or electrical connections to the system 120, such that the access door 554*a* position provides a simple indication of connections that warrant locking of the brakes. According to various embodiments, opening the access door 554*a* results in the locking of the brakes until the access door 554*a* is closed.

The interlock system 400*e* may additionally and/or alternatively lock the system 120's (e.g., the trailer 124's) brakes and/or the connected tractor's brakes in response to a variety of other sensed events.

Conversely, in response to various triggering criteria, the interlock system 400*e* may be configured to do a variety of things, for example:

- shut down or prevent operation of the system 120;
- prevent the opening of the access door 554*a*; and/or
- turn off various connections or valves (e.g., the individual valves of the vessels 122, 142 or a system-wide master shut-off or slain-shut valve) disposed between the vessels 122, 142 and a hose/connection leading to the mother, user, or other external site 110.

The triggering criteria may be, for example, any one or more of:

- the brakes of the trailer 124 and/or connected tractor/truck being released;
- movement or vibration of the system 120, vessels 122, 142, connected tractor, etc.;
- an inclination of the system 120, vessels 122, 142, modules 126, 730 relative to horizontal;
- opening or closing or a door or access panel of the system 120;
- predetermined upper or lower pressure or temperature thresholds of the gas in the vessels 122, 142 or at other points in the system 120 exceeding a predetermined threshold; and/or
- flow rate into or out of the vessels 122, 142 exceeding or falling below a threshold.

Additionally and/or alternatively, the interlock system 400*e* may provide a warning indication (e.g., a light, sound, etc.) when an operator attempts to either (a) release the tractor/truck/trailer brakes while the system 120 is operatively connected to a site 110, 130, or (b) open the door 554*a* or make connection(s) between the system 120 and the site 110, 130 when the brake is released.

The interlock system 400*e* may comprise one or a combination of various mechanical, or hydraulic, or pneumatic, or electric or electronic transducers or other sensors connected to the processor/controller of the interlock system 400*e* by wire, mechanical, pneumatic, hydraulic, or wireless connector(s).

The interlock system 400*e* may or may not include redundancy and can be configured to accept signals from one or various system 120 or site 110, 130 transducers, providing monitoring, diagnostic, alarm or emergency shutdown depending on the conditions and configuration. A test algorithm may be include to facilitate diagnostic tests on the interlock system 400*e*.

The interlock system 400*e* may operate continuously, or be activated automatically each time the interlock system 400*c* is prepared to start operation.

Figure 4F:
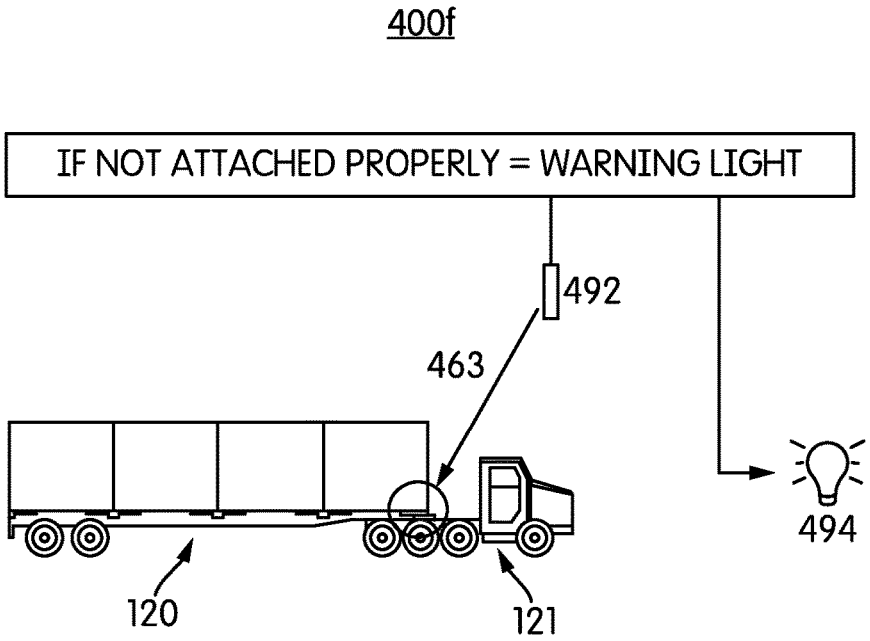
FIG. 4*f* is a schematic showing fifth wheel connection/hitch warning device in accordance with various embodiments of the present teachings.

As shown in FIG. 4*f*, even when such a trailer 120 is not connected to the loader (see 107 or 110 in FIG. 1*a*) or unloader (see 130 in FIG. 1*a*), there remains the risk that the trailer will become unintentionally disconnected from the tractor 121. This can happen when the operator incorrectly attaches the tractor 121 to the trailer 120. Such mistakes can include high-hitching, when the king pin on the trailer 120 is only partially engaged on the fifth wheel on the tractor 121, or an incompletely latched fifth wheel that will result in "dropping" the trailer 120 as the tractor 121 drives away. Dropping the trailer 120 can damage the trailer 120, damage the tractor 121 and/or strand equipment resulting in interference with future deliveries. In addition to operator procedures, various safety devices can be implemented to reduce the occurrence of such accidents.

For example, FIG. 4*f* is a schematic showing fifth wheel connection/hitch warning device. As shown, the device 400*f* connects the fifth wheel with a sensor/monitor 492 to indicate to the driver in the cab, by an indicator 494, for example, that the fifth wheel is properly engaged with the trailer 120, or warn the driver when there is a problem. In this manner, the devices shown in FIGS. 4*e*-*f* can be used to reduce the incidence of accidental damage to the system 120 due to movement. The devices can monitor and report to the driver the disposition of the connection, e.g., between a tractor 121 and trailer 120 and can give an alarm (see 494) when the fifth wheel is disconnected or incompletely connected while the electrical and hydraulic connections to the trailer are in place. In various embodiments, the device may send an alarm to the driver if the brakes are released while the vessel remains connected to a stationary system. When the device 400*e* locks the brakes of the trailer while the trailer 120 is connected to a loading or unloading system, the locking is accomplished, e.g., by releasing the pneumatic pressure in the braking system using a mechanism, e.g., actuated by an access panel to the vessels filling and/or unloading connections. In various embodiments, a connection can prevent such panel from being in the normally closed position.

According to various embodiments, the system 400*e* may provide warnings (e.g., visual, audible, etc.) when a sensed parameter deviates from a preferred range ("yellow zone"), and takes affirmative action (e.g., shutting down the system 120, closing shut-off valves, taking any of the above-discussed affirmative actions) when the sensed parameter deviates further from the preferred range and enters an unacceptable range ("red zone"). The system 400*e* may indicate (visually and/or audibly) which parameter has deviated from the preferred and/or unacceptable range, and may indicate the sensed measurement (e.g., via gauges with green (acceptable), yellow (outside preferred), and red (unacceptable) range indications thereon).

The system 400*e* may additionally and/or alternatively provide warnings (e.g., visual and/or audible) if a leak is detected, lines are incorrectly connected, valves are not in their expected or correct state, brakes are released, etc.

The system 400*e* may include a remote monitoring/control system by which the system 400*e* is operatively connected (e.g., through cellular, WIFI, and/or other wireless connections) to a geographically different site (e.g., a central headquarters for the virtual pipeline system) to supply the sensed state of the system 400*e* to the different site and/or enable the different site to activate parts of the system 400*e*.

The system 400*e* may include a data storage system that records the sensor readings and actions taken by the system 400*e* for later analysis (e.g., black box data).

The system 400*e* may include warnings (e.g., visual or audible) that indicate to an operator that the system 120 is in use, such that the system 120 should not be moved and the brakes should not be released.

The system 400*e* may include redundant systems that are designed to operate even if the main system 400*e* fails to function properly.

Types of Vessels 122, 142

In various embodiments, the mobile gaseous fuel module 126 of FIG. 1*a* including, e.g., trailers 120, can be optimized for storage capacity. Delivering natural gas via mobile storage vessels 122, 142 involves the capital cost of the mobile transport system 120 and the trucking cost to move the system 120. For a flow rate and distance, a small volume system may be transported more often, or a large volume system may be transported less often. When both the capital and transportation costs are known, the optimum vessel size can be calculated. However, for large customers, the optimum trailer size may be too large to be allowable on the available road systems. For example, trucks on US highways are typically limited to 100,000 lbs. GVW and sometimes 80,000 lbs., and often less on smaller roads. Some international locations allow for much higher weights, such as the case of Australia where truck trailer combinations may exceed 200,000 lbs. or Canada where a B-train configuration is allowed 137,500 lbs without a special permit. When the optimum trailer size is constrained by the maximum allowable vehicle weight, it may be advantageous to achieve the maximum storage volume for a given vehicle weight. As an example, CNG trailers may include an array of CNG vessels 122, 142 (e.g., CNG cylinders 122*a*, 142*a*) on a trailer 120, e.g., see FIGS. 4*a*-4*b*. These trailers typically utilize metal (e.g., steel, aluminum, etc.) cylinders ("Type I"), composite hoop-wrapped (exposed metal heads with the body of the cylinder being wrapped in composite material) metal cylinders ("Type II") or composite fully-wrapped metal cylinders (the entire metal cylinder including the heads being wrapped with composite material) ("Type III"), impermeable composite-lined composite-wrapped cylinders ("Type IV"), which may be in the process of being permanently certified for use on US roads and internationally and/or impregnated composite cylinders which are impregnated with an impermeable resin ("Type V"). In some cases, optimizing a trailer 120 may entail using the lightest available cylinders approved for use. However, in other cases, the optimum trailer 120 size may be obtained by lowering the trailer 120 cost per volume stored. The lowest performing CNG cylinders in terms of gaseous fuel stored per cylinder weight (Type I) may have the lowest cost in terms of dollars per stored volume. In some cases, optimum trailer configurations can be obtained by mixing cylinder types. In such cases, the respective cylinders may be only filled to their respective maximum operating pressures. This can be achieved with an automatic regulation valve system or other means.

Various embodiments may thus include a system to enable the use of multiple CNG DOT cylinder 122*a*, 142*a* types in a single mobile storage unit 122, 142. The system 120 may include a device to deliver gaseous fuel in each cylinder type while ensuring that a working pressure does not exceed the maximum allowable working pressure in each cylinder type. The system 120 may also include a system of pressure regulation valves that blocks fluidic communication between a cylinder and a manifold when the pressure in the manifold exceeds the maximum allowable working pressure of the cylinder and allows such communication when the pressure in the manifold is lower than the maximum allowable working pressure of said cylinder.

Vessel 122, 142, 422 Regulator

Figure 4G:
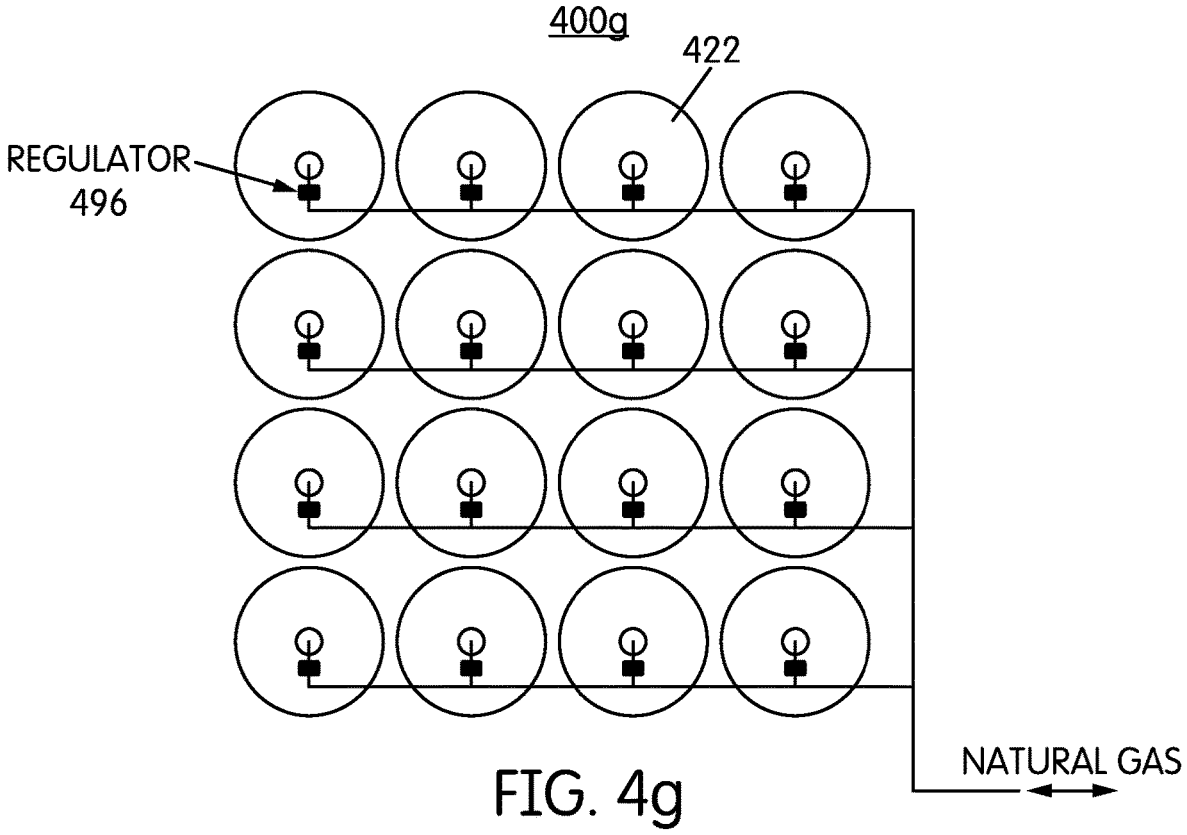
FIG. 4*g* is a schematic showing a regulating system for a mobile transport system containing a plurality of mobile storage vessels in accordance with various embodiments of the present teachings.
Figure 4H:
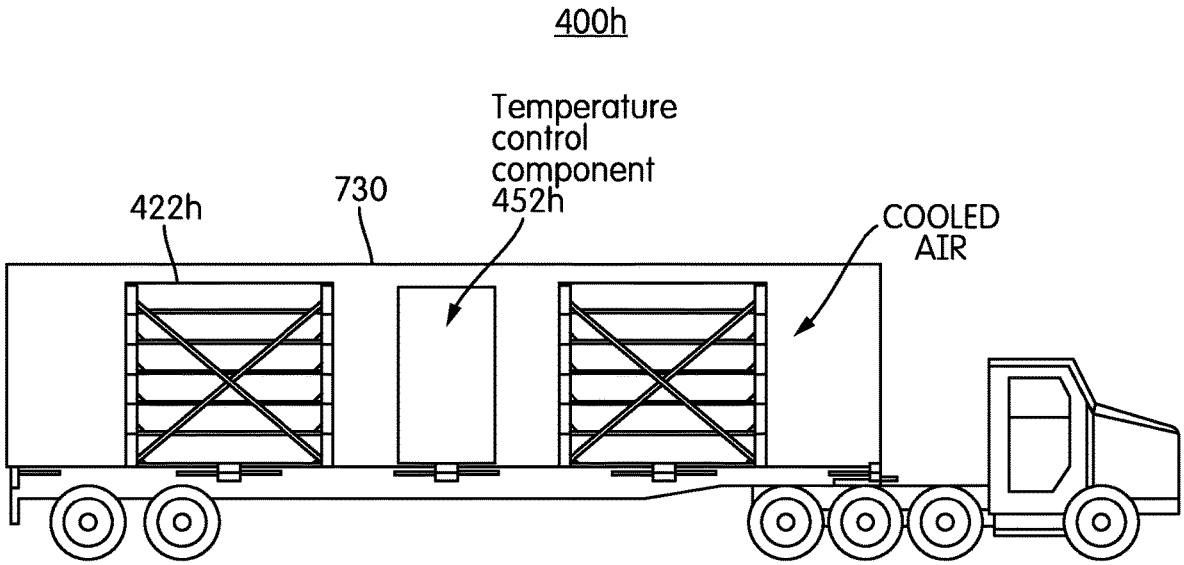
FIG. 4*h* is a schematic showing an exemplary mobile transport system having a temperature control component in accordance with various embodiments of the present teachings.

FIG. 4*g* is a schematic showing a regulating system 400*g* for a mobile transport system 120 containing a plurality of mobile storage vessels 422, e.g., cylinders. As shown, each vessel 422 may be connected to a respective regulator 496. However, in some embodiments a single regulator may be connected to a plurality of vessels 122, 142, 422 (e.g., a row or column of vessels 122, 142, 422) or even all the vessels 122, 142, 422 in a given mobile transport device 120. In various embodiments, the storage capacity, content in the vessel 422, temperature and pressure of the gaseous fuel in the vessel can be separately monitored and/or regulated as desired. In various embodiments, gaseous fuel cylinders such as CNG cylinders may be cooled such that storage capacity can be increased. At high pressure, methane behaves substantially differently than an ideal gas. When cooled below −40° C., its density increases substantially. FIG. 4*h* is a schematic showing an exemplary mobile transport system 400*h*. As shown, the system 400*h* may include an array of vessels 422*h* such as CNG cylinders within an insulated container 730 and maintain said container 730 at a temperature by a temperature control component 452*h*, which can be a cooler or a heater. For example, in order to increase storage density for a given storage pressure in the container 730, the temperature control component 452*h* can be a cooler to provide cooled air and to reduce the temperature in the container 730. Such cooling can be achieved in suitable manners including but not limited to, active refrigeration. In one example, CNG vessels can be packaged within an insulated enclosure and can be cooled to maintain a temperature. Alternatively, the CNG vessels may also be heated to maintain a given pressure.

When operating vessels 122, 142, 422 below ambient temperature, typically a passive or active refrigeration mechanism will be used to avoid or decelerate temperature rise, as well as insulating material. The insulating material in turn may be used as a strengthening material, for example carbon fibers combined with a low-conduction resin may perform both functions.

Another method to increase the strength of the materials is to use a material with higher strength/cost ratios, such as cables, which reinforce the vessel in the typical stress points, effectively distributing the stress to the cables instead of the shell of the vessels. These cables may in turn be combined with the insulating wrapping or other types of cables to complete the covering of the vessel.

Figure 4I:
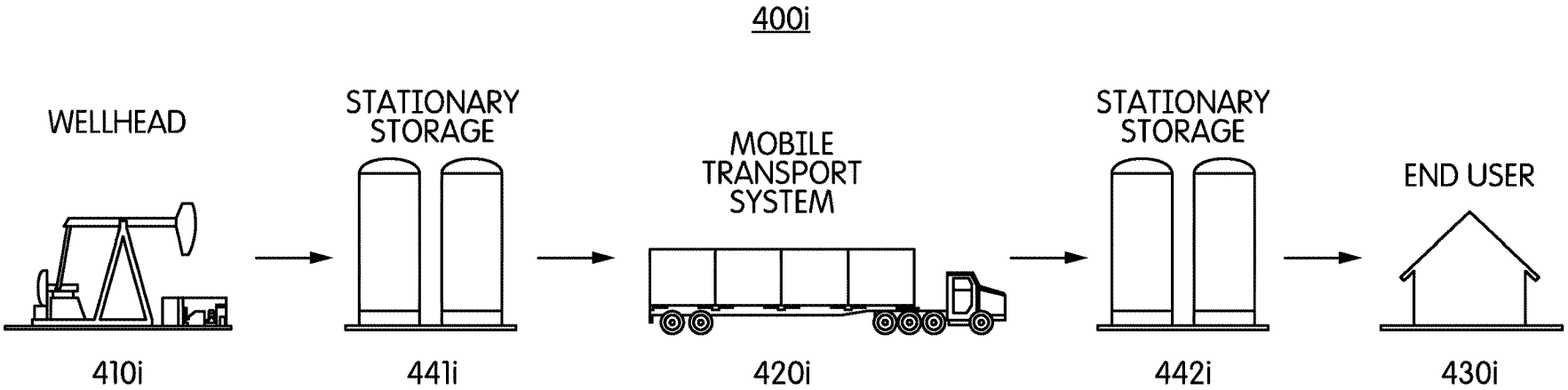
FIG. 4*i* is a schematic showing an exemplary virtual pipeline system including stationary storage vessels in accordance with various embodiments of the present teachings.

FIG. 4*i* depicts a virtual pipeline system 400*i* including a gas supply in the form of a wellhead 410*i*, a mother station with a stationary storage vessel 441, a stationary storage vessel 442*i* connected to a user site 430*i*, and a mobile transport system 420*i* that transports gas from the storage vessel 441*i* to the storage vessel 442*i* and/or end user side 430*i*.

Users

Referring back to FIG. 1*a*, the user 130 may include, e.g., an unloading system 132, a metering system 134, pressure/temperature (P/T) regulation system 136, and/or flow rate control and monitor, a storage vessel 143, an optional compressor 113, and/or an optional temperature control component such as a heater 153 or a cooler. The user 130 can be a fixed user 130*a* or 130*b* (e.g. a factory) or a dispensing system 130*c* including, for example, a CNG filling/daughter/intermediate station for CNG trailers or vehicles 160*a-c* in FIG. 1*a*. The storage vessel 141, 143 in the mother station 110 or user site 130 may be a "stationary" storage vessel, with respect to the "mobile" storage vessel 122, 142 in the mobile transport system 120, although the storage vessels 141, 143 and 122, 142 used may be the same or different. Storage vessels may be any device that stores gaseous fuel and commonly will involve storing natural gas under compression or otherwise.

It should be noted that the term "user" (e.g., see 130 in FIG. 1*a*) should be taken to mean a user of the virtual pipeline system, which connects to the mobile transport system 120 and receives gaseous fuel from the mobile transport system 120, and the gaseous fuel unloaded in the user site may further travel to any number of places including other end users/customers such as burners and engines (see 130*a-b* in FIG. 1*a*), and non-end user destinations (e.g., see 130*c* in FIG. 1*a*) including, for example, other virtual pipelines, actual pipelines and/or CNG filling stations for use as primary fuel aboard vehicles. As a non-limiting example, the user may be mobile such as where CNG is used to fuel oil field equipment that may be moved from site to site every few days. In such cases, the components shown as 130*b* may also be set up in a portable configuration such as on a trailer.

FIG. 1*b* is a schematic showing an exemplary virtual pipeline system 100*b* for transporting gaseous fuel from a mother station 110*b* to an end user 130 by a mobile transport system 120*b*. FIG. 1*c* is a schematic showing an exemplary virtual pipeline system 100*c* for transporting gaseous fuel from a wellhead 110*c* to a gathering station 130 via a mobile transport system 120*c* in accordance with various embodiments.

Gas Capacity

FIG. 1*d* is a schematic showing an exemplary virtual pipeline system 100*d* for transporting gaseous fuel from a pipeline 101 at a gaseous fuel supply station to an end user 130 via a mobile transport system 120*d* in accordance with various embodiments. When the virtual pipeline system 100*d* transports gaseous fuel from the gaseous fuel supply pipelines 101 to users 130 as shown in FIG. 1*d*, connections to the pipeline 101 must be considered. Pipeline connection agreements sometimes apply a financial penalty if flow from the pipeline is above or below a specific range. If the mother station 110 is intermittently filling the mobile storage vessel 122, 142, e.g., positioned on trailers, of a mobile transport system 120*d*, flow from the pipelines 101 may fall outside the proscribed limits resulting in increased gaseous fuel purchase costs. To avoid this, the mother station 110 may include the substantial on-site (or stationary) storage vessel 141. Such storage vessel 141 may be in the form of LNG, CNG, ANG or any other practical form. If CNG is used, the storage pressure may be above or below the desired trailer storage vessel 122, 142 pressure.

In addition, given the high volumetric efficiency gains from cold storage, storage vessels (e.g., mother station storage vessel 141, mobile storage vessel 122, 142, user storage vessel 143, etc.) temperatures may be kept substantially below the ambient environment to increase the density, and therefore quantity, of the gas stored in a given volume of storage vessel. According to various embodiments, refrigeration or other cooling equipment may be used to reduce the storage vessel temperature. According to various embodiments, the storage vessel temperature is kept: below 60, 50, 40, 30, 20, 10, 0 and/or −10° F.; above −50 and/or −40° F.; and/or between 60 and −40° F., between 40 and −40° F., between 20 and −40° F., between 0 and −40° F., and/or between −10 and −30° F. According to one or more embodiments, −20° F. provides an efficient, economical temperature, depending on the ambient temperature due to the lower working temperatures of common steal alloys. According to various embodiments, conventional, large scale commercial refrigeration/temperature control units can be used.

The storage vessels 141, 22, 142, 143 may use a combination of higher pressure, higher volume, an adsorbent (described below), and/or lower temperature to increase the gas capacity of the vessel 141, 22, 142, 143 or others vessel(s) used in various embodiments.

Use of Cooled Gas

To enhance the cost-effectiveness of the stationary upstream storage vessel 141, as well as to average out the refrigeration needs of the system, the gas may be cooled before and during storage in any of the vessels 122, 141, 142, 143. The additional mass storage capacity obtained may be 30% or higher depending on ambient temperature and storage temperature, for the same volume vessel. This allows a reduction in footprint and storage vessel capital cost. The storage at this vessel 141 may also be at a pressure higher than 3,600 psig so that there is driving force (differential pressure) to increase the rate of flow/transfer into the smaller vessels/cylinders 122, 142. This vessel 141 storage pressure may be at 3,000-77,000 psig depending on the specifications of the connection hoses/couplings which are typically the lowest pressure rated pieces in the system.

According to one or more embodiments, the cooled loading system 114 compresses, or integrates with a compression system, and cools the supplied gas. The cooled, compressed gas is then stored in high pressure-rated vessels (e.g. 5,000 psig) 141 at a low temperature (e.g., between 30 and −40° F.). Temperature and pressure limitations may be limited by the industry-standard hoses available. Higher pressure ratings and lower temperature ratings may further benefit the operation of the system if higher pressure and lower temperature rated components are used.

Cooled Loading

The cooled loading system 114 according to one or more embodiments is hereinafter described with reference to FIGS. 3*a* and 3*b*.

Mobile storage vessels 122, 142 are frequently filled and emptied when being utilized to store and/or transport gas, starting at low pressure and low gas mass inside the vessel 122, 142, until it reaches a design pressure point. The compressor 112 can be used to compress gaseous fuels such as natural gas supplied from a gas supply 107 to provide compressed natural gas (CNG), for example, to mobile storage vessels 122, 142. Valves 336, 337 in the supply line between the source vessel 141 and vessel 122, 142 being filled may be used to selectively start, stop, and control filling.

As a physical effect, gas heats up as it's compressed inside of a vessel 122, 142, in this case by additional gas being introduced into the vessel 122, 142. In various embodiments, if adsorbents (discussed below) are used, the heat of adsorption also leads to further heating of the gas. As with any gas and compressible fluids, higher temperatures translate into a lower density.

The resulting higher temperature in the vessel 122, 142 results in reduced gas storage capacity within the vessel 122, 142. Such undesirable under filling has been addressed in various ways:

a. Filling to a pressure higher than the operating pressure permitted for mobile use of the vessel 122, 142 (e.g., pressure in excess of DOT regulations). To comply with governmental regulations, the vessels may have to remain stationary for an extended period of time while holding a pressure higher than their approved operating pressure for transport over public roads.

b. Cooling the gas before inserting into the vessel 122, 142, through mechanical refrigeration and heat exchangers. This method has underperformed its expectations due to the present inventors' discovery that temperature gradients develop between the injection and opposite ends of a vessel 122, 142 and translate into a cold cylinder section on the inlet side and a hot section on the opposite end. To generate appreciable filling improvements using cooled loading, companies have resorted to near cryogenic refrigeration (e.g., at or below 40° F.), which adds a considerable cost due to the exotic materials required as well as a large operating expense to run the mechanical refrigeration used to effect these temperatures.

c. Allowing vessel 122, 142 to sit idle or slow fill in order to enable convective heat transfer of the heat of compression to the external environment. This has several downsides, including an extended residence time of the cylinders/vessels 122, 142, leading to idle utilization and higher CAPEX/OPEX expenditures. Such higher CAPEX expenditures stems from the need far more mobile storage systems for a given customer load because the such systems require more time to fill which may necessitate, in some cases, the need for multiple systems to be filling at one time. In addition, when ambient temperatures are significantly above the cylinder rated temperature, under filling is further aggravated.

In order to increase the amount of gas stored in a vessel 122, 142, composite-strengthened cylinders (composites have a higher strength/weight ratio than many common metals) may be used. The increased use of composite-wrapped cylinders has led to a reduction in the convective transfer rate of the cylinder walls (composites have lower thermal conductivity than metals) and also suffer from structural weakening at higher temperatures leading to a lower overfill pressure allowance due to the temperature rise (composites weaken considerably under elevated temperatures as compared to metals). Thus, under filling of cylinders has become more prevalent in recent years.

The economics of virtual pipelines are greatly affected by performance of the cylinder/vessel 122, 142 fill process. For example, a slower fill process: (1) reduces mobile transport system 120/mobile gaseous fuel module 126 utilization because they remain at the mother filling station 110 longer; (2) may require a greater number of vessel rill stations (including related components such as meters, fill hoses 116, real estate) if each mobile transport system 120/mobile gaseous fuel module 126 remains at a station 110 filling longer. Throughput per acre is reduced, leading to larger land areas needed to accommodate longer fill times, which places a limit on capacity in a predetermined mother station 110 site.

Mechanical refrigeration systems used to perform pre-inlet cooling of the gas to be inserted are expensive and don't necessarily guarantee a complete fill due to the temperature gradients that develop inside of the cylinder leading to an average temperature inside the cylinder to be significantly higher than the mass rating for the cylinder group.

Operating expenses may also be considered:

i) The energy required for mechanical refrigeration;

ii) Additional wear and tear of filling stations;

iii) Additional drivers, trucks, and other transport related expenses;

iv) increased truck traffic and complexity for management due to smaller capacity per unit of transport;

v) Wear and tear from high temperature cycling of vessels 122, 141, 142, 143; and vi) Additional programming and preparation to account for changes in ambient temperatures, cylinder types, and other modes of operation.

Increased truck traffic may also create problems for nearby communities.

As a result, for transportation/mobile applications it is advantageous to use a lower storage temperature in order to achieve higher densities of the gases carried, which, in turn, reduces the capital expense and operating expense associated with it.

Figure 3A:
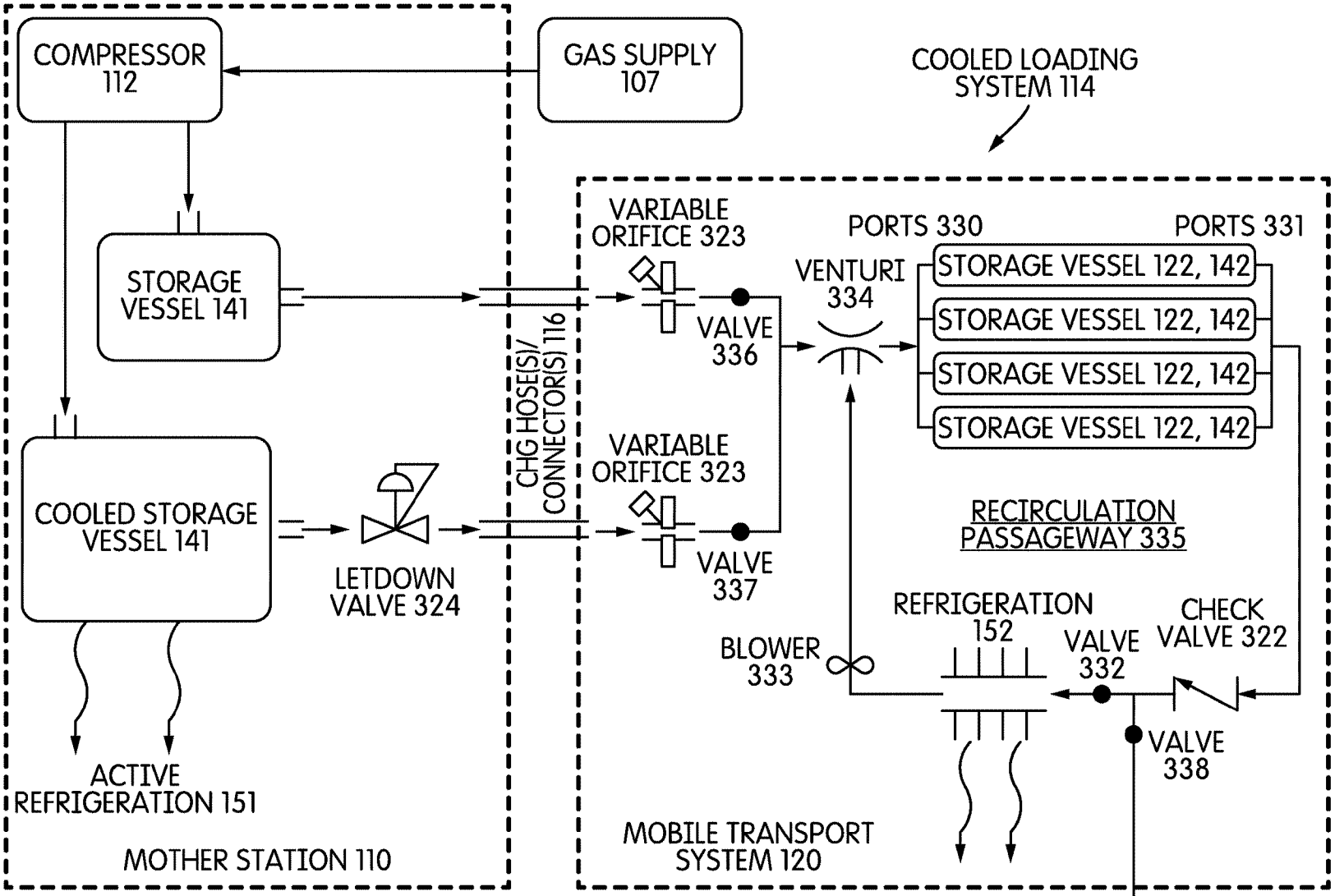
FIG. 3*a* is a schematic showing a cooled loading system according to one or more embodiments.
Figure 3B:
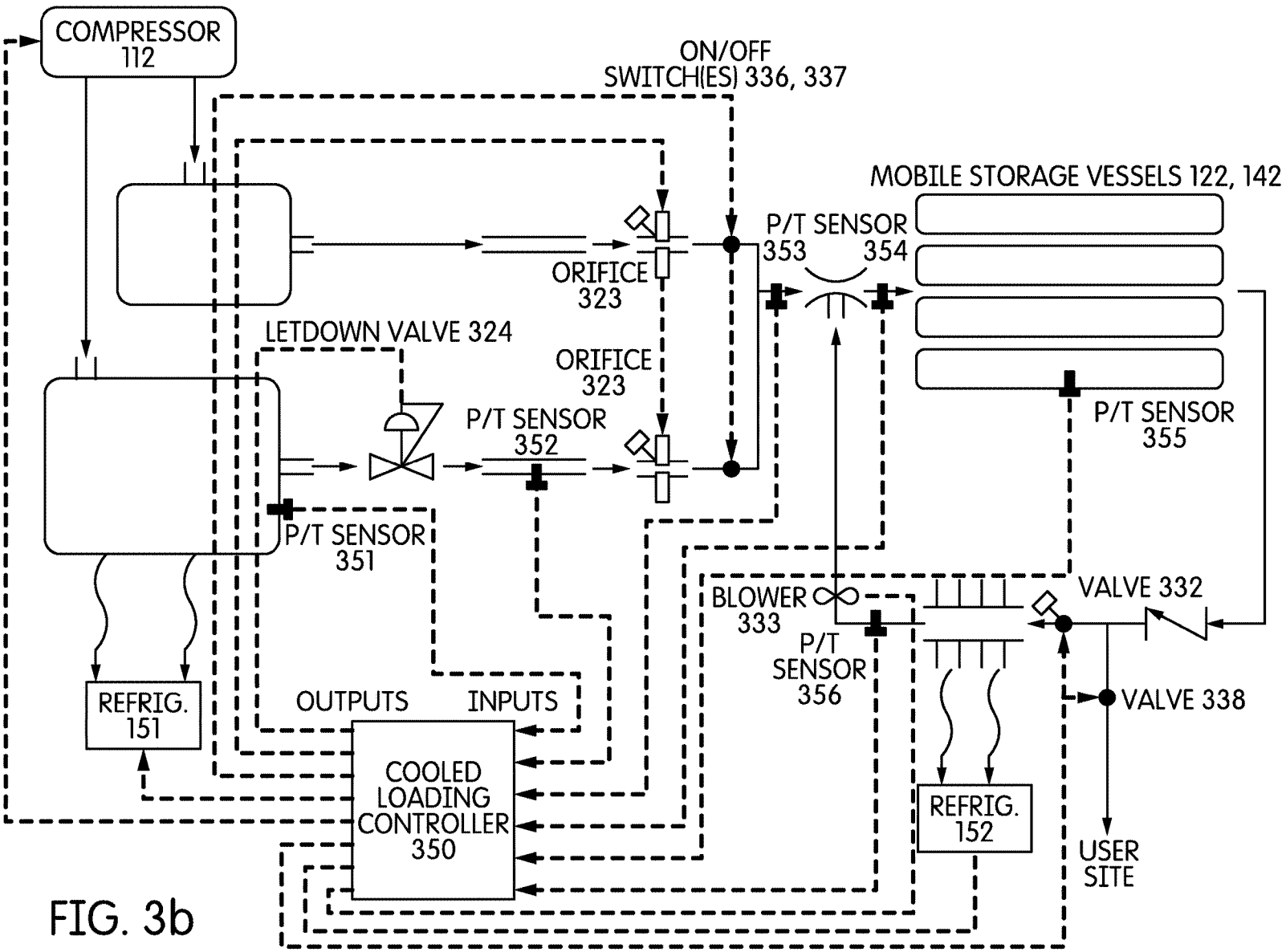
FIG. 3*b* is a schematic illustrating various input and output parameters of a controller for the cooled loading system of FIG. 3.

According to one or more embodiments, the cooled loading system 114 illustrated in FIGS. 3*a* and 3*b* may provide a faster, cheaper, and/or more complete filling operation for the vessels 122, 142.

The cooled loading system 114 can be used to pre-cool the gaseous fuel to a temperature lower than an ambient temperature, prior to introducing the gaseous fuel to: (1) the mobile transport system 120 (and vessels 122, 142) to allow the gaseous fuel to reach the maximum allowable pressure upon returning to ambient temperature (i.e., upon increasing temperature); or (2) a CNG storage vessel 141 at the mother station 110. According to various embodiments, the cooled loading system 114 can significantly improve the economics of the storage and transport of gases in mobile cylinders/containers/vessels 122, 142.

That is, gaseous fuel can be compressed and pre-cooled at the mother station 110 (e.g., in a storage tank 141 that is actively cooled by a refrigeration unit 151 and/or via a non-cooled storage tank 141 whose gas is cooled inline between the storage tank 141 and the vessel 122, 142 being filled) prior to introduction to the mobile transport system 120. Pre-cooling process of the gaseous fuel can be achieved through any suitable methods, including but not limited to, Joule-Thompson (JT) effect cooling (i.e., caused by decompression from a higher pressure, e.g., via variable orifices 323), active refrigeration using an external refrigeration system and a heat exchanger (e.g., via refrigeration systems 151, 152), passing the gaseous fuel through a bed of a phase change material that absorbs heat as a result of the phase change, passing the gaseous fuel through a thermal mass that has been pre-cooled, and/or a combination of these cooling methods. For example, the JT effect cooling mechanism may include a pressure regulation valve 323, which can be a part of the mother station 110. Alternatively, as shown in FIG. 3*a*, the regulation valve(s) 323 can be a part of mobile transport systems 120 that are being filled.

According to various embodiments, JT effect cooling is used to achieve the isenthalpic cooling because JT effect cooling may require minimal equipment (e.g., only a valve/orifice 323 (see FIG. 3*a*)), and there is little or no additional mechanical refrigeration or equipment involved to achieve deep cryogenic temperatures (i.e., at or below −40° F.), which would typically be the lower limit for conventional refrigeration equipment.

The JT-effect valve 323 may comprise a variable orifice, a letdown valve, a throat/orifice 323 (e.g., a plate with a fixed hole disposed therein, which may be lighter than a variable orifice valve or other components), or any other suitable valve for effecting JT cooling.

The use of high storage pressures in the vessels 122, 142 leads to a faster rate of filling into the cylinders/vessels 122, 142. As shown in FIG. 3*a*, the process starts by injecting gas into the front port 330 of a cylinder/vessel 122, 142. In the illustrated embodiment, the vessel 122, 142 also has a rear port 331 disposed at an opposite longitudinal end of the vessel 122, 142. However, according to alternative embodiments, the ports 330, 331 may be disposed at any other spaced apart portions, respectively, of the vessel 122, 142 without deviating from the scope of the present invention.

According to various embodiments, the cooled loading process used by the cooled loading system 114 starts by doing an initial fill without utilization of recirculation (discussed below). When filling the vessels 122, 142 from a higher pressure source (e.g., vessel 141 to vessels 122 or 142), differential pressure from a high pressure source creates cooling through a physical phenomenon referred to as the "Joule-Thomson" cooling effect, significantly reducing the temperature of the inlet/fresh gas (e.g., to under 20, 10, 0, −10, −20, −30, −40, −50, −60, −70, −80, −90, and/or −100° F.) without the use of additional mechanical refrigeration. This occurs through the use of the orifice 323 (see FIG. 3*a*) and/or letdown valve 324. Letdown valve 324 provides some cooling effect, but usually a very small fraction of such. Instead, valve 324 serves to control flow and pressure of the gas through the connection 116 which may not be rated for the pressures in vessel 141. Flow through an orifice 323 creates isenthalpic expansion of the gas as it reduces in pressure, leading to the reduction in temperature to maintain constant enthalpy.

According to various embodiments, as shown in FIG. 3*a*, the J-T effect orifice/throat 323 may be disposed at or near the inlet into the vessel 122, 142, 141, 143 so that the full J-T letdown (e.g., temperature drop) occurs downstream from the CNG hoses 116 used to deliver the gas from the source vessel 141 to the vessel 122, 142 being filled. For example, the orifice/throat 323 may be disposed at or on a manifold that is built into the mobile gaseous fuel module 126 that includes the vessel 122, 142 being filled. According to various embodiments, such orifice 323 positioning creates the most severe letdown (e.g. temperature drop) after the least cryo-resistant equipment (hoses and NGV connectors 116). Temperatures may be below −100° F. at the tip of the throat/orifice 323 connection and before the warmer recirculated gas mixes in and warms the cooled fresh gas at the venturi mixer 334, discussed below.

If a pressure differential between the source vessel 141 and vessel 122, 142 remains large, the cooled loading system 114 may rely on JT cooling alone throughout the entire filling of the vessel 122, 142. However, depending on the particular embodiment, if the pressure differential falls below a certain threshold, the JT cooling may be insufficient to prevent the vessel 122, 142 temperature from rising. At a predetermined point (e.g., once the pressure in the vessel 122, 142 reaches a predetermined pressure (e.g., a pressure over 500, 600, 700, 800, 900, 1000, 1100, and/or 1200 psi) or the gas entering the vessel 122, 142 rises above a predetermined temperature (e.g., −60, −50, −45, −40, −35, −30, −20, −10, 0, 10, and/or 20° F.)), mechanical refrigeration cooling may be used or the temperature in the vessel 122, 142 may be allowed to rise.

The refrigeration and heat exchanger units of the cooled loading system 114 may be smaller and more efficient than otherwise possible if JT cooling were not used. In addition, the average required power of the mechanical refrigeration system is reduced by only working through part of the cycle and for only part of the temperature reduction. As explained below, the active mechanical refrigeration may occur at a variety of points in the system.

As shown in FIG. 3*a*, the gas stored in the cooled source vessel 141 itself may be actively cooled via an active mechanical refrigeration unit 151 so that the gas being injected into the vessels 122, 142 is cooled even if there is little or no JT cooling (and/or to augment the JT cooling). This cooling may be performed at a high pressure (high density) and before letdown through the orifice 323 so that the maximum J-T effect may be utilized downstream of the active refrigeration provided by the refrigerator 151.

According to various embodiments, active cooling of the cooled source vessel 141 may facilitate faster loading of the vessels 122, 142, particularly if the cooling systems (e.g., J-T cooling system 323, active in-line refrigeration system 152) that are in-line between the source vessel 141 and vessel 122, 142 are insufficient to provide the cooling load desired to keep the temperature of the vessel 122, 142 below a desired maximum temperature.

Active refrigeration of the cooled source vessel 141 and compressed gas therein (as opposed to inline refrigeration in the passageway between the source vessel 141 and destination vessel 122, 142 during loading of the vessel 122, 142) may also facilitate the use of a smaller cooling system that may operate continuously to cool the cooled source vessel 141 (as opposed to an inline cooling system that is only operational during the loading/filling process). Thus, as discussed above, the use of a source vessel 141 may facilitate the use of smaller compressors 112 and smaller cooling systems 151 than might otherwise be possible if gas were loaded directly from a gas supply 107 to the vessel 122, 142.

Additionally and/or alternatively, the fresh gas may be cooled inline between the vessel 141 and the orifice 323 (e.g., via a heat exchanger and active refrigeration as is used in the recirculation loop described below).

Additionally and/or alternatively, as discussed below, a recirculation heat exchanger with active refrigeration 152 may provide supplemental cooling to the JT cooling by cooling gas that is recirculated from the vessel 122, 142 and back into the vessel 122, 142.

Commercial refrigeration equipment is normally most effective/efficient the closer the refrigerated temperature is to ambient, as reflected in the COP (Coefficient of Performance) and SEER (Seasonal Energy Efficiency Rating) of heat pumps and refrigeration compressors. Compared to deep cryogenic or equipment rated to operate at less than −20° F., the cost of commercial refrigeration equipment is a fraction, in addition to the lower operating costs. As such, according to various embodiments, capital and operating cost and efficiency for filling a vessel 141, 122, 142, 143 may be optimized by using a combination of commercial mechanical refrigeration and JT effect cooling.

Additionally and/or alternatively, as shown in FIG. 3*a*, the cooled loading system 114 may shift during vessel 122, 142 filling from using an uncooled source vessel 141 to using a cooled source vessel 141 when: (1) the pressure gradient between the uncooled source vessel 141 and the vessel 122, 142 being cooled falls below a predetermined threshold, (2) when the pressure in the vessel 122, 142 rises above a predetermined threshold, and/or (3) when a temperature of gas being injected into the vessel 122, 142 rises above a predetermined temperature. This switch may be affected by turning the on/off valve 336 off and the on/off valve 337 on.

The active refrigeration unit 151 may maintain the cooled storage vessel 141 at a lowered temperature (e.g., less than 40, 30, 20, 10, 0, −10, −20, −30, and/or −40° F., and/or about −40° F. and/or above 0, −10, −20, −30, and/or −40° F.) so that cooled gas supplied from the cooled storage vessel 141 cools the vessel 122, 142 being filled. According to various embodiments, the cooled vessel 141 is maintained at about 15° F. According to various embodiments, such vessel 141 operating temperatures allow the use of simple refrigerants and commercial/mass-produced refrigeration systems 151, which may enhance the gas volume stored in the vessel 141, but may also allow "slow" refrigeration and low installed refrigeration power. The high amount of mass of the vessel 141 (for example 5, 6, 7, 8, 9, 10, 12, 15, and/or 20 times more mass than the gaseous fuel disposed therein inside) causes the vessel 141 to function as a thermal sink. The vessel(s) 141 may be disposed within an insulated container (e.g., a reefer-type container) so reduce heat flow into the vessel 141 from the ambient environment. Additionally, the cooled storage vessel 141 may be maintained at a significantly higher pressure than the uncooled storage vessel 141 that is initially used to fill the vessels 122, 142, such that the switch results in greater JT cooling as well. The increased pressure gradient between the cooled storage vessel and filling vessels 122, 142, will also ensure sufficient mass flow between said vessels before pressure equalization occurs. According to various embodiments, the cooled storage vessel 141 is maintained at a pressure of at least 1500, 2000, 2500, 3000, 3500, 4000, 4500, 5000, 5500, and/or 6000 psig, and/or between 1500 and 6500 psi, between 2000 and 6000 psi, between 3000 and 6000 psig, and/or between 4000 and 6000 psig. According to various embodiments, the non-cooled vessel 141 is maintained at a pressure of around 2000 psi. According to alternative embodiments, the cooled vessel 141 is not actively cooled, but is nonetheless maintained at a higher pressure than the other vessel 141. The higher pressure vessel 141 provides a large pressure gradient with the vessels 122, 142 being filled such that the orifice 323 provides more JT-cooling than if the uncooled, lower pressure storage vessel 141 was still being used at this later stage of the filling process.

At the initial part of the fill process, the storage pressure of the mother station (e.g., vessel 141) is much higher than that required for J-T cooling while staying above the lower temperature limits of the hose and components. If the main J-T cooling temperature drop can be performed after the sensitive components (e.g., by positioning the orifice 323 downstream of low-temperature sensitive components such as the hoses/connectors 116), then less temperature resistant components may be implemented and an improved J-T effect could be utilized.

The cooled loading system 114 may use oversized hoses and connectors 116, potentially using multiple parallel hoses/connectors 116 to create a larger cross-sectional flow area and minimal pressure drop throughout the hose/connector 116, to connect the gas supply source (e.g., vessel 141) to the vessel being filled (e.g., vessels 122, 142, 143). By minimizing pressure loss in these flow elements, desired flow rates through the system can be achieved while minimizing the mean gas velocity through these components. This results in reduced erosion/wear and corresponding maintenance and operating costs. In some embodiments, the same set of hoses would be used and the connections would change between the cooled and uncooled pressure vessels 141. In other embodiments, and large diameter hose might be used when connected to the lower pressure vessel 141 and a smaller diameter hose might be used when connected to the higher pressure vessel 141.

Circulation and/or Recirculation During Cooled Loading

Gases in general possess low thermal conductivity and are at much lower densities than metals and or liquids. Their main method of thermal transfer is gas to gas inside the cylinder/vessel 141, 122, 142, 143 through convection and a small amount of conduction. The gas in turn conducts heat to the cylinder/vessel 141, 122, 142, 143 shell, which in turn effects the bulk of its heat transfer through natural convection with the external environment. Thermal transfer during a cylinder/vessel 141, 122, 142, 143 filling process thus is very slow.

The slow convective heat transfer between an ambient environment and a cylinder/vessel 141, 122, 142, 143 is further aggravated when larger capacity vessels 141, 122, 142, 143 are used because larger capacity vessels 141, 122, 142, 143 tend to have smaller surface area:volume ratios (resulting from their longer, larger diameter sizes). The relatively smaller surface area limits convective heat transfer. Despite their heat transfer shortcomings, the larger volume vessels 141, 122, 142, 143 may nonetheless be advantageous in order to reduce the costs through reduction of the number of cylinders/vessels 141, 122, 142, 143 used to hold a specific volume, as well as materials optimization in certain cases. However, according to various embodiments, the shape of a larger vessel 141, 122, 142, 143 may be modified to increase its surface/volume ratio. Additionally and/or alternatively, additional structure (e.g., fins, heat sinks, etc.) may be added to the vessels 141, 122, 142, 143 to improve their heat transfer properties.

The process and what occurs inside the cylinders/vessels 122, 142 during filling is not intuitive. The present inventors discovered that simply cooling the gas before injection into the cylinders/vessels 122, 142 leads to greater under filling than would be expected. The present inventors discovered that such under filling, despite the use of pre-cooling, resulted from large temperature gradients that developed in the elongated cylinder/vessel 122, 142 during filling. In particular, compression of the gas far away from the inlet port 330 significantly heated the gas already in the vessel 122, 142, and the long longitudinal length of the vessel 122, 142 relative to its width prevented adequate circulation of the gas within the vessel 122, 142. As a result, gas near the inlet port 330 became far cooler than gas on an opposite end of the vessel 122, 142. The gas filling into the cylinder/vessel 122, 142 can effectively be analyzed as a batch process in which the batch of gas most distant from the inlet will be at a higher temperature than that closest to the inlet. The present inventors also discovered that gravity-induced temperature gradients develop such that warmer gas rises, and cooler, denser gas tends to sink within the vessel 122, 142. As a result, in various filling scenarios involving horizontal, elongated vessels 122, 142, the highest temperatures are reach at the top of the distal (i.e., opposite the end through which gas is injected) end of the vessel. It should be noted that this temperature gradient phenomenon is not readily appreciated by inspection of the outside of a vessel 122, 142 being filled because fast heat transfer through the material of the vessel 122, 142 limits the temperature gradient across the surface of the vessel 122, 142 and obscures the much higher temperature gradient of the gas within the vessel 122, 142.

One or more embodiments of the present invention compensates for the filling-induced temperature gradients within the vessel 122, 142 in one or more ways.

Figure 3E:
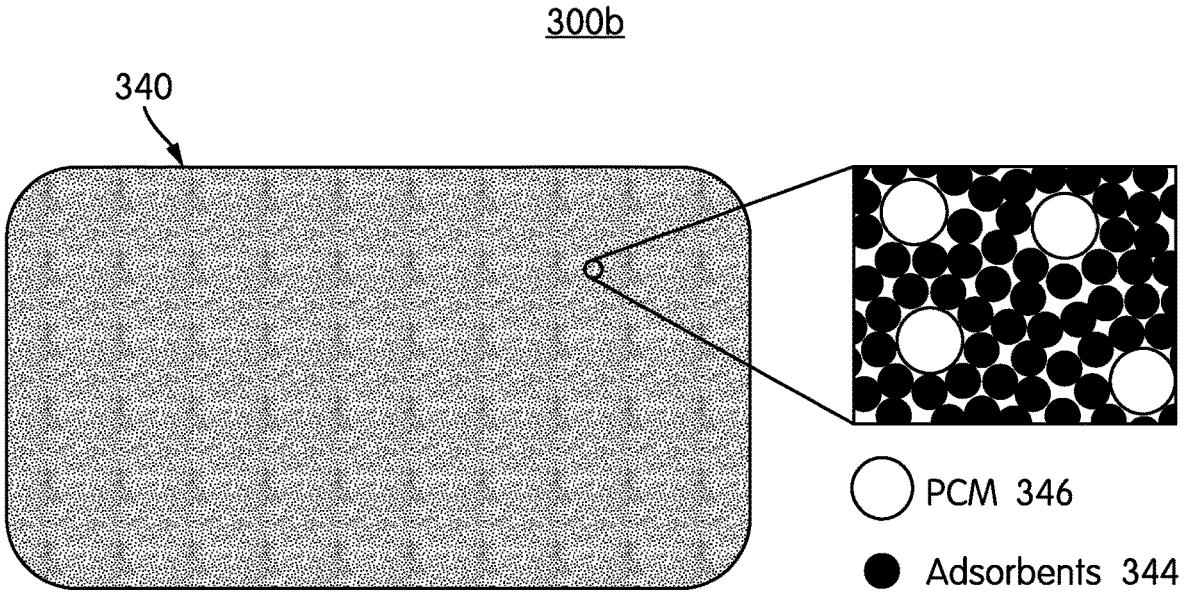
FIG. 3*e* is a schematic showing an exemplary vessel material having an adsorbent material and a phase change material in accordance with various embodiments of the present teachings.
Figure 3F:
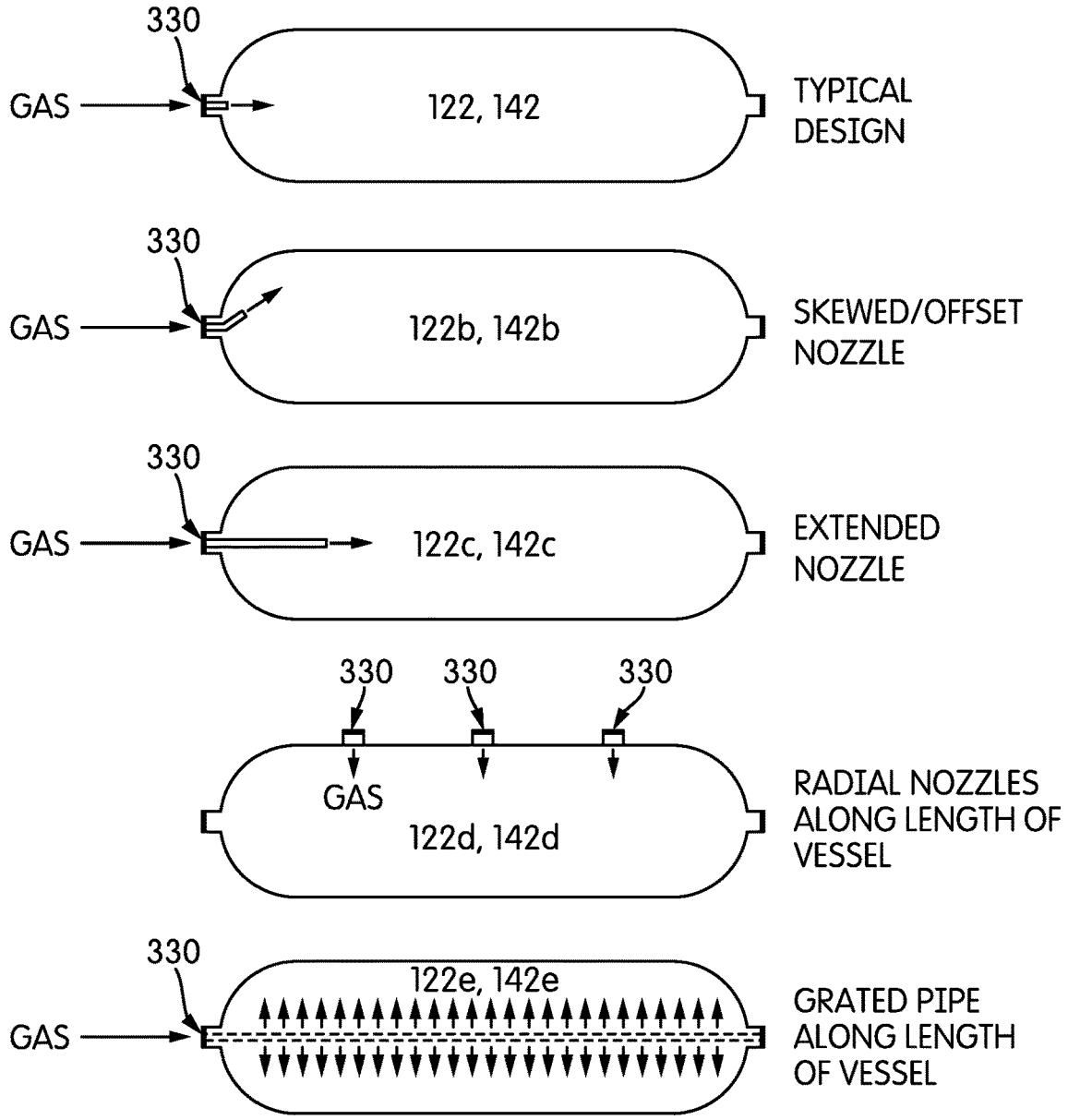
FIGS. 3*f-g* are schematics showing exemplary vessels with a variety of nozzle configurations in accordance with various embodiments of the present teachings.

Cylinder 122, 142 filling that is done entirely through a single port 330 of the vessel 122, 142 results in the upward and distal (i.e., away from the inlet port 330) stratification of hotter old gas (that started from a lower pressure and rises progressively), while the lower temperature, denser gas tends to be lower and closer to the inlet port 330 where the newer gas is being inserted. Since the flow tends to be laminar on the latter parts of the vessel 122, 142, horizontal and vertical temperature stratification occurs. There is a lot of turbulence near the inlet port 330 of the gas due to the jet stream of incoming inlet gas inducing eddies and mixing the nearby parts of the cylinder/vessel 122, 142 effectively. As shown in FIG. 3*f*, the vessels 122, 142 may be modified in various ways to enhance the horizontal and vertical eddies and circulation of gas within the vessels 122, 142, which may result in more uniform temperatures through a longer and taller section of the cylinder/vessel 122, 142. For example, in vessels 122*b*, 142*b*, a nozzle at the inlet 330 is skewed and offset within the vessels 122*b*, 142*b*, which may induce a circulating vortex that may result in better gas mixing over a longer, taller section of the vessel 122*b*, 142*b*. Additionally and/or alternative, a vessel 122*c*, 142*c* includes an inlet nozzle that extends well into the length of the vessel 122*c*, 142*c* from the inlet port 330 to induce gas mixing farther into the length of the vessel 122*c*, 142*c*. Additionally and/or alternatively, a vessel 122*d*, 142*d* includes a plurality of inlet ports 330 spaced over the longitudinal length of the vessel 122*d*, 142*d* to reduce temperature variations. As shown in FIG. 3*f*, these inlet ports 330 may be positioned at or near the top of the vessel 122*d*, 142*d* so as to better cool the hotter gas that tends to accumulate toward the top of the vessel 122*d*, 142*d*. Additionally and/or alternatively, a vessel 122*e*, 142*e* includes a grated pipe that extends along the internal length of the vessel 122*e*, 142*e* from the inlet port 330 to the outlet port 331 to distribute gas more evenly through the vessel 122*e*, 142*e* during filling, and reduce temperature stratification.

Figure 3G:
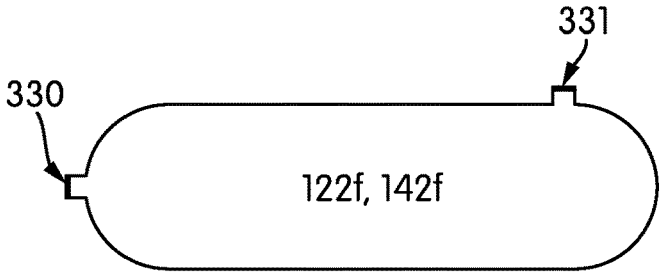

Additionally and/or alternatively, the cylinders 122, 142 may be filled from both ends (e.g., via ports 330 and 331 shown in FIG. 3*a*) to reduce the temperature gradient within the cylinder 122, 142. According to various embodiments, there is good mixing in the first 5 axial feet of a 20 inch diameter cylinder 122, 142 being filled from one end (e.g., via port 330). The use of ports 330, 331 on both ends of a cylinder 122, 142 may be well suited for reducing the temperature gradients within a cylinder 122, 142 with a 20 inch diameter and a 10 foot length according to one or more embodiments. As illustrated in FIG. 3*a*, the ports 330, 331 may be disposed on opposite horizontal ends of the elongated tubular vessel 122, 142. Alternatively, the ports 330, 331 may be disposed at any other suitable location along the vessel 122, 142. For example, as shown in FIG. 3*g*, the port 331 may be disposed distally from the port 330 (i.e., on an opposite horizontal half of the vessel 122*f*, 142*f*) and positioned at or near the top of the vessel 122*f*, 142*f* (e.g., within 40, 30, 20, 10, and/or 5% of the vertical top of the interior space defined by the vessel 122*f*, 142*f*). Such upper, distal positioning of the port 331 may advantageously be positioned at or near where the highest temperatures would otherwise develop within the vessel 122*f*, 142*f*, in the absence of such a port 331. As explained, hotter gas may accumulate near the distal, upper port 331 due to the combination of gravity-based temperature stratification (dense, cool gas sinks) and increased heating further from the injection port 330. As explained above and below, such a port 331 may be used to inject cooled gas into the vessel 122*f*, 142*f* during loading (so as to cool the heated area around the port 331) or to withdraw heated gas during cooling (e.g., for cooled recirculation).

Although various structures and method are generically described with respect to the vessel 122, 142, it should be understood that such structures and methods (e.g., recirculation during cooling) are equally applicable to the other specifically discussed vessels 122*b-f*, 142*b-f*.

Additionally and/or alternatively, the temperature gradient in the vessel 122, 142 being filled may be reduced by recirculating hot gas from the rear ports 331 back to the cold front ports 330 via a recirculation passageway 335 to provide a more homogeneous temperature throughout the vessel 122, 142, which results in improved filling (e.g., filling closer to the rated capacity of the vessel 122, 142).

As shown in FIG. 3*a*, at one or more points in the filling cycle or throughout the filling cycle, the gas on the rear end of the cylinder/vessel 122, 142 (i.e., near the ports 331) is removed and recirculated via the use of a blower 333 and/or venturi mixer 334. Heat may be extracted from the recirculated gas via a refrigeration system 152 (e.g., a heat exchanger with active refrigeration). The recirculated gas may then be inserted into the main inlet jet stream of fresh gas via the use of the venturi flow nozzle 334, as shown in FIG. 3*a*. However, other types of connections (e.g., Y-connector) may be used without deviating from the scope of the present invention. It may also be reasonable to utilize a small compression boost in order to inject directly into the jet-stream at a faster rate.

In the manifold connection on the mobile transport system 120, the venturi connector/mixer 334 may be placed so that the differential pressure and accelerated flow velocity will induce flow from a perpendicular connected line drawing gas from the rear side port 331 of the storage vessel 122, 142. Gas from the rear side of the vessel 122, 142 flows due to the induced venturi effect and passes through a small temperature control component 152 (e.g., a small heat exchanger or other temperature control unit 152 that is part of the mobile transport system 120 and is arranged to dump heat to the environment or a cooling liquid). The cooled gas from the rear side of the vessel 122, 142 is then mixed at the venturi connector 334 with the J-T effect cooled gas, which may be well under −40° F. after letdown. The resulting mixed gas temperature may be above −40° F., which may stay above material limits while at the same time being a larger volume of mass delivered at that low temperature.

If the venturi effect is insufficient to drive gas flow from the outlet port 331 of the vessel 122, 142 being filled to the inlet port 330 of the vessel 122, 142 being filled (or if a venturi mixer 334 is not used), then an external isochoric gas blower 333 (e.g., roots/lobe type for example) or other type of pump may be used to drive recirculation flow. An isochoric blower does not perform internal compression.

In some embodiments where the venturi effect is sufficient to drive gas flow, the venture valve 334 and the recirculation pathway 335 (without components 322, 338, 152 and 333) may be contained within the storage vessel 122, 142 itself, thereby eliminating the need for a second external connection to the storage vessel.

According to various embodiments, a valve 332 disposed in the recirculation loop may be used to actively turn recirculation on and off.

Recirculation may be shut off after the vessel 122, 142 being filled has reached about 2,000 psig (or another predetermined pressure) due to the fact that at this point the enthalpy changes may not be significant and the gas inside of the vessel 122, 142 will typically not rise in temperature very much through the end of the fill cycle at 3,600 psig (or another predetermined pressure).

At the end of the fill cycle, once the vessel 122, 142 reaches 3,200 psig (or another predetermined pressure) and to encourage mixing/equalization of the temperatures inside, the recirculation loop may be reactivated until the end of the fill cycle at 3,600 psig (or another predetermined higher pressure).

According to alternative embodiments, recirculation is only started after the temperature (at a specific point, such as near the port 331 where higher temperatures are expected) in the vessel 122, 142 being filled exceeds a predetermined value. Such a delayed start to recirculation may avoid wasteful recirculatory energy consumption when recirculation is not needed or not worthwhile.

Near the end of the fill cycle once the pressure reaches 3,500 psig (or another predetermined pressure), to prevent overfilling, the rate of fill may be reduced so that the flow meter can control the fill to >99.5% (or another predetermined accuracy) of vessel 122, 142 capacity, allowing for equalization of the temperature inside of the vessel 122, 142 (mixing as well as recirculation).

Recirculation/rear manifold/port 330 is separated from the rest of the system by a check valve 322, allowing flow only in the direction of exhaust of the gas from the cylinder/vessel 122, 142 out of port 331. In turn this is useful for unloading the cylinders/vessel 122, 142 once they get to their final destination (e.g., a user side 130) by opening the valve 338.

Cooled Loading Optimization

Optimization targets are to get the most amount of gas mass into the tank in the least amount of time keeping the tank temperature and the pressure below the limiting levels.

Achieving this is done through manipulating the thermodynamic characteristics of the gas and the tank and understanding of the gas laws. As the gas is injected into the tank, the tank pressure increases and the gas temperature rises. Some of this heat is taken away by the tank wall and into the ambient air. Also as the gas is injected at one end of the tank, the flow creates turbulence in the tank and the far end of the tank reaches higher temperatures than the near end during gas injection. Over time, after the injection is stopped, the temperature starts to stabilize and become somewhat uniform across the tank and after an extended period stabilizes to be equal to the ambient temperature. When the temperature in the tank is higher, the mass contained in the tank is lower at a given pressure. The rate at which the heat is taken away by the tank wall and the ambient depends on the tank construction material and the ambient and state of the ambient air, stationary or flowing. Starting with a cooled gas can increase the rate and amount of gas that can be injected, which reduces the time to fill to the vessel's limit. Knowing the temperature distribution within the vessel during filling and taking the hot gas at the far end out of the vessel and cooling and recirculating further improves the amount of gas that can be filled into the vessel. This type of external cooling of the gas is more effective than recirculating internal to the tank as the total heat energy still is within the tank and eventually has to dissipate through the tank wall and into the ambient. The mechanical construction of the tank with these internal features to recirculate, nozzles to create swirls, and such also makes it complex and possibly cost prohibitive and makes the vessel nonstandard. Such internal structures are nonetheless used in various embodiments.

For a given vessel construction and corresponding regulatory considerations related to weight and maximum pressure and ambient conditions, the parameters that can be varied in permutation combinations to get the most gas mass in the least amount of time into the vessel are primarily the gas injection rate and injection gas temperature. In addition, the variation on injection rate for portions of fill time and variation on cooling temperature, again for portions of fill time, then finally the duration of recirculation from none to throughout the fill time results in further optimization.

Figure 14:
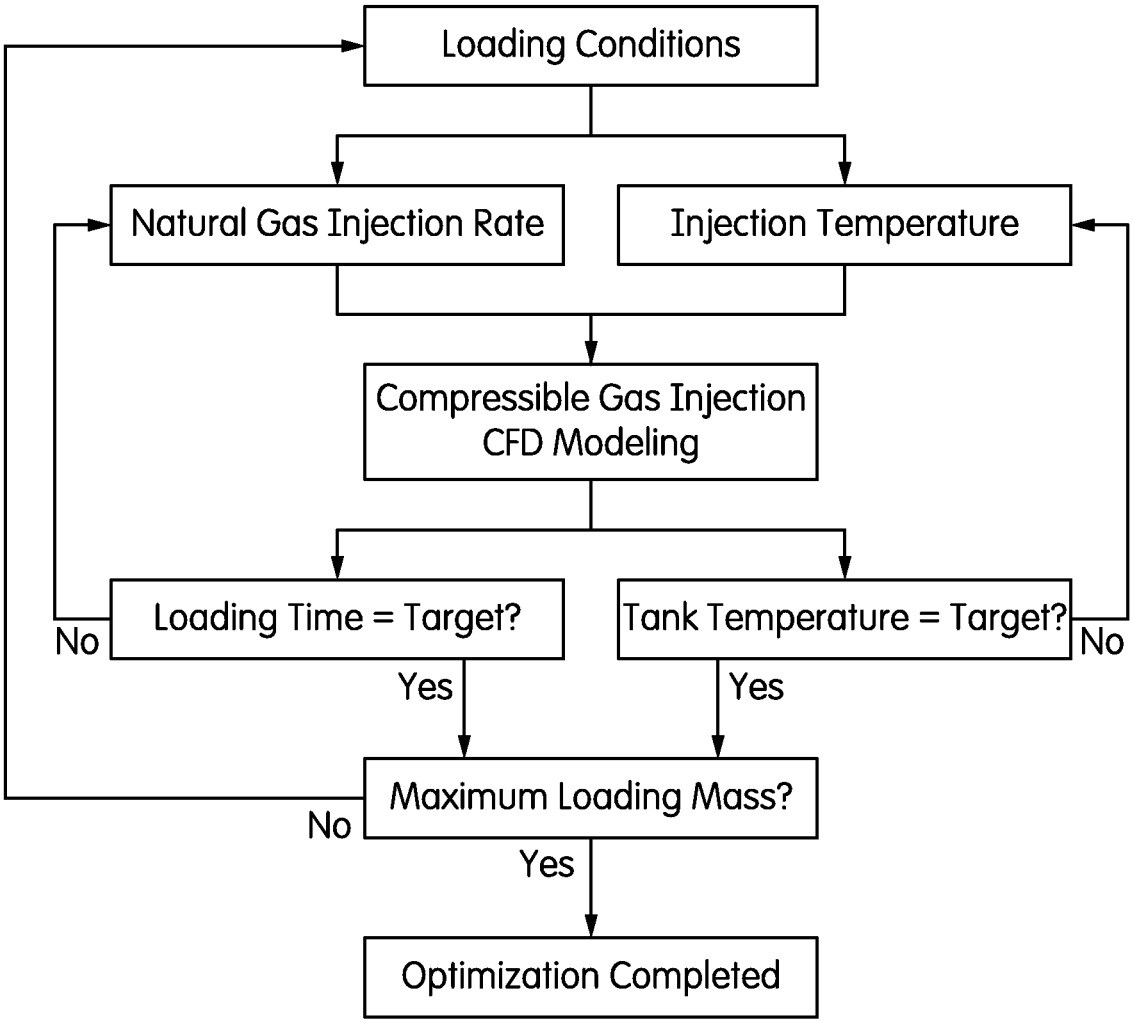
FIG. 14 is a schematic illustrating an optimization process for the cooled loading system according to one or more embodiments of the present teachings.

FIG. 14 shows the flow chart of an optimization process used in the first step according to various embodiments, taking into consideration just the primary parameters, the injection rate and the injection temperature. Inputs (loading conditions) are gas injection rate and temperature. A Computational Fluid Dynamics (CFD) model is built to simulate compressible natural gas injection into a cylinder. With base loading conditions, a set of tank temperature and loading time is achieved after pressure restriction is reached. If modeled loading time is larger than target and/or tank temperature is higher than target, loading conditions are modified to conduct the next iteration cm modeling. This process repeats until both loading time and tank temperature lie in the target range. Then, finally, loading mass is computed to understand the maximum loading mass reached under these conditions.

In the second step according to various embodiments, the injection rate as well as the cooled temperature were varied for different time steps. The CFD simulation was run varying these injection rates and time steps with each time studying the previous iteration results and fine-tuning until the gas mass was maximized.

As a third step according to various embodiments, the recirculation time was optimized to finally get the most amount of gas mass into the tank in the shortest period with temperature remaining within the limits.

In the case of unloading, the rate depends on the application. In this case, as the gas is exhausted, the pressure drops and the temperature drops inside the tank. It is critical that this temperature drop does not go below the levels at which it can start affecting the structure of the vessel. In cases where the gas is desired to be unloaded in as short a period as possible, the ambient or a heated ambient air may be forced over the vessel to keep the shell temperature above the material's specified minimum temperature rating. These scenarios were modeled and analyzed using the CFD model to develop an understanding and algorithms to control the variables during a variety of specific unloading operations.

According to various embodiments, the steps result in the rapid filling of a vessel 122, 142 to 100% of its nameplate capacity. According to various embodiments, the vessel 122, 142 (e.g., a pod of Type II vessels) can be filled from empty to 100% of its nameplate capacity in less than 200, 150, 100, 90, 80, 70, 60, 50, and/or 40 minutes, and/or more than 10, 20, 30, 40, and/or 50 minutes. According to a non-limiting example, the cooled loading algorithm provides a −60 F inlet fluid/gas temperature at the ports 330 where the ambient environment is 60 F, fills 9 individual vessels (cylinders) 122, 142 in parallel to each other in a pod with total flow of 90 lb/min, resulting in a 3600 psi pressure and 65 F temperature in 50 minutes. According to various embodiments Type III vessels 122, 142 can be filled from empty to 100% of their nameplate capacity in less than 200, 150, 100, 90, 80, 70, 60, 50, 40, and/or 30 minutes, and/or more than 10, 20, 30, 40, and/or 50 minutes. According to various embodiments, the gas mass difference between an empty and full individual vessel (e.g., individual cylinder) 122, 142 is (a) at least 50, 100, 150, 200, 250, 300, and/or 400 kg., (b) less than, 3000, 2000, 1000, 900, 800, 700, 600, and/or 500 kg., (c) between 50 and 3000 kg., and/or (d) any range between any two of these values.

According to various embodiments, the inlet temperature of the fluid at the inlet ports 330 can be adjusted depending on the type of vessel 122, 142 being used (e.g., a lower temperature being possible for a Type III vessel than for a Type II vessel).

Cooled Loading Controller

As shown in FIG. 3*b*, a cooled loading controller 350 controls the operation of the cooled loading process. The controller 350 may comprise any suitable type of controller (an analog or digital circuit, a program running on a processor of a computer such as a personal computer coupled to appropriate A/D converters to handle the different inputs and outputs or appropriate industrial microcontroller).

The controller 350 operatively may connect to some or all of the temperature and pressure sensors 351, 352, 353, 354, 355, 356 that are disposed in and/or sense the temperature and pressure of the gas in: the vessel 141, the hoses/connectors 116, the supply line upstream from the venturi mixer 334, the supply line downstream form the venturi mixer 334, the vessel 122, 142, and the recirculation loop downstream from the active refrigerator 152, respectively. The controller 350 may also operatively connect to flow meters at various points in the system. The controller 350 may additionally and/or alternatively use any other combination of inputs to control the cooled loading process.

The cooled loading controller 350 operatively connects to and controls the compressor 112, the refrigeration units 151, 152, the letdown valve 324, the variable orifices(s) 323, and on/off valves 332, 336, 337, 338 so that the controller 350 can control the filling temperature, speed, and pressure, among other things, during the cooled loading process. The controller 350 utilizes a suitable algorithm to control the above-discussed outputs in response to the above-discussed inputs. For example, the controller 350 may ensure that the temperature at various points in the system does not fall below a predetermined minimum temperature (e.g., material safety limits of the structure exposed to cooled gas at various points in the system). The controller 350 may be configured to account for temperature and pressure so as to quickly fill the vessels 122, 142 to an optimum pressure so that the vessels 122, 142 reach a predetermined pressure when the vessels 122, 142 return to ambient temperature conditions.

To control the cooled loading process parameters, because temperature gradients may develop in a vessel 122, 142 and mounting sensitive instrumentation to a mobile trailer 120/mobile storage module 126 can be very expensive to perform robustly, the cooled loading system 114 according to various embodiments adjusts based on a loading station where mass flow rates and cooling/temperature will be adjusted prior to letdown (which in turn keeps the materials cost of precision measurement equipment at a low level). An algorithm may control the operation of the system 114's controller 350 at a single point so that the vessel 122, 142 filling capacity will be improved and/or optimized.

The cooled loading method parameters may depend on the ambient temperature, preceding storage pressure and temperature, capacity of the cylinders/vessels 122,142 to be filled, and materials/specifications of the cylinders/vessels 122,142 to be filled. In addition, the algorithm may be further optimized to fill according to: a set (e.g., user-input) amount of time for filling, a maximum rate of fill, or another useful parameter. According to various embodiments, these optimizations may not affect pipeline nominations because these systems 114 would count with a storage vessel 141 on site to supply the gas for vessel 122, 142 filling, and the storage vessel 141 would, in turn, be filled at a constant rate by the mother station's compressor(s) 112. Such control of flow from a pipeline connection at the mother station can result in cost savings stemming from the avoidance of pipeline balancing costs and/or penalties.

All flow meter measurements may be temperature/pressure compensated mass measurements to ensure precision and may be done upstream of the letdown to minimize velocity through the meter.

Figure 15:
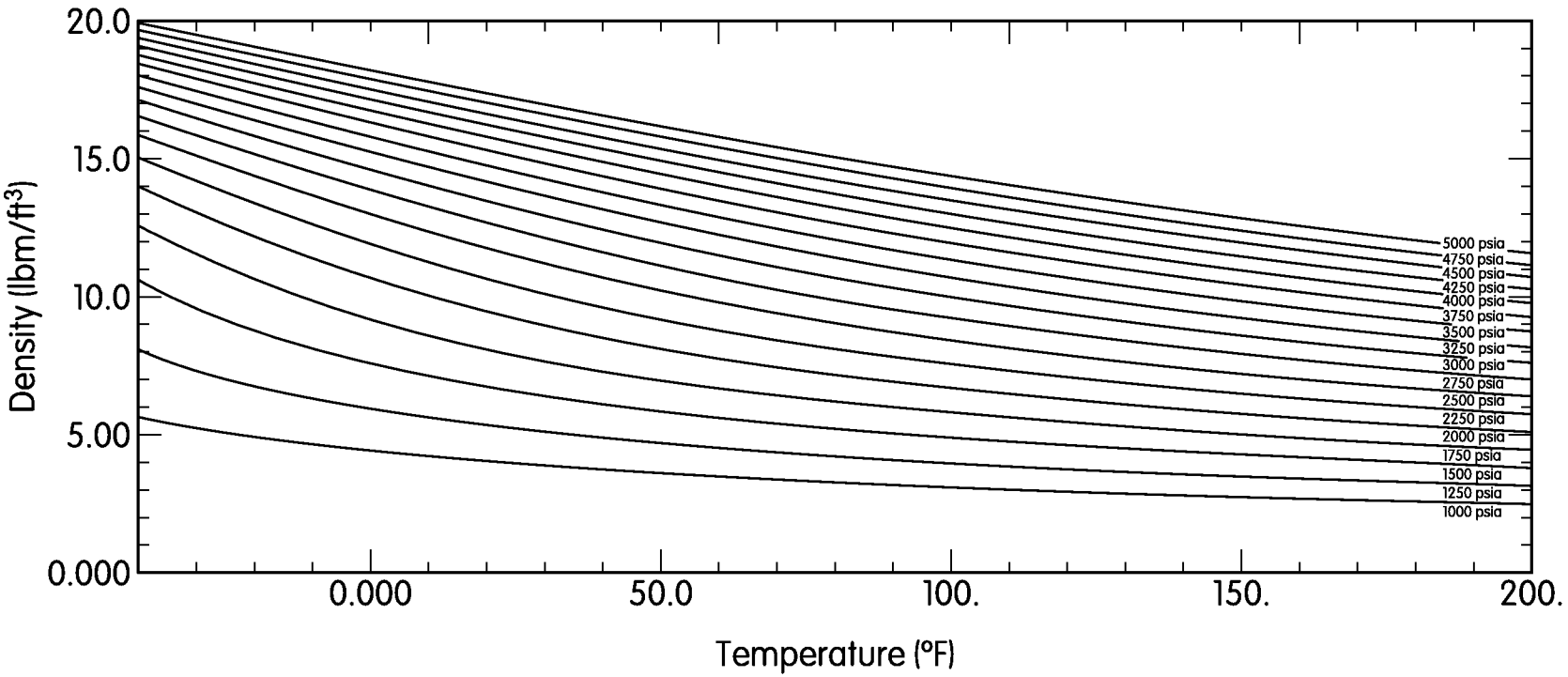
FIG. 15 is a chart of the density of natural gas as a function of temperature and pressure.

FIG. 15 illustrates how the density of natural gas varies with temperature and pressure, and shows that much higher densities can be obtained for a given pressure by reducing the gas temperature below 0 degrees F. The cooled loading controller 350 may utilize this density function to optimize the filling cycle.

FIGS. 3*c* and 3*d* illustrate the operating of the cooled loading controller 350 and cooled loading system 114 according to various embodiments.

Although various components of the cooled loading system 114 are illustrated as being part of the mother station 110 or the mobile transport system 120, any of the components of the cooled loading system 114 may be alternatively disposed without deviating from the scope of the present invention. For example, if it were desired to minimize the structure, equipment, and cost of the mobile transport system 120, more of the cooled loading system 114 components could be incorporated into the mother station 110 (e.g., the orifices 323, the heat exchanger/refrigerator 152, etc.).

Although the cooled loading system 114 is described with reference to filling the mobile storage vessels 122, 142, the cooled loading system 114 or any components therefore may additionally and/or alternatively be used to fill any other type of storage vessel (e.g., the vessels 141, 143, etc.). As a non-limiting example, the cooled loading system may be used to fill the fuel gas storage vessels on CNG vehicles.

Although the refrigeration systems 151, 152, 153 have been described as active, mechanical refrigeration systems, the systems 151, 152, and/or 153 may additionally or alternatively comprise passive refrigeration systems 151, 152, 153, depending on the relative temperatures of the environment and gas being cooled (e.g., via the use of heat conducting fins and a fan) without deviating from the scope of the present invention.

In various countries, regulations (e.g., NFPA specifications) state that a vessel 122, 122, 142, 143 cannot be filled to a level such that its settled pressure, when the vessel 122, 122, 142, 143 returns to ambient conditions after filling, is above its rated service pressure when corrected for ambient temperature. In other words, the maximum mass of gas that can be put into the vessel 122, 122, 142, 143 is limited to a specific amount. Also, in some countries, a vessel cannot be filled above 125% of its rated operating pressure—regardless of how much mass has been introduced into the vessel. The cooled loading controller 350 may be configured to allow a vessel 122, 142 to be filled faster in cold ambient conditions because the vessel 122, 142 because the controller 350 can keep the vessel 122, 142 pressure under the 125% pressure limit in colder environments despite the higher loading rate. Such accounting for a 125% pressure limit (or another over-pressure limit) may speed up the loading process, particularly in embodiments that do not utilize active cooling during loading.

There may be regions or countries where the settled pressure specifications do not apply. In such places, the limit may just be the operating pressure. For such places, the control system 350 may be devised to deliver just enough mass to meet the peak pressure condition at the ambient temperature (or a temperature that an active refrigeration system 152 can maintain the vessel 122, 142 below during transport). As an additional feature, this control system 350 could monitor predictions (weather reports) of future ambient conditions and predictions of the customer utilization rate, and combining these two predictions, adjust the delivered mass so that peak pressure will not be exceeded even if the ambient temperatures rise during the usage cycle of the mobile transport system 120 and the vessels 122, 142.

Additional Loading Methods

Figure 18A:
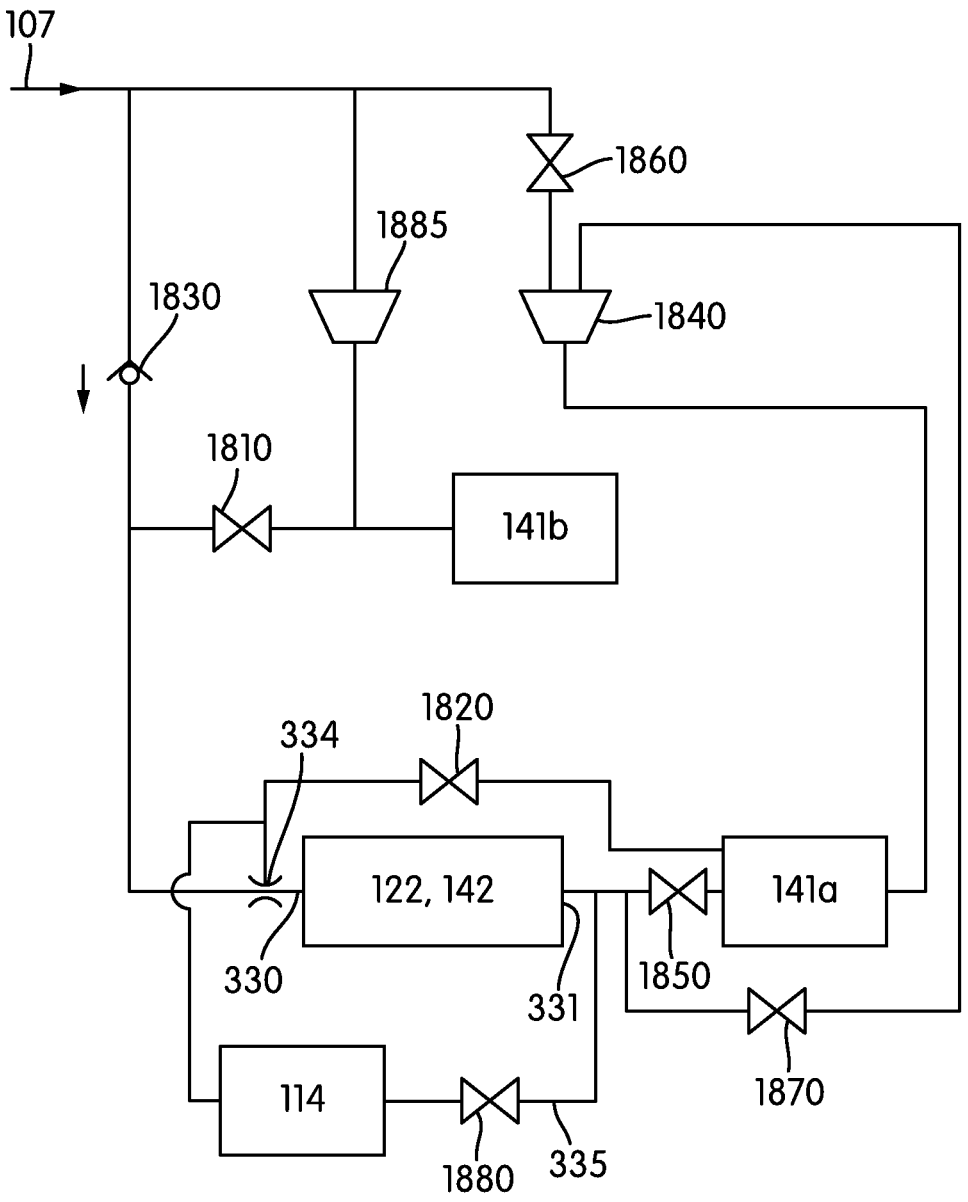
FIG. 18*a* schematically illustrates various methods for loading a mobile transport system at a mother site.

As shown in FIG. 18*a*, additional and/or alternative loading methods may be used to load the mobile transport system 120 from the mother station 110 and/or gas supply 107. These additional and/or alternative methods may improve loading efficiency, reduce loading time, simplify the loading process, reduce the compressor and/or cooling load associated with loading, or result in other features.

For example, during an initial portion of the vessel 122, 142 loading cycle when the vessel 122, 142 pressure is below the pressure of the gas supply 107 (e.g., 400 to 1500 psig), the vessel 107 may be loaded directly from the gas supply 107, e.g., by closing valves 1810, 1820. When the pressure differential between the gas supply 107 and vessel 122, 142 falls below a predetermined threshold (e.g., 1200, 1000, 800, 600, 500, 400, 300, 200, and/or 100 psi), which means that the flow rate has slowed, valve 1820 or 1810 may be opened to continue the loading from a low-pressure stationary storage vessel 141*a* and/or a high pressure stationary storage vessel 141*b*. The switch away from the gas supply 107 could be made earlier to increase the speed at which the vessel 122, 142 is loaded.

A check valve 1830 (or a selectively operated shut-off valve) prevents flow from the vessels 122, 142, 141*a*, 141*b* back to the gas supply 107 when the vessel 122, 142, 141*a*, 141*b* pressure exceeds the gas supply pressure 107.

After direct loading from the gas supply 107 has stopped, the low pressure vessel 141*a* may then be used to continue loading the vessel 122, 142 by opening the valve 1820. The valve 1850 may also be opened to load the vessel 122, 142 from both ends 330, 331. According to various embodiments, the low pressure vessel may be maintained at a pressure lower than a pressure of the high pressure vessel 141*b*. For example, the desired pressure for the vessel 141 may be between 1000 and 4000 psig, between 1500 and 4000 psig, between 1500 and 2500, and/or about 2000 psig. A compressor 1840 such as the compressor 113 fills the vessel 141*a*.

Because the vessel 122, 142 has already been partially filled from the gas supply 107 and because the vessel 141*a* is at a relatively low pressure, the pressure differential between the vessel 141*a* and vessel 122, 142 is relatively small, which reduces JT cooling, and may avoid cryogenic temperatures in the pathway from the vessel 141*a* to the vessel 122, 142 early in the loading cycle.

Instead of the above-discussed recirculation of heated gas from one end 331 of the vessel 122, 142 back to the other end 330, hot gas from the end 331 of the vessel 122, 142 may instead be directed to the vessel 141*a*, for example by closing the valves 1850, 1860, 1880, and either using a venturi pump 334 or the compressor 1840. If gas is being delivered from the vessel 141*a* to the vessel 122, 142 at the same time that heated gas is being directed from the vessel 122, 142 to the vessel 141*a*, it may be advantageous to inject the heated gas into an end of the vessel 141*a* opposite the end from which gas is delivered from the vessel 141*a* to the vessel 122, 142. Circulating heated gas into the vessel 141*a*, instead of back into the vessel 122, 142 may reduce a cooling load needed to cool the vessel 122, 142 to a desired temperature. The vessel 141*a* may therefore function as a thermal mass that absorbs some of the heat generated during loading of the vessel 122, 142.

The vessels 141*a* and/or 141*b* may be actively cooled, e.g., via active refrigeration 151 (see FIG. 3*a*), whose cooling load can be averaged out over time, and can be lower than a cooling load that be used to keep up with the heat of compression load generated by loading the vessel 122, 142. Additionally and/or alternatively, active refrigeration can be used to cool the gas within any of the hoses/lines connecting any of the components illustrated in FIGS. 18*a* and *d*.

According to alternative embodiments, when the pressure in the vessel 122, 142 is higher than the pressure in the vessel 141*a*, the valves 1850 may be opened and the valves 1820, 1870 may be closed. As a result, heated gas from the vessel 122, 142 flows directly from the port 331, through the valve 1850, and into the vessel 141*a*. This flow enables the vessel 141*a* to absorb heat from the vessel 122, 142 while the vessel 122, 142 is being loaded from a higher pressure source (e.g., the vessel 141*b*). The pressure differential between the vessel 122, 142 and the vessel 141*a* may result in JT cooling of the vessel 141*a* that partially counteracts the increased temperature of the heated gas flowing from the vessel 122, 142's port 331 into the vessel 141*a*.

Circulation of the heated gas from the vessel 122, 142 to the vessel 141*a* may reduce an overall cooling load needed to keep the vessel 122, 142 temperature below a predetermined threshold while still completing the loading cycle within a predetermined time period. Such circulation may facilitate faster loading times, lower instantaneous loading-related cooling loads, and/or smaller cooling components 151, and/or providing loading cycles in higher temperature ambient environments (e.g., when the ambient temperature is over 70, 80, 90 and/or 100 degrees F.).

Heated gas that was transferred from the vessel 122, 142 to the vessel 141*a* may subsequently be used to load another vessel 122, 142 (e.g., after the gas has been cooled in the vessel 141*a*).

Additionally and/or alternatively, heated gas being discharged from the vessel 122, 142 may be fed directly into an empty second vessel 122, 142 prior to further loading of the second vessel 122, 142. Active refrigeration of the hoses connecting the first and second vessels 122, 142 may be used to cool the heated gas before injection into the second vessel 122, 142.

Figure 18B:
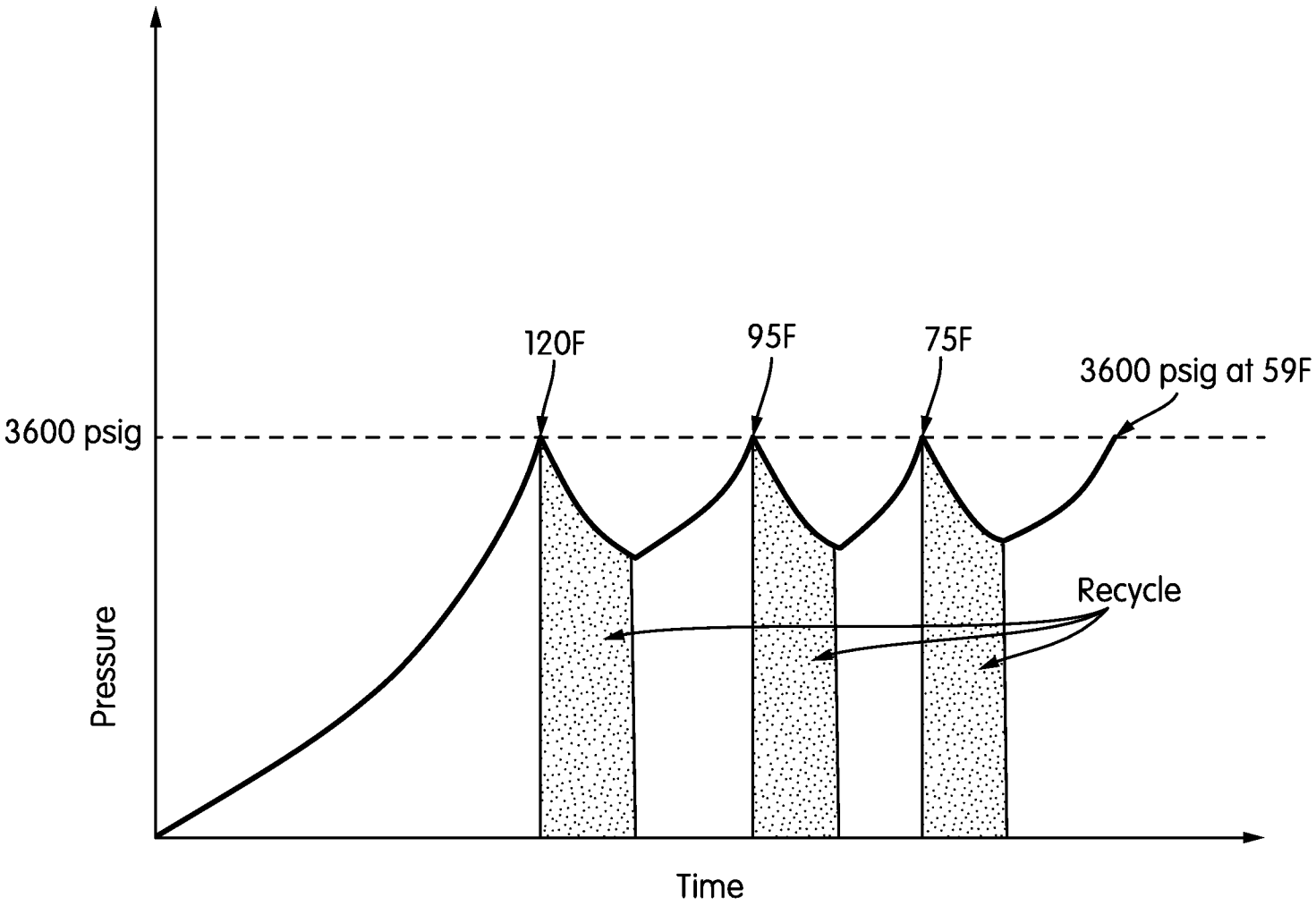
FIGS. 18*b-c* illustrate the pressure v. time graph for a vessel loading cycle that includes recycle time to allow the vessel pressure to drop.
Figure 18C:
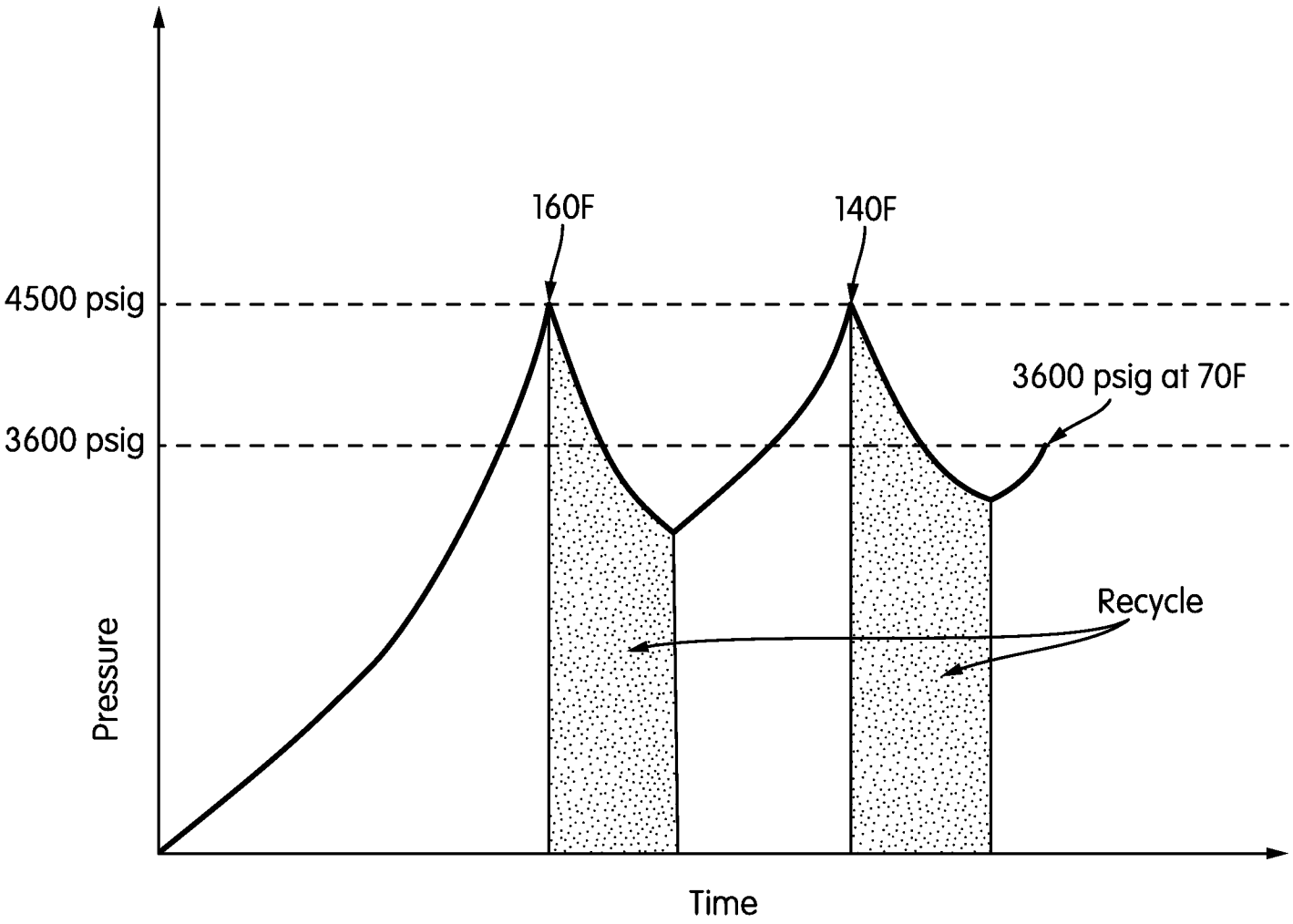

Additionally and/or alternatively, the vessel 122, 142 may be filled to above its rated transport pressure/load. The heated vessel 122, 142 is then allowed to cool, either through active or passive cooling. The over-pressurized vessel 122, 142 may then be bled off (e.g., into the vessel 141*a*) until the vessel's rated pressure and/or mass capacity is reached, which cools the vessel 122, 142. As shown in FIGS. 18*b* and 18*c*, the loading cycle may include multiple temperature/pressure recycle time periods (with or without bleeding) to allow the temperature and pressure in the vessel 122, 142 to drop. Such overpressure enhances heat flow out of the vessel 122, 142 by increasing the temperature differential with the heat sink being used. According to various embodiments, bleeding off of excess gas can be omitted, particularly if the subsequent cooling of the vessel 122, 142 will return the vessel 122, 142 to acceptable temperatures and pressures without bleeding. In such embodiments, the over-pressurized vessel 122, 142 may nonetheless be within the rated mass capacity of the vessel 122, 142 (e.g., assuming a standard temperature). FIGS. 18*b* and *c* illustrate the recycle times (e.g., cooling times) associated will filling a vessel 122, 142 to its rated pressure (FIG. 18*b*), as opposed to an over-pressure (FIG. 18*c*), according to various non-limiting embodiments.

As discussed above, the vessel 141*a* may be used to load the vessel 122, 142 until the vessel 141*a* pressure exceeds the vessel 122, 142 pressure by less than a predetermined threshold (e.g., 1200, 1000, 800, 600, 500, 400, 300, 200, and/or 100 psi). Additionally and/or alternatively, the vessel 141*a* may be used to load the vessel 122, 142 until the mass or volume flow rate from the vessel 141*a* to the vessel 122, 142 falls below a predetermined threshold, as measured by appropriate sensor(s). After that threshold is met, the valves 1820, 185, 1870 may be closed and the valves 1810 (and optionally 1880) may be opened so that the high pressure vessel 141*b* is used to complete the loading of the vessel 122, 142 to the desired full capacity of the vessel 122, 142. The loading system may alternatively shift to the high pressure vessel 141*b* earlier in the loading cycle to speed up the loading cycle.

Figure 18D:
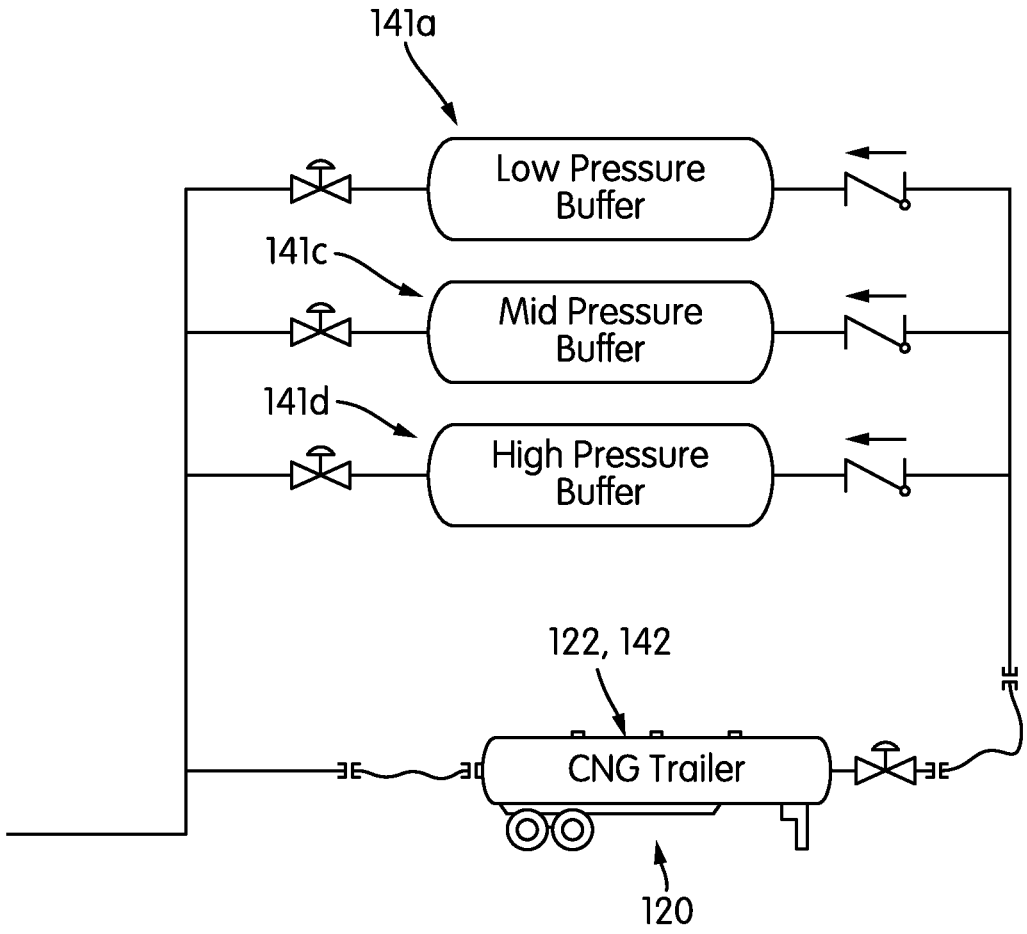
FIG. 18*d* schematically illustrates a method for loading a mobile transport system at a mother site.

Additionally and/or alternatively, as shown in FIG. 18*d*, heated gas from the vessel 122, 142 being loaded may be recycled to progressively higher pressure buffer vessels 141*c*, 141*d* in addition to and in generally the same manner as with the vessel 141*a*.

Sequentially using two or more of the gas supply 107, low pressure vessel 141*a*, high pressure vessel 141*b*, and/or a further intermediate vessel to load the vessel 122, 142 may provide various efficiencies in a manner similar to that disclosed herein in connection with reverse cascade loading. For example, much less energy is required to compress natural gas from 400 to 3,600 psig (e.g., about 0.06 kW) than to compress natural gas from 20 psig to 3,600 psig (e.g., about 0.3 kW).

A continuously operating compressor 1885 such as the compressor 113 may be used to keep the vessel 141*b* at or near a desired pressure (e.g., between 3000 and 6000 psig, between 4000 and 6000 psig, about 5000 psig).

The cooled loading controller 350 may operatively connect to one or more of the valves 1810, 1820, 1850, 1860, 1870, 1880, compressors 1840, 1885, and/or associated sensors (e.g., pressure, temperature, flow rate sensors) so as to control such valves 1810, 1820, 1850, 1860, 1870, 1880 and compressors 1840, 1885 so as to automatically carry out any one or more of the above-described loading options.

One or more of the above-discussed options for cooling the vessel 122, 142 and/or gas therein may facilitate the elimination of active cooling (e.g., refrigeration 151) and/or recirculation via the recirculation passageway 335. However, any two or more of these methods may be combined to more quickly or efficiently maintain the temperature in the vessel 122, 142 being filled to below a predetermine temperature without deviating from the scope of the present invention.

Active Cooling During Transport of Mobile Vessels 122, 142

As shown in FIG. 1*a*, according to various embodiments, the gas on in the mobile vessels 122, 142 may be cooled via active refrigeration during transport of the mobile transport system 120, e.g., via the temperature control component 152. Such cooling may facilitate the transport of more gas mass while keeping the vessel 122, 142 pressure below a predetermined threshold (e.g., the pressure rating for the vessel 122, 142).

According to various embodiments, such vessel 122, 142 cooling can be combined with the use of ANG because colder temperatures allow the increased storage of more natural gas in the adsorbent materials. Active refrigeration during transport would allow for the removal of any heat gain caused by insolation or a warm ambient temperature.

By cooling the outside shell of the vessel 122, 142, the adsorbent material may not rise in temperature (or have a limited temperature rise). Active cooling and/or ANG materials may reduce or eliminate the need to vent natural gas into the surroundings, for example when the ambient temperature rises.

If the mobile transport system 120 is stopped, the refrigeration system 152 may keep the unit from venting.

As a failsafe mechanism, in the case of a failure of the refrigeration system 152, the driver of the mobile transport system 120 may activate a depressurization of the vessel 122, 142 so that it vents down to a remaining content of mass that is within the vessel 122, 142 mass/temperature rating.

The activation of such mechanism could be manual and it can be bypassed/shut by an LEL sensor in case of accidental discharge in an enclosure or other poorly ventilated location, as a backup shutdown.

Additionally and/or alternatively, as discussed below, the vessels 122, 142 may be heated during transport to facilitate hotter and/or faster unloading of the vessels 122, 142 at the user site 130. According to alternative embodiments, the vessels 122, 142 may be cooled during a first portion of the transport from the loading station (e.g., mother station 110) to the user 130, and heated during a second, later portion of the transport.

Adsorbed Natural Gas (ANG) Storage and Transport

In one or more embodiments, with the use of an adsorbent material, storage density of gaseous fuel may be increased, or storage pressure of the gaseous fuel may be decreased (at comparable storage densities). According to various embodiments, the adsorbent may comprise or use a porous material, a high surface area material, nanohorns, chemical/hydride interactions, and/or cross-linked polymers/gels, among other adsorbents. Storage of natural gas utilizing vessels (e.g., see 122, 141, 142, 143 in FIG. 1*a*) that include an adsorbent is generally referred to as "adsorbed natural gas" or "ANG". Such adsorbent materials have been shown to store substantial quantities of natural gas at relatively modest pressures. In some implementations, a vessel including adsorbent can store as much natural gas at a relatively low pressure (e.g. 500 PSIG) as a CNG vessel at a much higher pressure (e.g. 3600 PSIG). Because lower pressure vessels can be far less expensive than comparable sized high pressure vessels, ANG based storage can be used to lower the cost of storing natural gas in various applications.

Adsorbents may include any material with a substantial adsorptive capacity including but not limited to activated carbons, metal oxide frameworks, and/or zeolites. Some adsorbents are manufactured in loose form such as powders, grains, sands or pellets. Such loose forms may be contained and handled during manufacture and operation in porous containers including but not limited to woven or non-woven fabric container (e.g., sacks) or other porous structure or material or membrane which would enable easy handling and would simultaneously act to filter any adsorbent that becomes airborne and prevent such airborne particles from traveling downstream to where they may clog or otherwise damage equipment.

Adsorbents typically exhibit the behavior wherein the adsorptive performance drops as temperature increases. Thus, a vessel (e.g., the vessel 122, 141, 142, 143 in FIG. 1*a*) including an adsorbent at a given pressure and temperature will store less gaseous fuel than it would at a lower temperature and the same pressure. Due to the heat of adsorption, vessels including adsorbent typically heat up upon filling. After the filled vessel returns to ambient temperature, its pressure will drop. As shown in FIG. 3*a*, to avoid this effect and achieve the maximum storage for a given pressure and ambient temperature, the gaseous fuel can be pre-cooled prior to introduction to the vessel 122, 141, 142, 143 including (one or more) adsorbents. With appropriate controls, the gaseous fuel may be pre-cooled sufficiently that the thermal capacity of the gaseous fuel compensates for all or part of the heat released by the heat of adsorption during filling. In some cases, the vessel 122, 141, 142, 143 including the ANG may be filled and cooled simultaneously by introducing gaseous fuel in one end and removing a fraction of the gaseous fuel from another point on the vessel, thereby flowing the gaseous fuel past the adsorbent. This can enhance the cooling effect and cause the cooling effect to be more uniform throughout the cooling vessel. The removed gaseous fuel can be suitably recompressed and reintroduced to the inlet stream. Such recirculated gaseous fuel may also be actively refrigerated to enhance the cooling effect.

The converse also happens where the vessel including ANG cools down when being emptied at the user site. This has the effect of reducing the pressure of the vessel and causing the vessel to stop emptying, when limited to minimum operating pressure. This effect can be counteracted, in whole or in part, by incorporating a method to introduce heat back into the adsorbent. This can include heat pipes, heat exchangers (passive or active), or other methods. In some cases, gaseous fuel may be recirculated through the vessel similar to the cooling recirculation described above. In some cases, such recirculated gaseous fuel may be passively heated using heat from the ambient environment or in other cases actively heated utilizing a heat exchanger in the recirculation loop. Such heat may come from any source including but not limited to a direct burner, or heat carried by a secondary working fluid that is heated by an indirect source. Such direct and indirect sources of heat may include wasted heat from the user site.

A temperature control component 151 (e.g., see FIG. 1*a*, 3*a*) for heating and/or cooling, such as a heat pump, may be incorporated to introduce or remove heat when emptying or filling the vessels (e.g., see vessels 122, 141, 142, 143) respectively. In fact, such a heat pump and associated temperature swings may be used to create pressure to fill other vessels. For example, gaseous fuel may be transferred from one vessel including an adsorbent to another vessel including an adsorbent by fluidly connecting the two vessels and then heating and/or cooling one vessel relative to the other. This has the effect of driving gaseous fuel from the hotter vessel and creating pressure that will drive the gaseous fuel to the relatively colder vessel.

Methods to counteract the heat of adsorption involve the incorporation of one or more phase change materials in thermal communication with the adsorbent material (or materials). Such phase change material tends to absorb heat above a certain temperature and release heat when cooled below a certain temperature. For example, FIG. 3*e* is a schematic showing a vessel material 340 including an adsorbent material 344 and a phase change material 346. According to one or more embodiments, the phase change material may comprise alcohol at 5% of weight. Various techniques may be used to avoid or minimize the loss of phase change materials during unloading. For example, Unloading parameters may be set to ensure that the phase change material (e.g., alcohol) condenses before being expelled with the gas during unloading. According to various embodiments, the phase change occurs near the filling temperature.

ANG storage may be kept at or below ambient temperature. If ANG vessels are kept at modestly low temperature (e.g. −20° C.), their storage density can rival CNG and in some cases may approach LNG densities. As used herein, the term cryogenic means a temperature below −20° F.

In some cases, it may be desirable to actively pump gaseous fuel from a vessel including adsorbent to some other part of a system that requires a higher pressure. This has the added effect of increasing the utilization of the adsorbent including vessel by removing more gaseous fuel during the unloading cycle than otherwise would have been removed. Any pumping device capable of creating a pressure differential may be used, e.g. compressors, blowers, diaphragm pumps, turbo pumps, etc. Such pumping can be used in conjunction with heating and/or cooling described above.

Adding heat to an adsorbent filled vessel will increase the actual pressure of the vessel (hot adsorbents release gas and do not adsorb), thus leading to "adsorption compression."

In some virtual pipeline systems, compressed natural gas (CNG) may be combined with adsorbed natural gas (ANG). For example, a CNG trailer may deliver natural gas (NG) to an end customer where said customer utilizes an ANG storage tank that remains at the customer site. Such a system allows CNG trailers at relatively high pressure to fill ANG tanks at lower pressure without the use of a compressor. Furthermore, as the high pressure CNG passes through a pressure control valve, its temperature drops by, i.e. JT cooling effect. Thus the filling of an ANG tank from a CNG trailer also enables the pre-cooling of the natural gas without the use of some other cooling mechanism. It is envisioned that such a hybrid system could replace traditional liquid fueling models such as heating oil delivery and vehicle fueling.

U.S. Provisional Application No. 61/787,503, filed Mar. 15, 2013, titled "METHODS, MATERIALS, AND APPARATUSES ASSOCIATED WITH ADSORBING HYDROCARBON GAS MIXTURES," discloses additional ANG embodiments, and the entire content of that application is incorporated herein in its entirety. The ANG embodiments and materials disclosed in that application may also be used in conjunction with any of the embodiments disclosed herein (e.g., the ANG materials/methods disclosed in that provisional application may be used in connection with any of the vessels 122, 141, 142, 143 disclosed herein).

Stationary Storage

Referring back to FIG. 1*a*, as described above, stationary storage vessels 141,143 can be utilized in various ways as part of the virtual pipeline system. Such storage may utilize a variety of gaseous fuel storage mechanisms including but not limited to LNG, CNG and ANG. Such storage systems allow intermittent filling and unloading demands to be smoothed. Stationary systems also typically have substantially lower costs per volume stored because they are subject to less demanding regulations. In addition, the respective weights of stationary systems are typically less critical than with mobile systems. Lastly, stationary storage vessels 141, 143 may incorporate more elaborate loading and unloading systems than may be practical with a mobile storage system. This can allow storage vessels 141, 143 to be mechanically moved from a transportation vehicle, e.g. truck, to the end site. In some cases, a crane or other lifting mechanism may be incorporated on the vehicle and a rack or other vessel holding device may be used at the stationary site. In other cases, the storage vessel 141, 143 may be fabricated on site. Since weight may not be an issue, it may be practical to use reinforced concrete with a suitable impermeable lining as a vessel 141, 143 to store gas. Such a container would have a large thermal mass which could be advantageous for filling/loading and unloading ANG vessels. Such a system, in some case, may be practical for buried applications or otherwise below ground level.

Another storage method uses a mobile transport trailer, operated under different regulations when mobile versus stationary (e.g., higher permitted pressure when stationary than when mobile and on regulated roads). For example, ASME regulations may require a 150% safety factor for stationary storage, while DOT regulations which may require 250-350% safety factors. The mobile vessel 122, 142 (e.g., oriented along a horizontal axis) can be tilted vertically in order to reduce the footprint required at the destination site. Thus, the mobile vessel 122, 142 may become the stationary vessel 143 and operated at a higher pressure when used as the stationary storage vessel 143.

The stationary gaseous fuel storage vessels 143 may include adsorbent and are stored on holding mechanisms at the use site. These stationary gaseous fuel storage vessels 143 are transported to the use site with a vehicle including a mechanism to move the vessels from the vehicle to the holding mechanism. Stationary gaseous fuel storage vessels may include a reinforced concrete shell with a gaseous fuel impermeable liner. The liner can be a polymer material. The liner can be a metal material including a steel alloy, or an aluminum alloy. Stationary gaseous fuel storage vessels 143 can be actively cooled or heated and can contain CNG, ANG, etc.

Vessels 122, 141, 142, 143 may be optimized for, among other things, storage cost by methane stored per $ of storage vessel cost or optimized for weight but not volume.

Vessels such as the mobile storage vessel 122, 142 and on-site storage vessels 141, 143 may include an adsorbent used for the transport or storage of natural gas. The gaseous fuel can be introduced to the vessel utilizing the "cooled loading" mechanisms described above. The vessel can be maintained below ambient conditions to increase storage capacity. In various embodiments, the introduced gaseous fuel is pre-cooled utilizing vaporized LNG or atomized LNG. The gaseous fuel can be pre-cooled prior to introduction to the vessel utilizing JT effects. The vessel can be maintained below ambient conditions. The vessel may include a phase change material to counteract the heat of adsorption. The vessel can be used as on-site storage at a mother station, be transported at least partially filled from site to site, be a stationary vessel at an end user site, and/or be filled from a CNG trailer.

Various embodiments further include a system having a heat pump based temperature regulation system to heat and/or cool all or a portion of one vessel for example, a vessel in the system depicted in FIG. 1*a*. The heating and cooling is used to pressurize the adsorbed gaseous fuel via desorption to fill another vessel. The vessel can be the primary fuel tank, e.g., on a NG fueled vehicle (e.g., see the mobile storage vessel 122, 142), which include an adsorbent.

Various embodiments further include a system having a pumping device to actively pump gaseous fuel from the vessel 122, 142 during the unloading cycle. A recirculation loop may be used where a portion of gaseous fuel is passed through the vessel. In various embodiments, such recirculated portion of gaseous fuel can be actively cooled or heated. In various embodiments, such heating or cooling can be accomplished with the temperature control component 151, 152, 153 such as a heat pump system. Such heating or cooling utilizes a source of heat or cooling from the end user site, e.g., utilizing waste heat. Such a pumping device may additionally and/or alternatively be used during the cooled loading process to drive recirculation (e.g., as the blower 333 or in place of the blower 333 illustrated in FIG. 3*a*).

Unloading at a User Site

When unloading gaseous fuel from the mobile transport system 120, e.g., at a user site 130*a-c* in FIG. 1*a*, the gaseous fuel may be delivered in a state conforming to a set specification. For example, the gaseous fuel may be specified to be at a certain pressure and temperature and have a certain chemical (e.g., BTU) composition. Moreover, it is often desirable to measure these quantities in addition to the flow of the gas. For example, if the gaseous fuel is owned by one party prior to the unloading station and ownership passes to a second party upon passing through the unloading station, metering such a flow, e.g., by a metering system 134 in FIG. 1*a* can be useful for the purposes of billing and logistics planning.

Virtual pipeline systems may use a loading/unloading system at the mother and user site. FIGS. 5*a*-5*h* are schematics showing an unloading process of a mobile storage vessel 5 mounted on a mobile gaseous fuel module 6. The mobile storage vessel 5 can be unloaded from the module 6 and onto an unloading system shown in FIG. 5*a* at the mother and user sites by using a connection mechanism 4. During this unloading process, the connection mechanism 4 can be used to provide equal height, safe unloading. No forklifts are needed according to one or more embodiments. Such a system may be used in virtual pipelines in which the trailers of the modules 6 are not kept with the vessels 5 during gas loading at the mother station or gas unloading at a user site. In contrast, such a vessel 5 loading/unloading system may be omitted in embodiments where the vessels 5 remain mounted on a trailer during loading/unloading of the gas into and out of the vessels 5.

Referring back to FIG. 1*a*, the unloading system 132 can serve multiple functions including, pressure/temperature regulation 136, gaseous fuel heating e.g., using a temperature control component such as a heater 153, metering system 134, and gaseous fuel composition control 138. In some cases, the unloading system 132 may also include additional stationary storage vessels 143 of the gaseous fuel or of some other fuel entirely.

In some implementations, the metering system 134 can be used to provide data with which to bill the end user. Some implementations may include metering for both the cumulative amount of gaseous fuel delivered to the end user and net remaining gaseous fuel stored in an attached primary mobile storage system and/or integral stationary secondary storage system. In some implementations, the metering data can be communicated by, for example, manual recordings, automatic wireless, and/or hardwired connections, to a central facility. In some implementations, the central facility can use the metering data to issue bills to the end user. In other implementations, the metering data can be used to schedule future deliveries of the primary fuel. In some cases, a software algorithm can be utilized to optimize delivery schedules in order to minimize delivery trips and maximize utilization of the primary mobile storage system.

In some implementations, the pressure-temperature ("P/T") regulation system 136 in the unloading system 132, may be used such that high pressure in the mobile transport system 120 may be reduced prior to introduction to the end customer site 130, 630. Such a pressure regulation system 132, 684 may be constructed from one or more pressure control valves. If the pressure of the gaseous fuel in the mobile storage system is sufficiently high (e.g. about 3600 PSIG or greater) and the delivered pressure is sufficiently low (e.g., about 150 PSIG or lower), the gaseous fuel can typically drop in temperature due to Joule Thompson effects ("JT cooling"), and if flows are sufficiently high relative to the thermal mass and heat transfer characteristics of the pressure regulation system, the temperature of the gaseous fuel may drop into cryogenic regimes. In such a case, according to various embodiments, cryogenically rated materials (e.g. stainless steels) may be used for all gaseous fuel handling components that may be exposed to the low temperature gas. The P/T regulation system 136, 684 may include pressure regulation valves, such as, for example, a single valve, or multiple valves to achieve coarse and fine regulation control. Pressure control valves can be arranged in series to allow a smaller pressure drop per valve. In addition, a heating process, e.g., by the heater 152 and/or 153 (see FIG. 1*a*), can be introduced between regulation stages to gradually re-heat the gaseous fuel after or before JT cooling effects. Multi-step pressure regulation may also be advantageous for precise downstream pressure control. For example, the bulk of the pressure drop can be achieve with a first pressure control valve that may tolerate large pressure drops at high flow, but offers imprecise downstream pressure control. A second pressure reduction valve can then be used to drop the pressure the remaining amount to the set point. In some implementations, the second or further valves in series will give superior pressure control (i.e. more accurate downstream pressure control) because the second or further valve sees a much smaller pressure drop. The system may use a combination of pressure and temperature valves to optimize the heating efficiency and capacity at different points in the discharge cycle.

When pressure must be reduced substantially (e.g. by a factor of about 50 or greater), a pressure safety valve ("PSV") may be used. The PSV acts an emergency back-up if the primary pressure reduction mechanisms fail. If the downstream pressure rises above a certain set-point, the PSV opens and allows gaseous fuel to travel to an emergency vent thereby protecting downstream equipment from damage due to exposure to high pressure. In some instances such venting, even only in emergency situations, may be undesirable because the venting of a flammable gaseous fuel can cause an unacceptable safety hazard (e.g. if there are ignition sources nearby). In such cases, a back-up "slam shut" valve may be used. Alternatively or additionally, in the case of a "slam shut" valve or any form of emergency shutdown where the source vessel is isolated from the unloader system, a buffer tank with a much larger volume than that of the unloader system can be used as a drain location for gas to be used at a later time. The buffer tank size would be appropriate to drain all applicable gas to at or below atmospheric pressure to minimize system back pressure.

Figure 6A:
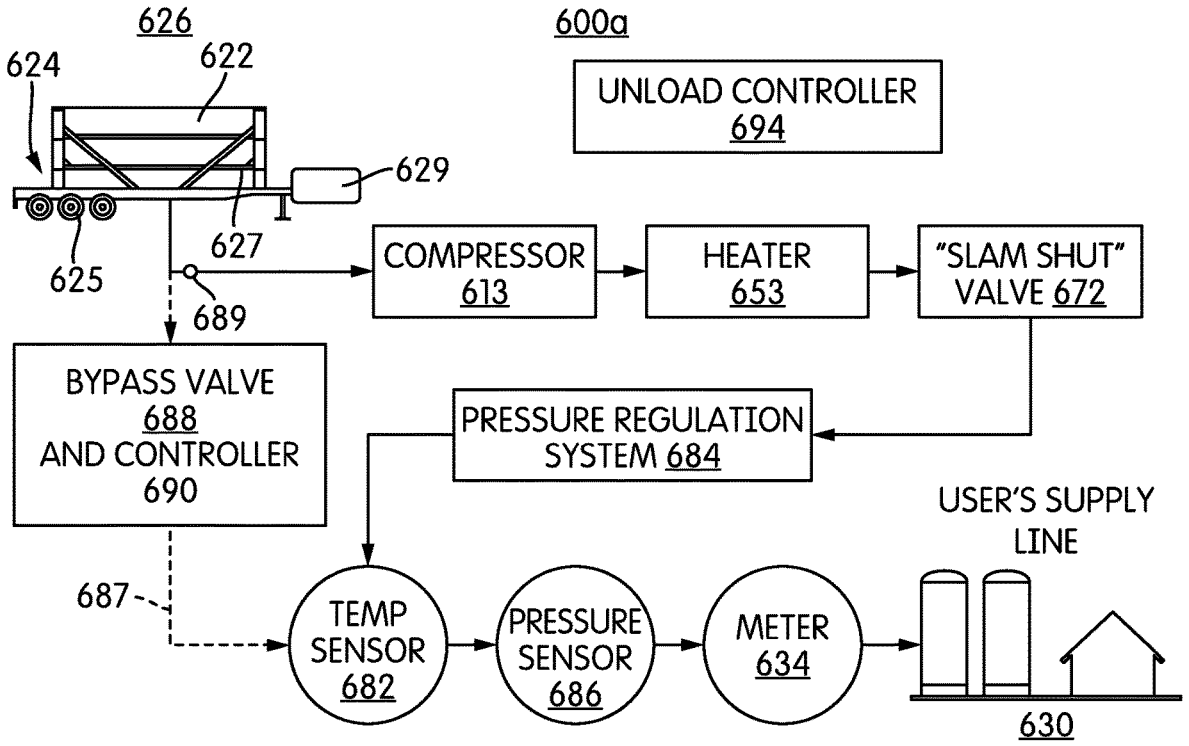
FIG. 6*a* is a schematic showing an exemplary unloading system in accordance with various embodiments of the present teachings.

FIG. 6*a* is a schematic showing an exemplary unloading system 600*a* including a mobile compressed gaseous fuel module 626 (e.g., also see 126 in FIG. 1*a*), which can be fluidly connected or disconnected to a site of a user's gaseous fuel supply line 630 (e.g., also see 130 in FIG. 1*a*). The mobile compressed gaseous fuel module 626 (or the module 626) can include a wheeled frame 624 (e.g., also see 124 in FIG. 1*a*) which, for example, is adapted to be propelled along a road by a motorized vehicle (e.g., a truck, also see vehicle 121 in FIG. 4*f*) that can be connected and disconnected from the module 626.

The module 626 can include the frame 624 and wheels 625 securely mounted below the frame to enable the frame 624 to be moved. The end of the frame 624 opposite the wheels 625 can be supported by a stand 627 to support the frame 624 in a substantially horizontal configuration when the truck is disconnected from the module 626. A hitch connection mechanism 629 is provided on the module 626 to enable the module 626 to be releasably connected to a truck, for example. In one embodiment, the module 626 is a trailer that is releasably connectable to a tractor or truck 121 (e.g., see FIG. 4*a*). In one embodiment, the frame 624 can be a truck bed.

The module 626 can further include at least one (e.g., multiple) mobile vessel 622 (e.g., also see 122 in FIG. 1*a*) mounted to the wheeled frame 624. The mobile vessel 622 contains compressed gaseous fuel, which can be supplied from the mobile vessel 622 to any users (e.g., see 130*a-b-c* in FIG. 1*a*) as desired.

For example, when a mobile transport system (e.g., see system 120 in FIG. 1*a*), e.g., including the mobile compressed gaseous fuel module 626 mounted or otherwise coupled to a vehicle (e.g., see vehicle 121 in FIG. 4*f*), arrives at a user's site, the vehicle may be disconnected from the module 626 and leave the module 626 at the user's site. In some embodiments, the module 626 may be fluidly and directly connected to the user's gaseous fuel supply line 630 to supply gaseous fuels to the supply line 630 as desired. In other embodiments, the module 626 may be fluidly, indirectly connected to user's gaseous fuel supply line 630 to supply gaseous fuels to the supply line 630. For example, one or more components including but not limited to, a compressor 613 (e.g., see compressor 113 in FIG. 1*a*), a heater 653 (e.g., see heater 153 in FIG. 1*a*), a "slam shut" valve 672, a pressure regulation system 684, a temperature sensor 682, a pressure sensor 686 (e.g., see P/T regulation 136 in FIG. 1*a*), and/or a meter 634 (e.g., see metering system 134 in FIG. 1*a*), may be configured between the module 626 and the user's gaseous fuel supply line 630. For example, the slam shut valve 672 may be placed upstream of the pressure reduction mechanisms. The slam shut valve 672 may utilize a control system wherein the downstream pressure is monitored, and if the downstream pressure rises above a specific set-point, the slam shut valve is actuated and quickly cuts off the flow through the system. In this way, downstream components are saved from exposure to high pressure gas, and yet no gaseous fuel is released to an emergency vent.

One or more additional safety valves may be additionally incorporated where such valves, or the control systems thereof, monitor flow or operating pressures in the system. A sudden drop in pressure may indicate an excessively high downstream demand, which many times is the result of a leak or accident, and as such will cause the safety valve to cut off flow to the system. A sudden increase in flow may also trigger the valve to cut off flow, which may be measured either directly with pressure/temperature compensation or simply a velocity measurement (direct or indirect, for example by a vortex inducer). The valve may also be activated by a temperature drop, for example if the heater were malfunctioning or insufficient for the flow rates, in order to protect equipment downstream.

In various embodiments, the natural gas piping and associated components may be separated from any possible heater or other equipment not in direct contact with natural gas by use of a firewall. There are significant cost premiums for commercially available equipment including but not limited to heaters, transformers, and generators that are rated for certain. OSHA classifications, e.g. Class I Division 2, relative to equipment without any such classifications. Such a firewall may facilitate an unclassified partition within the unloader and allow for cost savings.

In various embodiments, the control system on the unloader can provide additional static safety features such as pressure relief valves and the opportunity to optimize the volume of gas transferred from the mobile vessel to the user. The control system may include automatic trip triggers based on any of the available instrumentation, e.g. pressure, temperature, flow, or an available manual button for unit shut down by operator. The control system onboard the unloader may communicate with valves and/or measurement instruments on the mobile vessel through means of hydraulic, pneumatic, digital, or analog signals. Such communication would facilitate automatic operation of trailer on/off valves in the case of system shutdown or after mobile vessel has completed the unload process. This can be particularly beneficial to minimize the amount of required human interaction with the system during operation and switching mobile vessels as the primary gas source to the user.

The control system may also route the gas on the unloader through one of multiple available passageways depending on the pressure in the mobile vessel, such that each passageway is designed for appropriate pressures and with minimal pressure losses for a given mobile vessel pressure range. E.g. the mobile vessel pressure ranges may be approximately 3,600 psi to 1,800 psi, 1,800 psi to 600 psi, and 600 psi to 150 psi. In sequential order based on the mobile pressure range, the unloader control system may route gas through two cryogenically rated letdown valves and any such heat source, then through two non-cryogenic letdown valves, and lastly a line with one non-cryogenic letdown valve, respectively. Such a waterfall operation would allow for minimal equipment for each respective supply pressure, thus minimizing pressure losses and maximizing utilization of available gas on the mobile vessel.

In various embodiments, the module 626 may be kept at the user site until the user has consumed at least about 30% by weight of the compressed gaseous fuel in the vessel 622, which can then be fluidly disconnected from the user's gaseous fuel supply line 630 and removed from the user's site. In embodiments, the module 626 may remain coupled to a vehicle (e.g., a truck) rather than be disconnected to the vehicle, when it is fluidly connected or disconnected to the user's gaseous fuel supply line 630.

Referring back to FIG. 1*a*, in some implementations, the unloading system 132 may include a heater 153 to warm gaseous fuel to a desired temperature prior to delivery to the end user. Such heating devices may be incorporated upstream or downstream of the pressure regulation system, if any. If the gaseous fuel is pre-warmed or heated prior to depressurization, the gaseous fuel will not fall to as low a temperature, and the use of cryogenic valves may be avoided. Furthermore, the gaseous fuel is in a denser state allowing for more efficient heat transfer with lower pressure drop. Such heating mechanisms can use any appropriate heating technology or combination thereof. Such mechanisms are described in more detail below.

Figure 6B:
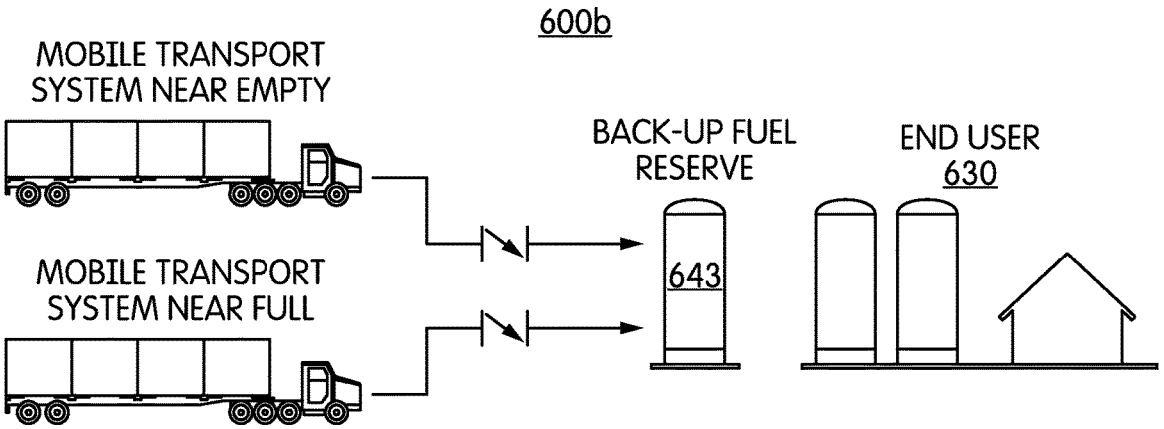
FIG. 6*b* is a schematic showing an exemplary system including a back-up fuel vessel and a dual connection in accordance with various embodiments of the present teachings.

As shown in FIG. 6*b*, the secondary fuel storage system 143, 643 may be used as a back-up fuel reserve to assure reliability when the primary mobile storage system (e.g., 122, 142, 626) is not available. The secondary fuel storage system 143, 643 may also be utilized to arbitrage between prices for disparate fuels. The gains from arbitrage may be shared between the fuel buyer and fuel seller or the all the gains from arbitrage may be kept by the fuel seller or the fuel buyer. The fuel gas stored in the secondary gaseous fuel storage system 143, 643 can be mixed with air or an inert gas (e.g., nitrogen) to simulate the fuel value of the primary fuel. The secondary storage system 143, 643 can store the same fuel type as the primary mobile storage system. In various embodiments, the secondary storage vessel may be periodically topped off by a CNG mobile storage system. The secondary storage vessel may include an adsorbent. The secondary storage system 143, 643 may be used routinely to enable the primary mobile storage devices (e.g., 122, 142, 626) to be fully emptied prior to transportation back to the compression station.

As shown in FIG. 1*a*, the fuel composition control 138 may be used to alter fuel composition. The fuel composition control 138 may utilize an adsorption effect to remove $CO_2$ or $N_2$ from the primary fuel (e.g., 122, 142) in order to increase BTU value of the fuel. The fuel composition control 138 may include a storage tank of $N_2$ and a blender to mix the primary fuel and $N_2$ with the goal of lowering the BTU value of the fuel. Catalysts may be used to convert CO into $CO_2$ and thus allow proper adsorption. Other materials such as membranes, molecular cages, and chemical reactions may be used alone or in combination to extract a particular molecule. C2+ and higher value hydrocarbons may be removed through the use of "tuned" pore adsorbents, with pore diameters that can better capture the larger molecules and thus achieve a two-pronged effect of retaining the NGLs (Natural Gas Liquids) whilst increasing the purity/value of the gas being delivered. In some cases this approach with combinations of catalysts, adsorbents, absorbents, and reactants can lead to bypassing a gas plant and generating considerable value out of wellhead gas, landfill gas, or some other non-pipeline spec gas.

In some embodiments, it may be advantageous to incorporate a secondary fuel supply as a back-up to the primary supply in the mobile transport system. This secondary supply may be used in case the primary mobile storage system is unable to arrive in time (e.g. due to accidents, equipment breakdowns, fuel shortages, and other factors). If the back-up fuel is the same as the primary fuel, the back-up supply can be used as a buffer that allows the mobile system to be fully depleted prior to delivery of a new full mobile storage system. Since such mobile systems (e.g. Type II trailers) can be very expensive and stationary systems can be comparatively less expensive, using back-up storage can lead to higher utilization of expensive assets and hence a higher ROI on the entire system. Such stationary systems may use any suitable technology to storage natural gas including CNG, LNG and ANG technologies.

FIG. 6*b* is a schematic showing a back-up fuel vessel 643 and relation to a primary trailer 120, 626 and customer supply pipe. FIG. 6*b* also shows a dual connection to allow attachment of a full trailer 120, 626 prior to disconnection of near-empty trailer 120, 626, as well as check-valves to prevent trailer-to-trailer transfer of gas from the nearly full trailer 120, 626 to the nearly empty trailer 120, 626. Additionally and/or alternatively, compressors may be used with the trailers 120, 626 to pump more of the gas out of a nearly empty trailer 120, 626 than is possible in the absence of a compressor. The use of such compressors may reduce the wasteful transport of unused gas back to the mother station.

Figure 6C:
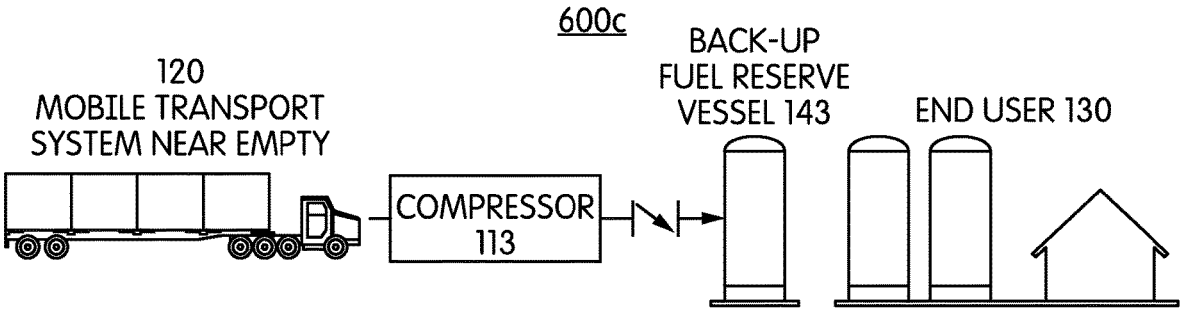
FIG. 6*c* is a schematic showing an exemplary system for top-off a back-up fuel vessel from a lower pressure trailer in accordance with various embodiments of the present teachings.

The stationary storage containers, e.g., the vessel 143 in FIG. 1*a* or the back-up fuel vessel 643 in FIG. 6*b*, can be periodically refilled by the delivered mobile system 120. In the case of CNG, this can be done with a simple "top off" connection where a large mobile storage system is connected to a smaller stationary system so that when the two are combined, the pressure remains relatively high. Once gaseous fuel stops flowing from the mobile to the stationary system, the remaining volume in the mobile system 120 can be redirected to the unloader or the unloading system 132 for delivery to the end user 130. In other cases, a compressor 113 may be used to pump from the mobile system 120 vessel 122, 142 pressure to the higher stationary system 143 pressure. For example, FIG. 6*c* is a schematic showing use of a compressor 113 to top-off a back-up fuel vessel 143 from a lower pressure vessel 122, 142 of a mobile transport system 120. Of course, the stationary storage system 143 may include an adsorbent. In such cases, a CNG based mobile storage system 120 at high pressure may fully "top off" the adsorbent including stationary system 143 without compression.

With the first filling of the onsite storage 143 from a fresh mobile transport system 120 with 3600 psig vessels 122, 142, assuming equal volume in the system 120 and storage 143, the vessels 122, 142 and onsite storage 143 will even out at 1800 psig. During subsequent top-offs, the onsite storage 143 can eventually get close to the initial pressure of the vessels 122, 142 (e.g., 3600 psig) with subsequent connections to fresh, full systems 120 if the system 120 is connected to the onsite storage 143 before being used to supply the rest of the user site 130.

A steeple cylinder may be used to compress lower pressure gas to a higher pressure (e.g., 3600 psig) for injection into the stationary storage vessel 143 by taking advantage of large pressure differential between the system 120's vessels 122, 142 and the lower pressure gas desired by the user site 130. The steeple cylinder enables the pressure differential between the vessels 122, 142 and the supply line 630 of the user 130 to compress some of the gas from the vessels 122, 142 to a higher pressure for delivery to the stationary vessel 143. In this manner, the stationary vessel 143 can be topped off to a higher pressure (e.g., 3600 psig) than is present in the system 120's vessels 122, 142.

Figure 6D:
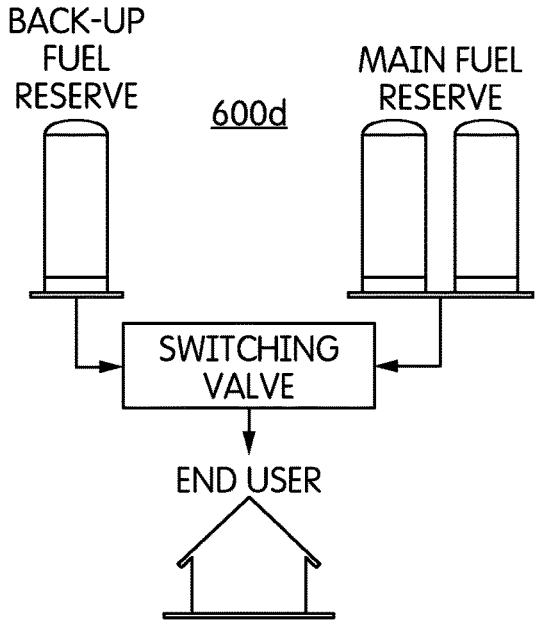
FIG. 6*d* is a schematic showing an exemplary dual fuel switching system in accordance with various embodiments of the present teachings.

If the back-up fuel is different from the primary fuel (e.g., propane rather than natural gas), then use of the back-up fuel can be advantageous in various circumstances. For example, there can be situations where the market price of natural gas briefly goes above that of propane. If one switches to the back-up fuel in such situations, purchase of the more expensive primary fuel can be avoided, or already purchased primary fuel may be sold back to the market for a profit. Various business models are enabled with this configuration. For instance, a single company can offer to provide a "BTU Contract" wherein the customer pays for a fixed number of BTU per day and given price per BTU. Alternative, the customer may contract to purchase a fixed volume of natural gas, and when market conditions are favorable, allow themselves to be switched to the back-up fuel and sell the nominated natural gas back to the market. In such situations, the net profits from such a market transaction can be shared between the fuel provider and fuel buyer. For example, FIG. 6*d* is a schematic showing a switching valve between primary and back-up fuel vessels, e.g., particularly for dual fuel systems.

Figure 6E:
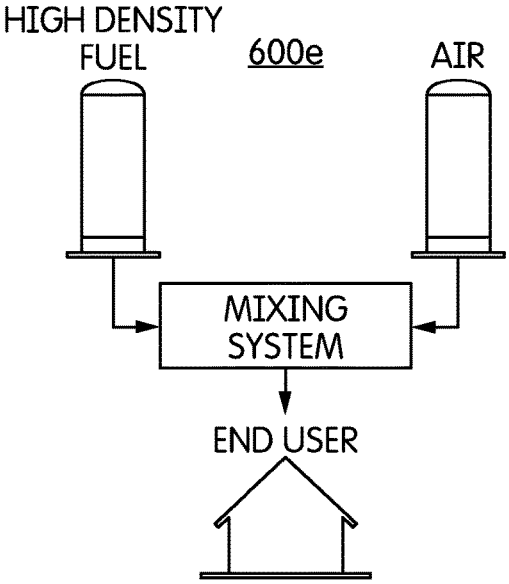
FIG. 6*e* is a schematic showing an exemplary air mixture system in accordance with various embodiments of the present teachings.

In systems with disparate fuels that are both gaseous, it can be advantageous to mix the greater density fuel (e.g. propane) with air or an inert gas (e.g. carbon dioxide or nitrogen) in order to simulate the BTU content of natural gas. Such mixers can allow for the rapid switching between fuel types without end user intervention or in some cases without even end user knowledge. For example, FIG. 6*e* is a schematic showing air mixture system when higher fuel density gaseous fuel (propane) is used for NG supply pipe.

Figure 6F:
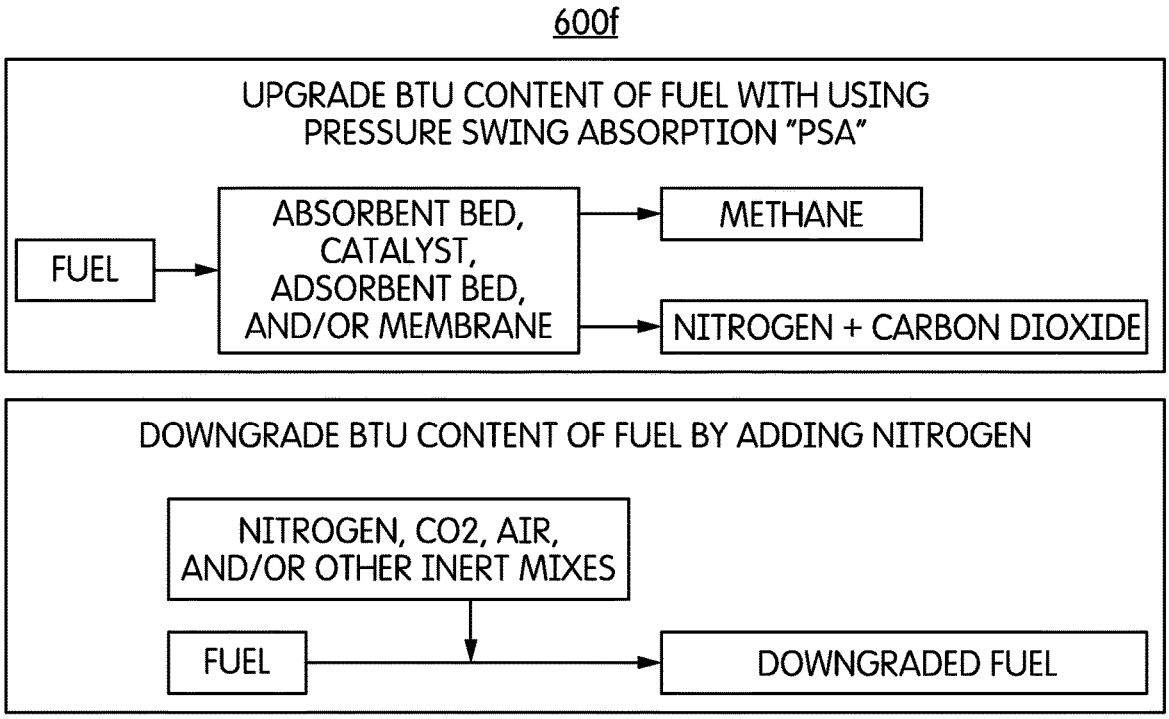
FIG. 6*f* is a schematic showing an exemplary system for standardizing British Thermal Unit (BTU) content in accordance with various embodiments of the present teachings.

In some cases, the unloading system may be utilized to modify the fuel composition in other ways. For example, an adsorbent bed can be used to preferentially adsorb methane and thereby separate nitrogen and carbon dioxide from the fuel stream. Such pressure swing adsorption ("PSA") is commonly practiced in industry and typical materials are molecular sieves, zeolites (which act electrochemically or electrostatically to separate and adsorb specific molecules such as $O_2$ or $N_2$), molecular cages, among others. Vacuum swing adsorption ("VSA") may also be used and preferred for certain situations where heating use typical in PSA processes could be minimized. PSA/VSA may also be used to upgrade the BTU content of a gaseous fuel delivered to an end user by retaining low BTU or non-combustible components of the gas. Conversely, the unload station can be designed to mix nitrogen or other inert gases (e.g. from a stationary storage system) with the gaseous fuel to lower the BTU value. Such fuel conditioning steps can be implemented separately or in combination in order to upgrade a non-uniform fuel stream into a constant BTU value fuel stream to the end user. For example, FIG. 6*f* is a schematic showing a system to standardize BTU content from non-uniform fuel supply, where the BTU content of fuel can be upgraded by using PSA and/or downgraded by adding, e.g., nitrogen.

Figure 6G:
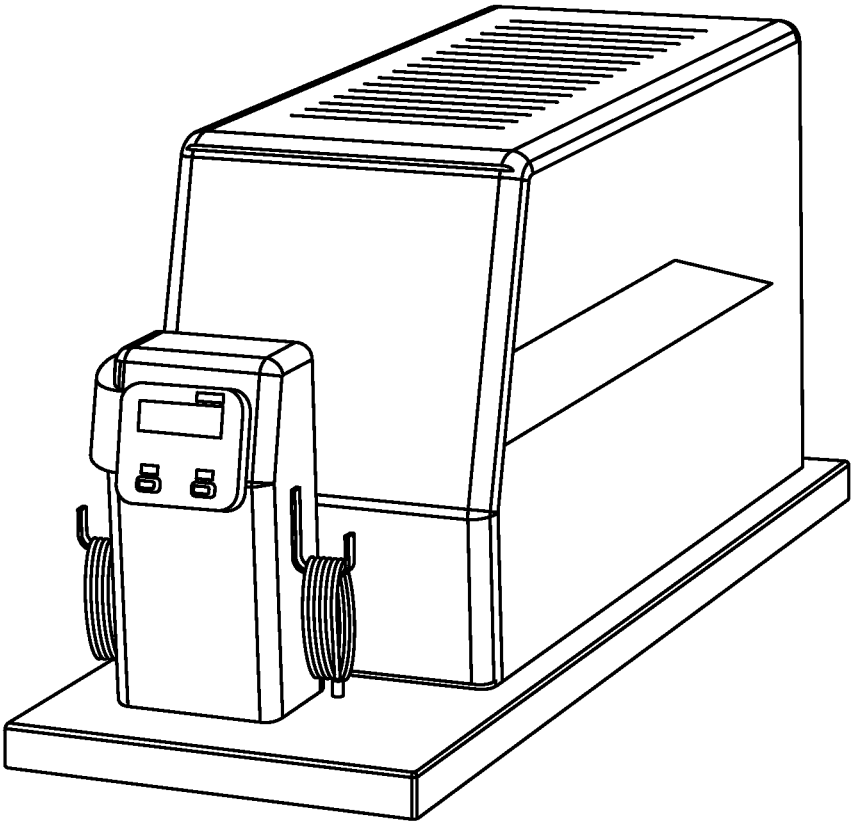
FIG. 6*g* is a schematic showing an exemplary gaseous fuel handling equipment in accordance with various embodiments of the present teachings.

In some cases, the end user site may be subject to viewing from individuals not technically familiar with the equipment. Because the look of gaseous fuel handling equipment can potentially look threatening to some casual observers, it is sometimes warranted to enclose the unloading system in an aesthetically pleasing enclosure. Such enclosures can be designed to resemble devices with which the casual user may be more comfortable, such as gasoline pumps. For example, FIG. 6*g* is a schematic showing the gaseous fuel handling equipment in a container that resembles a conventional liquid fuel pump.

Construction of Stationary Storage Vessels

The stationary storage vessels 141, 143 may comprise any type of suitable storage vessel. According to various embodiments, stationary storage vessels 141, 143 can be shipped to the site 110, 130 in an unassembled state and assembled/fabricated on-site. According to various such embodiments, the storage vessel 141, 143 comprises two steel plates and numerous pipes extending between them. The ends of the pipes are circularly welded (e.g., by robotic on-site welders) to the plates to make sealed vessels, access to which is provided by drilling hole(s) through the plates. The pipes may be up to 26 inch diameter seamless, extruded pipes with a 1.5 inch wall thickness if the vessel 141, 143 is designed for use with 5000 psig pressure. The pipes could be as large as 48 inch diameter if the maximum pressure is reduced to 3600 psig. Even larger pipes (e.g., up to 96 inch diameter) may be used for ANG vessels because such vessels may have a lower operating pressure. Beyond those diameters, there may be a diminishing return on volume in exchange for additional steel required. Seamed or seamless pipe may be used. Pipe size and type can be optimized by balancing the cost of the pipe required against the volume/mass capacity of the pipe.

By transporting the vessels 141, 143 to the site 110, 130 unassembled, the vessels can be transported in much less space than would be required to transport them in their assembled state. Because the material used to fabricate the vessels 141, 143 (e.g., steel plate and pipe) is often manufactured far from the site 110, 130 (e.g., in a different country), transportation costs are high on a per/volume basis, such transportation costs can be greatly reduced by transporting the vessels 141, 143 to the site 110, 130 in their more compact unassembled/fabricated state. Unconnected pipes can be tightly packed together for transportation, while the assembled pipes are typically spaced from each other to facilitate welding the pipes to the plates. In various embodiments, the cost savings can be substantial because transportation costs can rival the material costs of vessels 141, 143 in some circumstances. According to various embodiments, the transported volume of the unassembled vessels 141, 143 is at least 30, 40, 50, 60, and/or 65% smaller than the assembled volume due to the open space between the assembled pipes of the vessel 141, 143. The unassembled volume may be between 20 and 90% smaller than the assembled volume according to various embodiments.

To further reduce the transportation volume of the unassembled vessels 141, 143, different sized pipes (e.g., 42 and 46 inch internal diameter pipes) could be nested one inside the other.

Instead of using plates, the vessels 141, 143 may comprise a serpentine honeycomb using numerous lengths of straight pipes with U-shaped (or other-shaped) bends therebetween. The welds (or other types of connections) between the pipes and bends may be easier to form than the butt-welds used between the pipes and plates according to the previously discussed embodiment.

Unloading Heater

The unloading system can incorporate a number of different technologies to counteract JT cooling, e.g., by a heater 152 and/or 153 depicted in FIGS. 1*a*, 6*a*, and 7*a-d*. These may include, for example, catalytic burners, inline heaters, indirect burners, process heat from another source (e.g. process steam from the end user), municipal steam systems, solar heat, and waste heat from some other process. The gaseous fuel may be heated, through the use of any appropriate heat exchanger and/or heat exchange mechanism.

Figure 7A:
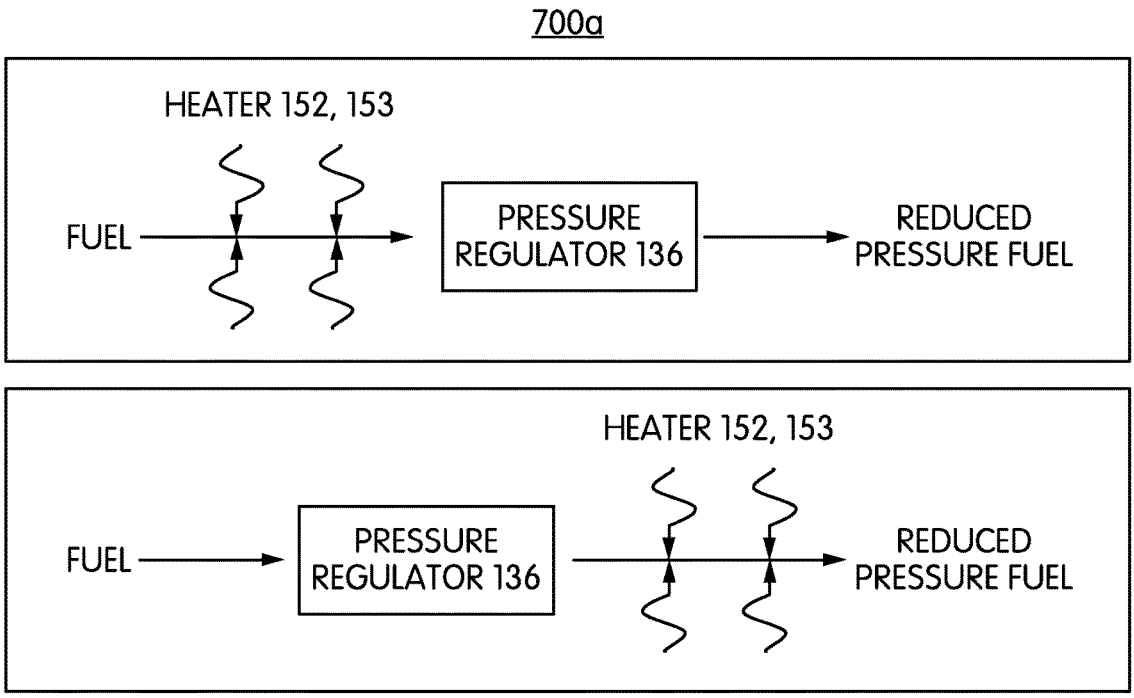
FIG. 7*a* is a schematic showing various exemplary unloading heater systems in accordance with various embodiments of the present teachings.

FIG. 7*a* is a schematic showing that the heater 152, 153 (e.g., heat exchangers, boilers, etc.) may heat the gas either upstream from or downstream from the pressure regulator 136. Heating the upstream gas may advantageously increase the minimum temperature of the gas, thereby possibly avoiding cryo temperatures anywhere in the flow path. However, placing the heater 152, 153 downstream of the letdown at the pressure regulator 136 may be useful because the temperature gradient across the heat exchanger of the heater 152, 153 is larger at this downstream position, so there is better heat exchange rate, which may facilitate more efficient heat exchange, or the use of a smaller, less expensive heat exchanger. Downstream heat exchange may also facilitate separation of propane and methane, enabling the separate collection of propane.

In one implementation, the gaseous fuel is heated prior to pressure reduction using a heat exchanger 152, 153 that is radiatively coupled to a catalytic burner. In another implementation., the gaseous fuel is warmed within a heat exchanger 152, 153 via a process fluid (e.g. water) which is warmed in a separate gas-fired boiler and circulated through the heat exchanger. Such indirect fired systems may be advantageous in some situations because it can be important for safety considerations to keep the source of heat (i.e. source of ignition) away from the components containing pressurized flammable gasses (e.g. natural gas). Such systems are known as "explosion proof", or flammability risk reduction, and rated by various systems such as Class 1, Div. 2., etc. and institutions such as NEMA, NFPA, and DOT, among others.

The heat for the heater 152, 153 may come from any suitable source (e.g., low grade waste heat from an inline heater or driving engine or other sources of low grade heat at user site 130, thermal heat of compression generated at the filling site 130, electricity from an onboard or off-skid generator powered by fuel or thermo-mechanical power (i.e. expander-generator in gas line), ambient air temperature, solar radiation, and/or fuel combustion).

According to various embodiments, heat is stored in a thermal mass (e.g., water/gel/phase change material wax) that may be heated over a long period of time and its heat transferred to the gas and/or vessel 122, 142 when desired via a heat exchanger. A feature of indirect fired systems according to one or more embodiments is that the process fluid has substantial thermal mass and reservoirs that may be included in the heating loop to increase this thermal mass to allow for the heating component to be sized more closely to the average heating load. Other types of thermal mass may also be employed. Use of thermal mass can be advantageous according to some embodiments because, in some instances, it can allow the size of the indirect heater to be reduced to a level closer to the mean heating load. Another method of providing heat is the use of phase change materials (e.g. paraffin wax) to act as thermal storage.

The heater 152, 153 may provide low grade heat over a large heat transfer surface to effect faster heat transfer from the heat source or thermal mass to the gas to be unloaded.

A large thermal mass may facilitate the use of a smaller, less expensive heater 153. The thermal mass may be held in a stationary storage vessel at the user site 130. Alternatively, the thermal mass may be mounted to the mobile transport system 120 and move with the vessels 122, 142 between the mother station 110 and user 130.

In warm climates, the indirect heater may be discarded altogether, and a fluid loop may be employed to transfer heat from the ambient environment, through a heat exchanger, to the gas. In some implementations, a control system can be implemented to control the heating effect in order to maintain the delivered temperature of the gaseous fuel within a specified set point. In some implementations, a refrigeration system (e.g., a heat pump) can also be incorporated to cool the gas.

Figure 7B:
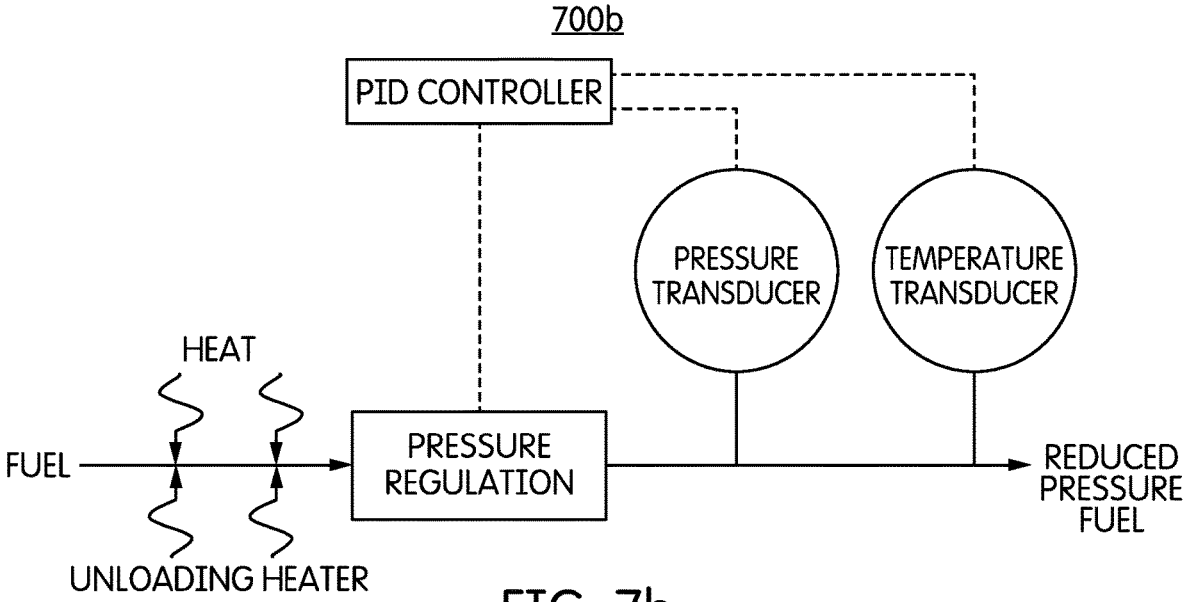
FIG. 7*b* is a schematic showing an exemplary control loop used with an unloading heater in accordance with various embodiments of the present teachings.

FIG. 7*b* is a diagram showing a control loop used with unloading heater to ensure appropriate temperature of gaseous fuel supplied to customer. Pressure transducer and/or temperature transducer can be used in the unloading heating system 700*b*. The unloading heater may heat the gaseous fuel to within a desired range of temperatures. The heating methods can include, but are not limited to, a radiatively coupled catalytic burner, an indirect fired boiler thermally coupled to the gaseous fuel with a circulating fluid loop, line heater, and/or an air/gaseous fuel heat exchanger.

According to various embodiments, heat may be transferred to the gas in the vessel 122, 142, rather than to gas that has already left the vessel 122, 142 (e.g., after pressure regulation). Heating the gas in the vessel 122, 142 itself during unloading may facilitate faster unloading times by increasing the relative pressure differential between the vessel 122, 142 and the user 130, while still keeping the downstream gas temperature above a predetermined threshold (e.g., cryo temperatures, or temperatures below which the design rating of the hoses, fittings, or other structures handling the gas). The higher pressure differential increases the amount of gas that can be quickly delivered and sold. The increased differential pressure also may increase the flow velocities, facilitating delivery to high demand users. The increased temperature may also help avoid or decrease the magnitude of the Joules-Thompson effect while the gas is depressurized to the delivery requirements. Such benefit would negate or reduce the heating costs at the unloading site.

The temperature control component 152 of the mobile transport system 120 may incorporate both heating and refrigeration components (e.g., a 2-way heat pump). According to various embodiments, the temperature control component 152 includes a thermal mass and is incorporated into the mobile transport system 120. According to various embodiments, the thermal mass could comprise a water-filled vessel mounted on the wheeled frame 122 of the mobile transport system 120. As explained above, during cooled loading, the temperature control component 152 may pull heat from the gas being loaded into the vessel 122, 142 and store that extracted heat in the thermal mass. The temperature control component 152 may then pump that heat back into the gas and/or vessels 122, 142 during unloading, as explained above.

The temperature control component 152 may be used alone or in combination with a heater 153 at the user site 130 to provide heat to the gas and/or vessel 122, 142 for unloading.

Controlling the temperature of the vessel 122, 142 during loading and/or unloading may reduce the temperature variation experienced by the vessel 122, 142, which may result in longer tank life.

Figure 7C:
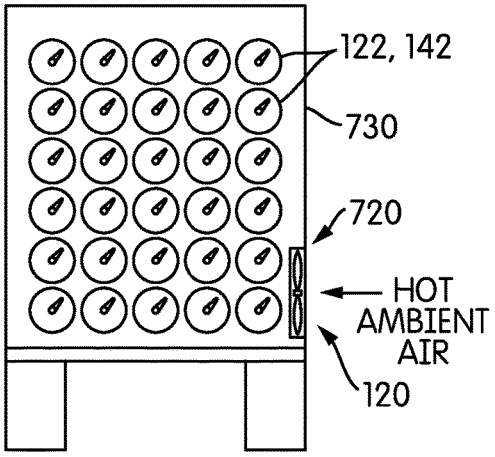
FIGS. 7*c-k* are schematics illustrating ways of heating and/or cooling the vessels during loading, transport, and/or unloading according to various alternative embodiments of the present teachings.
Figure 7D:
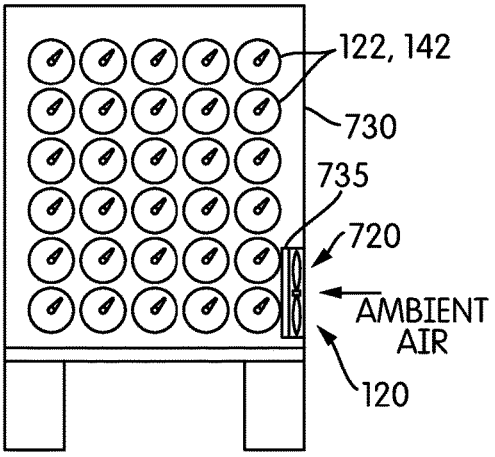

As shown in FIG. 7*c*, the heater 152, 153 may comprise a fan 720 that blows hot ambient air into the enclosed space (e.g., an enclosed ISO or trailer box 730 of the mobile transport system 120) around the vessels 122, 142 in the mobile transport system 120. As shown in FIG. 7*d*, a direct heater or heat exchanger 735 (e.g., which circulates heated thermal mass material such as water) may be added to heat air being blown into the mobile storage system 120 by the fan 720. In the embodiment shown in FIG. 7*d*, the fan 720 may blow ambient air into the enclosed space 730, or alternatively simply circulate heated air with in the space 730 in the mobile transport system 120.

Figure 7E:
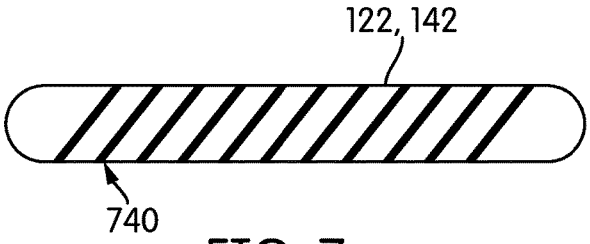

According to alternative embodiments, as shown in FIG. 7*e*, the temperature control component 152 and/or heater 153 may comprise heating wire/tape 740 wrapped around the surface of the vessel 122, 142. Passing electricity through the heating wire 740 provides heat to the vessel 122, 142 during unloading to keep the vessel 122, 142 temperature above a predetermined threshold.

Figure 7F:
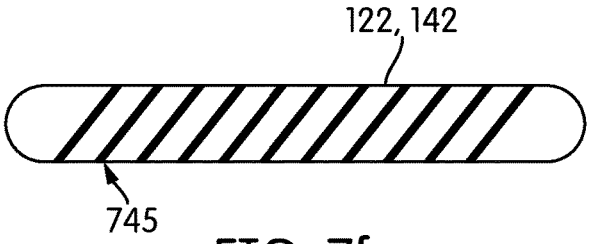
Figure 7G:
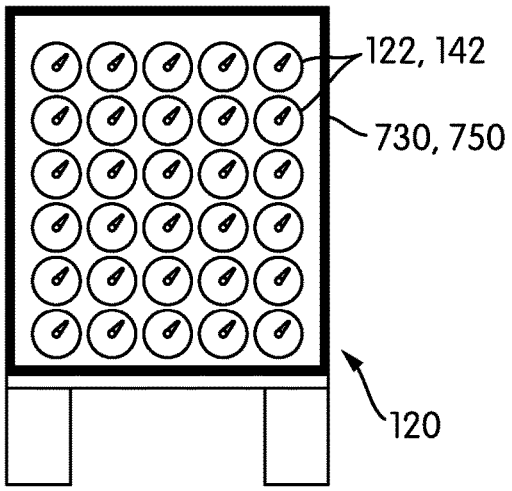
Figure 7H:
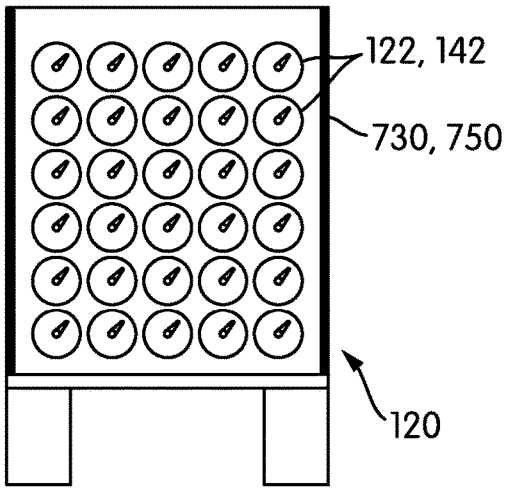

As shown in FIG. 7*f*, flexible tubing 745 containing phase change material may be wrapped around the vessels 122, 142. As shown in FIGS. 7*g* and 7*h*, hollow walls, ceilings, and or other parts of the shell 730 of the mobile storage system 120 may be filled with such phase change material 750. Alternatively, heated fluid (e.g., hot water) may be actively passed through tubing such as the tubing 745 so as to transfer heat from the heated fluid to the vessel 122,142 and compressed gas therein. The fluid may be heated in any suitable manner. Heating may also be indirect. For example, a warm radiator may line the bottom of the mobile transport system 120 or module 126 that encloses the vessel(s) 122, 142, and indirectly warm the vessel(s) 122, 142 inside the enclosed system 120 or module 126 by convection.

Figure 7I:
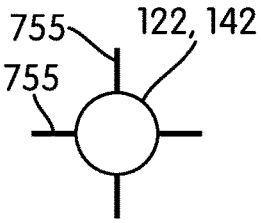
Figure 7J:
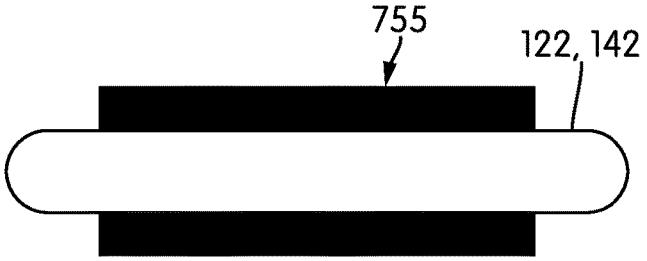

As shown in FIGS. 7*i* and 7*j*, passive heat sink fins 755 (e.g., steel or aluminum) with a large surface area may be attached to the vessel 122, 142 to improve heat absorption from the ambient environment or heated air within the mobile storage system 120 during unloading.

According to alternative embodiments, heat absorbing paint may be used on the exterior of the mobile storage system 120 to absorb solar energy.

Figure 7K:
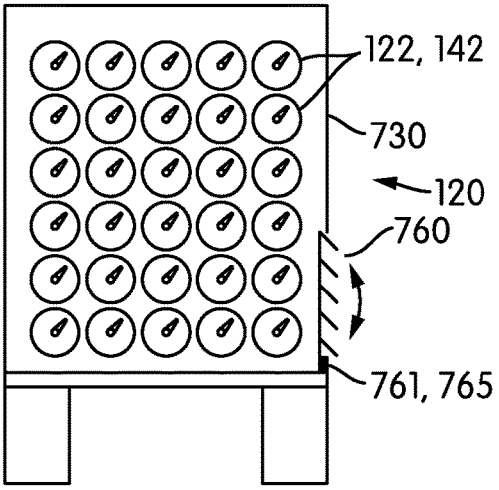

As shown in FIG. 7*k*, the container 730 may include a ventilation system that includes an opening covered by louvers 760 that are actuated by an actuator 761. The adjustable ventilation system can be controlled automatically by a controller 765 that controls the actuator 761 without human interaction to increase or decrease heat transfer rate with the ambient environment in order to optimize the operation based on instantaneous weather conditions. Benefits of optimization may include, but are not limited to, loading rates and/or capacity, unloading rates and/or capacity, and reliability of vessels 122, 141, 142, 1433 by reducing magnitudes of thermal cyclic loading.

The automation may be by means of a controller 765 that includes a mechanical limit switch, programmable logic controller, or similar control method. The controller 765 may include a temperature sensor, anemometer, or the like, to measure ambient weather conditions and adjust the louvers 760 accordingly. The instantaneous temperature of the gas and/or intended procedure, i.e. filling or unloading, may be an input into the logic and affect control output signals of the controller 765. The actuator 761 may comprise pneumatic or hydraulic powered actuator(s), an electric or pneumatic fan that controls louvers 760 that are spring-biased closed via air pressure. Such mechanisms may be mounted on the external or internal walls or roof of the subject container 730. All controls may be discrete or continuous in nature.

During unloading the controller 765 may open the louvers 760 when the ambient temperate exceeds the temperature of the vessels 122, 142 and gas therein so as to transfer heat from the environment to the gas and vessels 122, 142. Conversely, during unloading, the controller 765 may close the louvers 760 when the ambient temperature is below the temperature of the vessels 122, 142 so as to prevent or discourage heat from escaping from the vessels 122, 142 into the environment.

While various of the above-discussed systems are designed to heat the gas and/or vessels 122, 142 during unloading, they may alternatively be used to help cool the gas during loading and/or during transport. For example, during loading and/or transport, the controller 765 may open the louvers 760 when the ambient temperate is below the temperature of the vessels 122, 142 and gas therein so as to transfer heat from the gas and vessels 122, 142 to the environment. Conversely during loading and/or transport, the controller 765 may close the louvers 760 when the ambient temperature is above the temperature of the vessels 122, 142 so as to prevent or discourage the vessels 122, 142 and gas from being heated by the environment.

Additionally and/or alternatively, the controller 765 may be used to heat the vessels 122, 142 during transport to facilitate faster, hotter unloading of the gas at the user site 130. For example, the controller 765 and/or other temperature control components 152 of the mobile transport system 120 may be used to heat the gas in the vessels 122, 142 during transport, while ensuring that the pressure remains below a predetermined threshold (e.g., 125% of rated pressure for the vessel 122, 142).

Additionally and/or alternatively, the controller 765 may utilize other thresholds for determining when to open or close the louvers 760 (e.g., absolute vessel 122, 142 temperature, absolute ambient temperature, etc.).

Although illustrated in connection with a container 730 of a mobile transport system 120, louvers 760, actuator 761, and controller 765 could additionally and/or alternatively be used in connection with a stationary container that holds stationary vessels (e.g., vessels 121, 143) without deviating from the scope of the present invention. Similarly, any of the above-discussed heaters could alternatively be used with stationary vessels 121, 143 without deviating from the scope of the present invention.

According to additional and/or alternative embodiments, any one or more of these heating mechanisms may be used in combination to improve heat transfer to the vessels 122, 142 and gas during unloading.

Unloading Bypass Line

As discussed above, the unloading system may include several components that facilitate reducing the pressure of the gas in the vessels 122, 142 and heating the gas so as to provide acceptable pressure and temperature gas to the user 130 (e.g., heater 153, 653, pressure and temperature regulator 136, etc.). These components may have an inherent pressure drop through the component. The number of regulators 136 and size of heater 152, 153 may be determined by the pressure drop and heat load according to various embodiments. The pressure drop and associated heat load are a function of the mobile storage vessel 122, 142 pressure, which decreases during the unloading process.

As shown in FIG. 6*a*, the unloading site 130 may have a secondary bypass line 687 with less flow resistance than the primary line (the line through one or more of the compressor 613, heater 653, valve 672, pressure regulation system 684, temperature sensor 682, pressure sensor 686, and meter 634) and may be opened and utilized based on some measured flow parameter, either pressure or temperature, upstream of the secondary line, e.g., via a pressure/flow/temperature sensor 689. The lower flow resistance through the secondary line 687 may be achieved by the one or more of the following methods: reduced number of regulators, elbows, heat exchangers, and/or other pressure loss elements, shorter heat exchanger, and any other means to minimize resistance. The reduced pressure losses through the secondary line 687 may allow design flow rates at a lower inlet pressure, thereby maximizing mass of delivered gas or product. Engagement of the secondary line 687 may be achieved with an actuated valve 688 or other similar control mechanism. The discrete methodology of such flow line 687 may be controlled by a programmable logic controller 690, mechanical limit switch, or other control tools, which may be operatively connected to the sensor 689 to determine when the upstream pressure, pressure differential between the vessels 122, 142 and user site 130, flow rate, temperature, and/or other parameter is suitable for using the secondary line 687.

In the embodiment illustrated in FIG. 6*a*, the secondary line 687 entirely bypasses the compressor 613, heater 653, valve 672, and pressure regulation system 684. According to alternative embodiments, the secondary line 687 may still pass through any one or more of these components, and/or lower-pressure drop versions thereof without deviating from the scope of the present invention.

Unload Controller

As shown in FIG. 6*a*, an unload controller 694 may operatively connect to the various components involved in unloading (e.g., the compressor 113, 613, heater 653, 153, 152, valve 672, pressure/temperature regulator 136, 684, fuel composition control 138, temperature sensor(s) 682, 689, pressure sensor(s) 686, 689, meter 134, 634, bypass valve 688, unloading system 132, storage vessels 122, 142, 143). According to various embodiments, the unload controller 694 automatically carries out one or more of the unloading activities discussed herein, for example:

- carrying out one or more of the functions of the controller 690;
- carrying out one or more of the functions of the interlock system 400*e* (e.g., emergency shut-down, locking of the brakes, closing all trailer valves, and/or providing warnings or corrective actions when various measured values deviate from preferred or acceptable ranges, etc.);
- opening and/or closing the user site 130 inlet valve;
- draining a volume of gas in the hose(s) extending between the system 120, unloading system 132, and/or the user site 130;
- visually or audibly alerting the operator that hose(s) is safe for connection and/or disconnection;
- visually or audibly instructing the operator to connect or disconnect the supply hose(s) of the system 120 to or from the supply line 630 of the user site 130;
- upon all safety checks passing without issue, opening all system 120 valves needed to initiate unloading;
- upon all safety checks passing without issue and previous trailer pressure meets criteria, opening applicable user site 130 inlet valve to the user site supply line 630;
- continuously polling sensors and/or safety detector(s) to ensure that unloading is proceeding appropriately, and taking appropriate action in case of deviation or error;
- carrying out pre-disconnect routine(s) after unloading is complete;
- close all trailer valves after unloading is complete;
- upon all safety and procedural checks passing without issue, opening hose drain gas solenoid to facilitate disconnection of hose(s) connection the system 120 to the user site 130;
- visually and/or audibly alerting the operator that hoses connecting the system 120 to the user site 130 are safe for disconnection;
- providing a display to the operator for review of the status of the unload parameters and activities (e.g., gauges or other indicators of pressure, temperature, and/or instantaneous flow at various points in the system, cumulative mass transfer to the user 130));
- opening/closing the valves 672, 688, 1610, 1620; and/or
- operating and/or adjusting the operation of the operation of: the pressure regulation system 684, 136, the heater(s) 152, 153, 653, the compressor 113, 613, the fuel composition control 138.

The controller 694 may carry out any one or more of these activities in response to any of the inputs described herein, for example:

- sensed temperature, pressure, and/or flow rates (e.g., as sensed by the sensors 682, 686, 689, 634, 134) at any point in the system (e.g., in the vessel(s) 122, 142, 143 or input into the user's supply line 630);
- operator activation of a button or other switch/indicator indication that the gas connection between the system 120 and user site 130 has been made or disconnected;
- activation of an operator-activated emergency shut-off;
- a user desired flow rate, pressure, temperature, etc. (e.g., as input by the operator into the controller 694, or determined automatically by the controller 694 based on an automatic identification by the controller 694 of the connected user 130); and/or
- gas mass or volume transferred to the user 130 (e.g., as measured by the meter 134, 634).

The controller 694 may automatically initiate unloading upon sensing that the mobile transport system 120 is properly connected to the user site 130 (e.g., that the gas lines are properly connected and/or that the static discharge connection has been made).

According to various embodiments, the controller 694 may drive the unloading process differently for different users 130. For example, if the system 120 is merely complimenting a user 130's usual load (e.g., a facility 130 that can accept as much flow as the system 120 can provide), the controller 694 may unload as fast as possible. In such a scenario, the temperature control may be the limiting factor in providing as much flow as possible. Conversely, if the user's gas usage is slower than the system 120's ability to provide gas, the pressure of the delivered gas may be the controlling factor used by the controller 694 during the unload cycle. Alternatively, the user 130 may define the desired flow rate, and the controller 694 may adjust the unload cycle to optimize the unloading for the desired flow rate.

The controller 694 may be incorporated into the user site 130, the mobile transport system 120, a combination of the user site 130 and system 120 (some components in each), or a stand-alone unit that is discrete from both the user site 130 and the system 120.

The controller 694 (as well as any other controller discussed herein) may be implemented in any suitable manner and may itself comprise one or more controllers that include one or more processing devices (e.g., a digital processor, an analog processor, a digital circuit designed to process information, an analog circuit designed to process information, a state machine, and/or other mechanisms for electronically processing information). The one or more processing devices may include one or more devices executing some or all of the unload operations/activities described herein in response to instructions stored electronically on an electronic storage medium. In some embodiments, the one or more controllers 694 and/or the one or more processing devices may control one or more components of system 100 based on output signals from one or more sensors that are part of system 100. The one or more processing devices may include one or more devices configured through hardware, firmware, and/or software to be specifically designed for execution of one or more of the unload operations/activities.

Daughter Station 130*c*

In various embodiments, the unload system/station can be used as a "daughter station" 130*c* for filling "daughter" mobile storage systems 160*a-c* (see FIG. 1*a*), e.g., CNG vehicles. In the daughter station 130*c*, the unloading system can include a secondary compressor to transfer gaseous fuel from a mobile storage system (e.g., 120), such as a CNG trailer, to the "daughter" mobile storage system 160, e.g., a CNG vehicle. When the CNG trailer 120 is at a substantially higher pressure than the vehicle 160, gaseous fuel can flow from the trailer 120 to the vehicle 160 without a compressor. In other words, if the CNG trailer/mobile transport system 120 is sufficiently large and/or at a sufficiently high pressure, a secondary compressor is omitted according to various embodiments.

These systems are known as cascade systems as the gaseous fuel can be transferred to successively lower pressure vessels. However, if the vessels 122, 142 of the system 120 become sufficiently depleted, the pressure may approach or drop below the target pressure of the CNG vehicle. In this case, as shown in FIG. 8*a*, the "daughter compressor" 113 may be used to pump the gaseous fuel from the system 120 to the CNG vehicle 160*a* or one or more intermediate vessels 143.

Figure 8A:
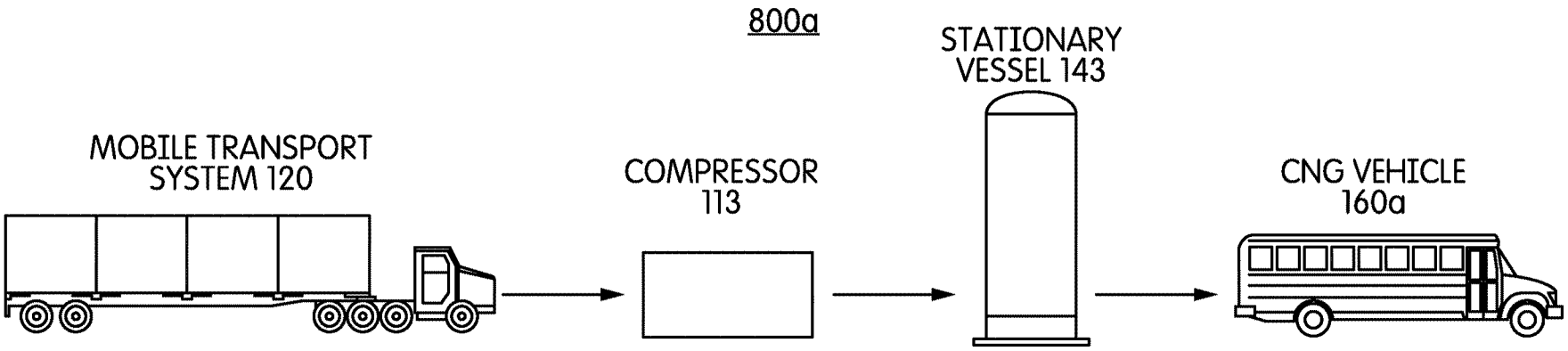
FIG. 8*a* is a schematic showing an exemplary daughter filling station in accordance with various embodiments of the present teachings.

As shown in FIG. 8*a*, such a daughter compressor 113 can be combined with one or more stationary storage vessels 143. Provided that the stationary storage vessel 143 is of sufficient size and sufficiently high in pressure, the CNG vehicles 160*a-c* can be fueled directly from such a vessel 143 without any further compression, i.e. in a cascade configuration. Furthermore, such storage 143 may be kept at substantially higher pressures than the target pressure of the CNG vehicle 160*a-c* so that CNG vehicles 160*a-c* may be fueled relatively quickly as the large pressure difference will drive substantial flows from the storage vessel 143 to the CNG vehicle. A second advantage of the secondary vessel(s) 143 is that the daughter compressor 113 may be sized for the average dispensing load over time rather than the instantaneous filling rate necessary for a short filling time. The instantaneous filling rate may be the rate for a single vehicle 160, or may be the rate expected for a plurality of vehicles 160. For gas-station-style daughter stations 130*c* designed to fill private individuals' vehicles 160 and/or commercial vehicles 160, the daughter station 130*c* may experience two peak usage times: one in the morning and one in the afternoon. According to various embodiments, by averaging out compression over course of the variation cycle (e.g., day, week, etc.) into the daughter station 130*c* storage vessel(s) 143 and by appropriately sizing the vessel(s) 143, smaller compressor 113 can be used.

The daughter compressor 113 may run largely continuously to keep the stationary vessel 143 at peak pressure. Smaller compressors 143 are typically less expensive, and in some cases, the money saved on compression equipment will be more than the cost of the secondary storage. In addition, operating smaller compressors 143 may directly translate into an operating expense advantage and/or allow multiple small units to be used with redundancy.

If the compressor 113 had to keep up with the filling load during such peak filling times, a much larger compressor (e.g., 300 hp or more, which may cost $250,000 to $750,000 or more for a conventional cascade compressor) may be needed. However, through use of the vessel(s) 143 and a smaller, continuously running compressor 113, the compressor 113 may be smaller (e.g., a 30 hp compressor that costs less than $100,000, or even less than $50,000).

The daughter station 130*c* may also compensate for peak demand by providing a fresh, full mobile transport system 120 to the daughter station 130*c* at the peak times to further satisfy the peak load. The fresh system 120 provides more gas supply to the station 130*c* and more pressure, thereby reducing the rate required from other parts of the station 130*c* such as the compressor 113.

The compressor 113 may also be less expensive because, as explained below, according to various embodiments, the piggyback tandem compressor only compresses between adjacent pressure levels in the cascade system. As a result, according to one or more embodiments, the compressor 113 does not experience they type of high pressure differential that might necessitate a more expensive compressor.

According to various embodiments, the daughter compressor 113 may comprise a compressor similar to or identical to any of the compressors described in U.S. application Ser. No. 13/782,845, filed Mar. 1, 2013, titled "COMPRESSOR WITH LIQUID INJECTION COOLING," the entire contents of which are hereby incorporated by reference.

The daughter station 130*c* storage tank 143 may be heated to allow or enhance direct discharge into a vehicle 160*a-c* (to compensate for the J-T effect) or utilize a heat exchanger 153 to absorb heat from the environment or another heat source.

In various embodiments, in addition to storage, the cost of the daughter compressor 113 may be further reduced by utilizing a cascade filling approach with a system known as a piggyback tandem compressor 113. In the piggyback tandem compressor, a double acting piston is used. On one side of the piston flows are arranged to pump from a first vessel 143 to a second vessel 143. The opposite side of the piston flows are arranged to pump from the second vessel 143 to a third vessel 143. By maintaining the difference in pressure between the vessels 143 below a specified limit, the net rod load on the piston can be limited and hence the overall scale and cost of the compressor 113 can be limited as well, even though the chamber pressures can grow relatively high. It order to achieve higher pressures, once the third vessel 143 reaches a certain pressure, the chambers of the piston can be rearranged to pump from the second vessel 143 to the third vessel 1433 and from the third vessel 1433 to a fourth vessel 143, respectively. The switching, known as cascaded compression, can be repeated for an arbitrary number of vessels 143. In the daughter station 130*c* concept, the final vessel 143 can be a larger reservoir from which the CNG vehicles 160*a-c* are fueled. According to various embodiments, the final vessel may be at a pressure of between 2500 and 7000, between 3500 and 6000, between 4000 and 6000, between 4500 and 5500, and/or about 5000 psig. The small daughter compressor 113 can progressively fill higher and higher pressure vessels 143 until pumping to the final vessel 143, at which point it can begin the cycle again and reconfigure the flows, e.g. with a system of actuated valves, in some cases actuated with a single stem/operating mechanism, to resume pressuring the lowest pressure vessels 143 in the cascade.

In the cascade compression system of the daughter station 130*c*, the daughter station 130*c* may use numerous sequentially higher pressure vessels 143 (and/or 122, 142). According to various embodiments, the cascade compression system may comprise (a) at least 5, 10, 15, 20, 25, 30, 35, and/or 40 vessels 143, 122, 142, (b) less than 100 vessels 143, 122, 142, (c) between 5 and 100 vessels and/or between 10 and 50 vessels, and/or (d) any number of vessels 143, 122, 142 between any such numbers of vessels 143, 122, 142.

For example, in a daughter station 130*c* with 40 vessels 143, the vessels' pressures may range from 250 to 6000 psig. The use of a large number of vessels 143, 122, 142 may result in a low pressure differential between sequentially higher pressure vessels 143, 122, 142 (e.g., pressure differentials of less than 500, 250, 200, 150, 100, and/or 50 psi). A block valve manifold may connect the piggyback compressor 113 to the numerous vessels 143 to provide automated switching of the compressor 113 to compressing between different combinations of the sequentially-higher pressure vessels 143, for example using the algorithm discussed above, as implemented in an appropriate controller.

Additionally and/or alternatively, any one or more of the vessels 143 used in the cascade filling system may be replaced with one or more of the vessels 122, 142 on one or more of the mobile transport systems 120.

According to various embodiments, the arrangement of the tandem compressor 113 may use a double-acting single cylinder compressor. Alternatively, the compressor may use more cylinders arranged in a single stage. The compressor may be as simple as a single stage single throw single acting compressor. A slightly more complex embodiment uses a two throw single stage double acting compressor. The compressor motor may be sealed and include a linear motor directly actuating the piston rod. As a hermetic linear system, the unit may avoid the use of precision rod packings, crossheads, crankshaft, and/or central lubrication systems, and may, at low speeds, also avoid lubrication of the valves and piston seals. The unit may omit a transmission/coupling between the motor and compressor shaft, and the motor could be cooled by the process gas. If inlet gas is used to cool the motor and reduce the average operating temperature of the unit, the compressor may in turn be "hermetic" and thus not have any sealing/maintenance or external requirements that would greatly increase the cost and maintenance for such a unit. In addition, due to the relatively fixed and low differential pressures within the device, the durability of the piston rings could be greatly enhanced and kept at very high efficiency levels. A single casting component could also be used for the motor cover, leading to a further cost reduction.

According to various embodiments, the compressor 113 has a fixed pressure differential, as opposed to a fixed compression ratio. Cascades are typically designed on pressure differential between sequential vessels, but compressors are typically designed for a particular compression ratio. For given inlet pressure, a conventional compressor will pressurize by a fixed ratio. If filling a vessel 143 with lower pressure than the outlet pressure of the compressor 113, this compression energy is wasted as the gas will partially re-expand upon leaving the outlet of the compressor 113. Because the piggyback compressor 113 according to various embodiments sees a relatively low delta P, the outlet pressure from the compressor 113 may avoid being significantly above the vessel 143 being filled. The use of a piggy-back compressor 113 may therefore result in more efficient cascade compression than if a conventional, fixed compression ratio compressor were used. However, according to various alternative embodiments, a conventional fixed compression ratio compressor could be used.

In some embodiments, it may be advantageous to mount the daughter compressor 113 and associated CNG filling system on the CNG trailer 120 itself. For example, fueling mining, construction or logging equipment may be done in the field so that the work vehicles may remain at the work site to be refueled. In such cases, the daughter compressor can be configured to utilize the multiple vessels (e.g., 122, 142) on the CNG trailer 120 as the cascade system.

In various situations, the low HP requirement for the driver to the compressor package may facilitate the use of alternative arrangements such as hermetic connections and systems, or the utilization of differential pressure in the trailers in the earlier part of the discharge cycle to power the pressurization of the cascade or other interim stages of the compression process. Beneath a certain horsepower size, government regulations may shift significantly to allow for a reduction of cost in the station (e.g. US EPA permitting and emissions requirements may be lower or non-existent for a unit under 25 HP).

Figure 8B:
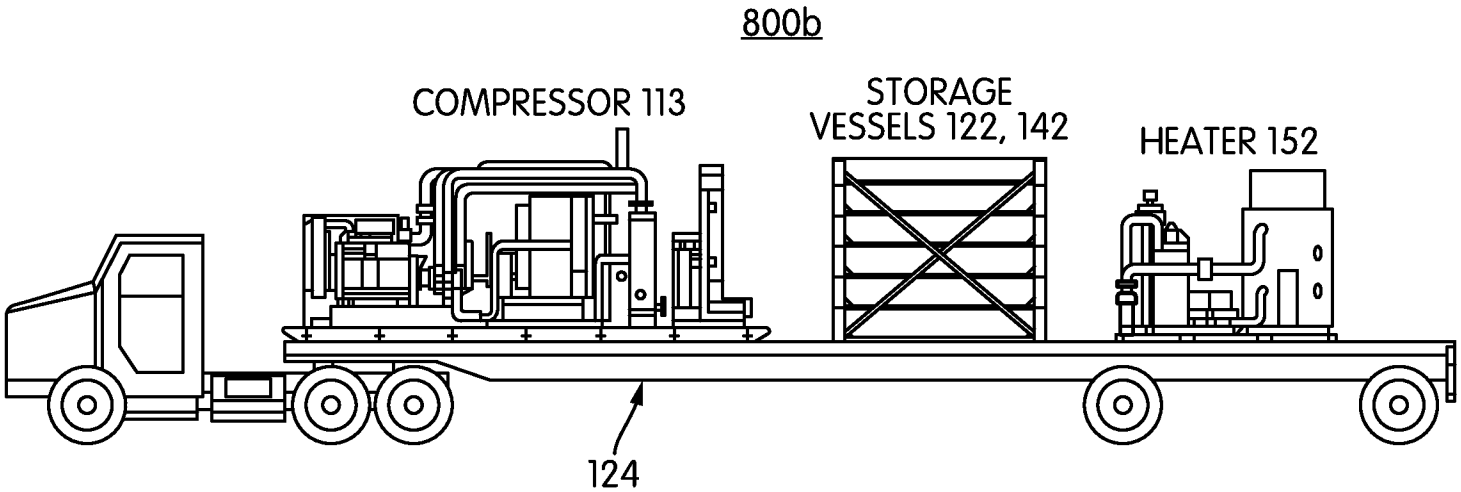
FIG. 8*b* is a schematic showing another exemplary daughter filling station in accordance with various embodiments of the present teachings.

In various embodiments, the daughter station 130*c* can include a compressor and a "refill" system to refill a "daughter" mobile storage system, e.g., CNG vehicles. Such a "refill" system may also include a high pressure stationary vessel 143 for cascade refueling. The compressor 113 can be sized substantially below the target dispensing rate. The compressor 113 can be a piggyback tandem compressor and include multiple vessels 143 at successively higher pressures. The unloading system may include, e.g., a gaseous fuel dispensing system such as a CNG dispensing system. The daughter mobile storage system may further include multiple vessels 143 in a cascade compression configuration and the compressor 113 may be a piggyback tandem compressor. For example, FIG. 8*b* is a schematic showing an exemplary mobile daughter filling station including compressor 113, trailer 124, storage vessels 122, 142, and a heater 152, 153.

Filling from Sequentially Higher Pressure Source Vessels 143

CNG vehicles 160*a-c* may be filled from a sequential plurality of progressively higher pressure source vessels 143 (or 122, 142) of the daughter station 130*c*. For example, a relatively empty (i.e., low pressure) tank of a vehicle 160*a* may be initially filled from a low pressure vessel 143 (or 122, 142) at a relatively low pressure (e.g., 3600 psig or below). When the pressure differential between the vehicle 160*a* tank and the source vessel 143 falls below a predetermined threshold (e.g., 2000, 1500, 1250, 1000, 750, 500, 400, 300, 200, 100, and/or 50 psi), the source vessel 143 is switched to a higher pressure source vessel 143 (e.g., the next highest pressure source vessel 143 of the daughter station 130*c*). As the pressure in the vehicle 160 tank rises, sequentially higher pressure vessels 143 are used to fill the tank and maintain a pressure differential that continues to drive the filling in a fast and efficient rate. The daughter station 130*c* may include an automated valve manifold that automatically connects sequentially higher pressure vessels 143 to the vehicle 160 tank at the appropriate points in the fill cycle, all of which may be transparent to the person filling the vehicle 160, who merely uses a single final hose connection to the vehicle 160.

According to various embodiments, the multi-vessel filling system may utilize a combination of stationary vessels 143 and mobile vessels 122, 142. According to various embodiments, the stationary vessels 143 are the higher pressure vessels, while the mobile vessels 122, 142 are the relatively lower pressure vessels. For example, a first portion of the vehicle 160 filling cycle may come from vessel(s) 122, 142 on the mobile transport system 120. After the first portion, the source vessel is switched to one or more of the higher pressure source vessel(s) 143 of the daughter station 130*c*. According to various embodiments, the first portion may end when the pressure differential between the vehicle 160 and source vessel(s) 122, 142 falls below a predetermined threshold, and/or when the vehicle 160 tank pressure reaches an absolute threshold (e.g., 1000, 1500, 1800, 2000 psig).

In some embodiments, the mobile storage system vessels 122, 142 are used as lower pressure vessels in the cascade, particularly if the fresh vessels 122, 142 have a relatively lower pressure (e.g., 3600 psig) than other vessels 143 in the cascade compression system. In these or other embodiments, the vessels 122, 142 may additionally and/or alternatively be used as relatively higher pressure vessels in the cascade system. CNG vessels 122, 142 approved for mobile transport typically have higher pressure capability/allowances when utilized as stationary vessels 143. For example, a vessel 122, 142 that is limited to 3600 psig during transport may be permitted to have a 5000 psig pressure when in stationary use. As a result, vessels 122, 142 may efficiently be used as relatively high pressure vessels in the cascade compression/filling system of the daughter station 130*c*.

Sequential filling may reduce the JT cooling imparted on the gas that fills the vehicle 160 tank, for example because the pressure differential at any given time between the source vessel 143 and vehicle tank 160 is kept lower than that pressure differential that would exist if the empty vehicle 160 tank was initially connected to the highest pressure source vessel 143 (e.g., a 5000 psi vessel 143). Additionally, JT cooling is not as large at higher pressures (e.g., above 2000, 2500, 3000, 3600 psig), so there is less cooling (e.g., 20 degrees C.) than might otherwise occur when delivering gas at a much lower pressure (e.g., the <150 psig line pressure desired by various other user sites 130). Additionally and/or alternatively, such sequential filling may more efficiently use the compression energy available by allowing the mobile system 120 to first supply gas to a vehicle 160 and then if no vehicle 160 is present, supply gas to the daughter station 130*c* compressor 113 to load the daughter station 130*c* cascade vessels 143.

Transportation Cycle of a Mobile Compressed Gaseous Fuel Module

Figure 9:
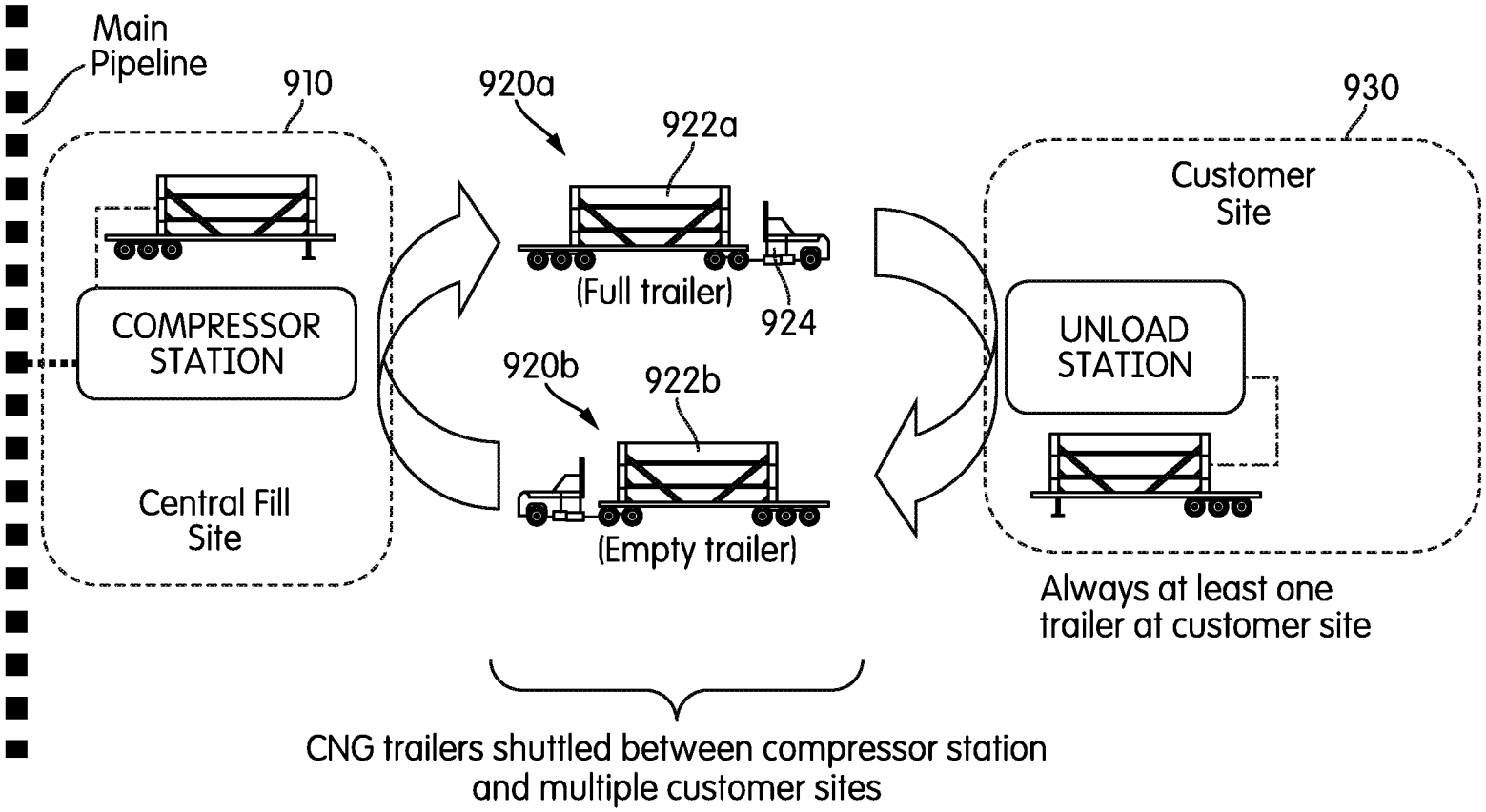
FIG. 9 is a schematic showing an exemplary method of supplying gaseous fuel to an end user in accordance with various embodiments of the present teachings.
Figure 10:
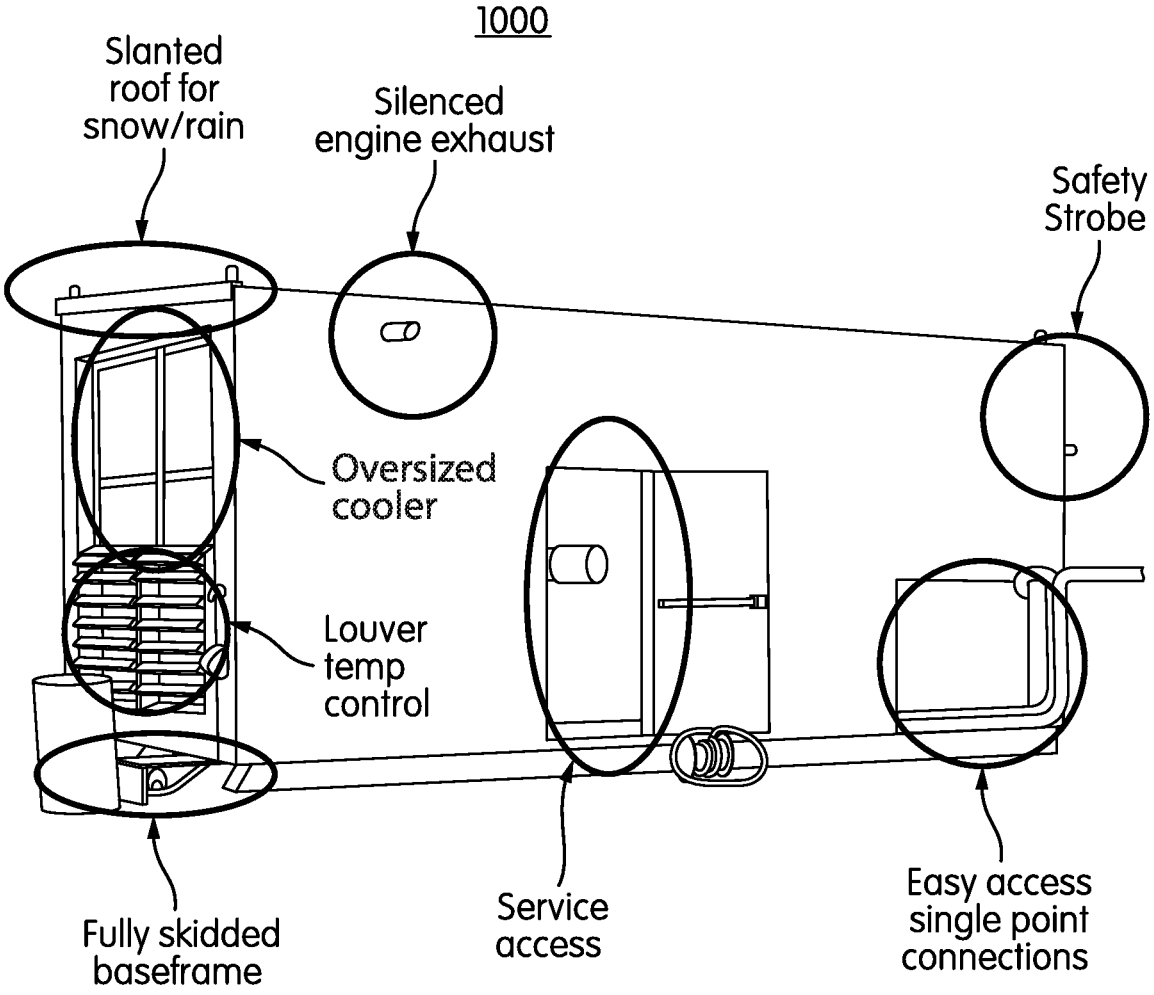
FIG. 10 is a schematic showing an exemplary compressor package in accordance with various embodiments of the present teachings.

FIG. 9 is a schematic showing a method of supplying gaseous fuel (e.g., natural gas) to an end user. In this method, a mobile compressed gaseous fuel module 920*a* can be delivered to a site 930 of a user's gaseous fuel supply line. The mobile compressed gaseous fuel module 920*a* can include, e.g., a wheeled frame (a road-legal trailer with a hitch that is adapted to be connected to a hitch of a tractor-trailer) with gaseous fuel storage vessels 922, 122, 142 stored thereon, adapted to be propelled along a road by a vehicle such as a truck 924. The mobile compressed gaseous fuel module 920*a* can be, e.g., a vessel mounted to the wheeled frame and containing compressed gaseous fuel in the vessel(s) 922. The vessel 922 of mobile compressed gaseous fuel module 920*a* can be, e.g., fluidly connected to the user's gaseous fuel supply line so as to supply the compressed gaseous fuel to the user. The module 920*a*, 920*b* can then be kept at the user site 930 until the user has consumed (i.e., burned (e.g., in a boiler, generator, gas-fueled equipment, etc.), as opposed to stored) at least 30%, 40%, 50%, 60%, 70%, 80%, 90%, and or 95% of the compressed gaseous fuel in the vessels 922 of the module 920*a*. The empty module 920*b* can then be fluidly disconnected from the user's gaseous fuel supply line and removed from the site 930 and transported back to the central fill site/mother station 910 by the truck 924 for reloading. In various embodiments, the compressed gaseous fuel can be supplied to the user's gaseous fuel supply line at a desired pressure, while upon delivery of the module 922 to the site, a compressed gaseous fuel pressure within the vessel 922 can be, e.g., maximized at an allowable pressure, and/or contain at least 200 MSCF (thousand standard cubic feet, which is a measure of mass) or at least 400 MSCF or at least 500 MSCF of the compressed gaseous fuel.

According to various embodiments, a single truck 924 may be used to deliver a full module 922*a* from the fill site 910 to the customer site 930 and then return the empty module 922*b* from the customer site 930 to the fill site 910. In this manner, the single truck 924 can service multiple customer sites 930 by sequentially transporting full and empty modules 922*a*, 922*b* between the various customer sites 930 and the fill site 910. An empty module 922*b* may be filled at the fill site 910 while truck 924 delivers another full module 922*a* to a customer site 930. According to various embodiments, such shuffling of modules 922*a*, 922*b* can reduce the down time of expensive modules 922.

Figure 13:
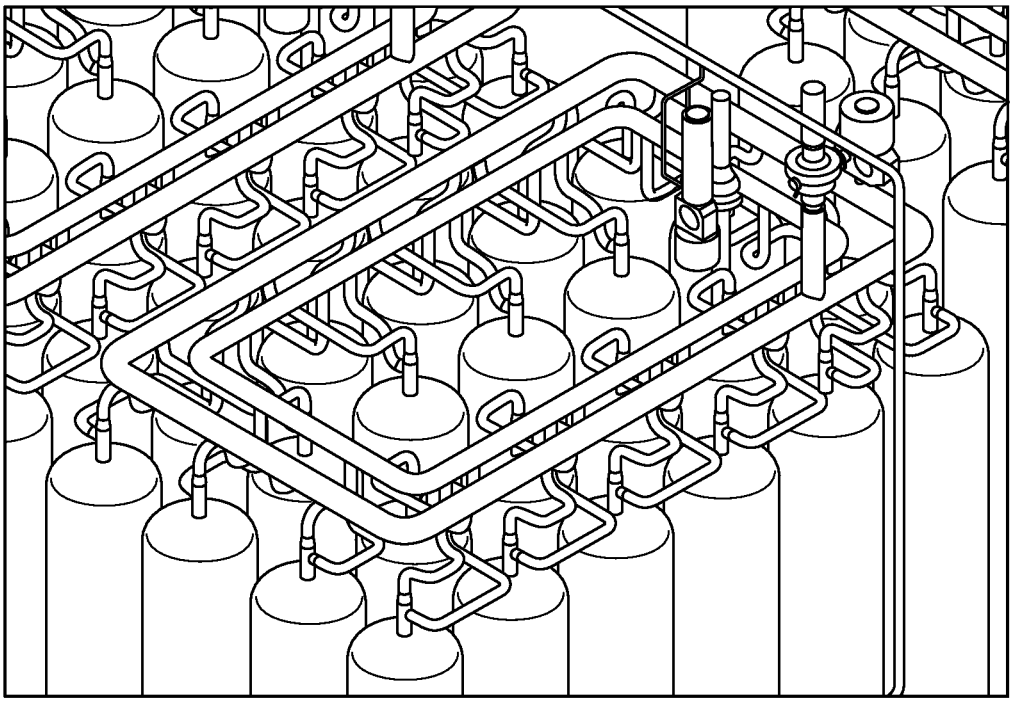
FIG. 13 is a schematic showing an exemplary CNG cargo containment system in accordance with various embodiments of the present teachings.

FIGS. 10-14 are schematics depicting, e.g., a compressor package (see FIG. 10), a loading/unloading station install (see FIG. 11); an unloading heater and control (see FIG. 12); and a CNG Cargo Containment System (see FIG. 13). Note that structures and arrangements in FIGS. 10-14 are examples only and will not be limited in any manner.

Sub Distribution Station/Intermediate Mother Station

In case of excessive distances between the source of gas and the destination of the gas, a smaller distribution station equipped for regional gas distribution may be enabled. Such a sub distribution station (also referred to herein as an intermediate mother station) could use an enlarged approach to a CNG daughter station but filling optimally sized trailers (high onboard expensive capacity for long haul, lower cost smaller capacity for short haul). Such a sub distribution station may also opportunistically utilize storage as a method of receiving excess capacity from the mother station (for example maximizing the utilization of drivers/trucking/compression at the mother station).

An intermediate mother station may provide recompression and filling of trailers for further distribution of different sized trailers and configurations from the intermediate supply trailers/mobile transport units. An intermediate mother station may include a substantial storage vessel (e.g., ANG) to optimize the utilization of expensive assets as the mother station.

Reverse Cascade Unloading of Mobile Transport Systems to Stationary Storage Vessels at User Sites According to various embodiments, it is desirable to reduce the quantity of mobile transport systems 120 that are used to meet a given user demand (e.g., at one or multiple user sites 130) because the mobile transport systems 120 typically represent a large, if not the largest, capital expenditure (CapEx) within various example virtual pipeline systems 100. According to one or more embodiments, a reverse cascade unloading scheme is used to enable fewer mobile transport systems 120 to service a higher user demand by more fully unloading the mobile transport system 120.

According to various embodiments, such nearly complete unloading occurs even if an unload compressor 113 is not used. In various situations, a compression system 113 or other powered means to transfer gas from the mobile transport system 120 to the stationary vessels 143 would be overly expensive or create weight or other logistical issues. Accordingly, various embodiments omit an unloading compressor 113. Instead, the reverse cascade operation may utilize the positive differential pressure and volumetric ratio between vessels 122, 142 and the vessels 143 to achieve complete or nearly complete filling of receiving vessel(s) 143 without an external power source or compressor 113. The vessels 143 may represent a larger control volume than receiving vessels 122, 142, achieving a volumetric ratio greater than one (1) favoring the mobile storage unit.

Figure 16:
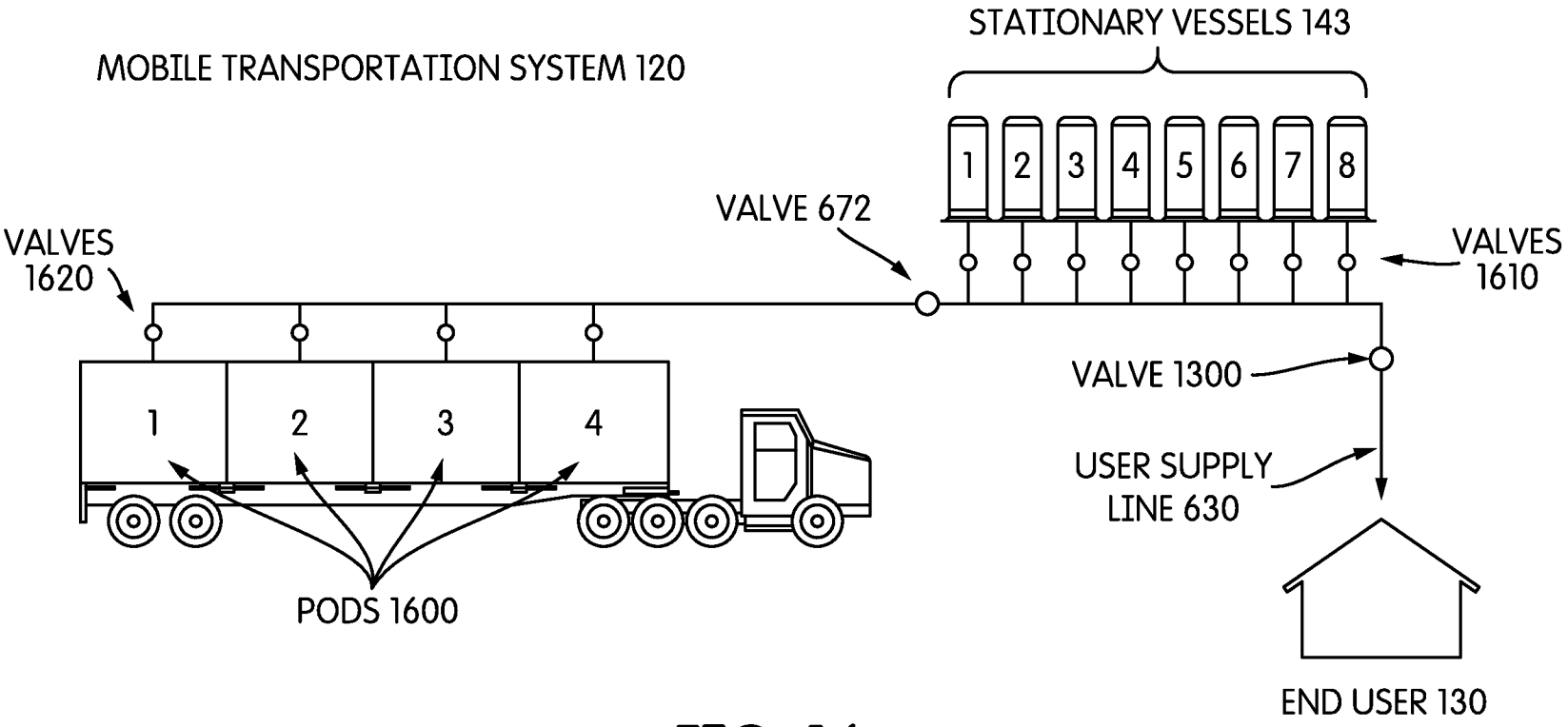
FIG. 16 schematically illustrates a reverse cascade unloading method according to one or more embodiments of the present teachings.

As shown in FIGS. 16 and 17, gas is discretely unloaded from multiple separate pods 1600 of one or more vessel(s) 122, 142 of the mobile transport system 120 into multiple discrete stationary storage vessels 143 at the user site 130. The vessels 143 may be mounted on a common skid. Gas is unloaded to the vessels 143 regardless of on-site vessel 143 pressure levels. The stationary storage vessels 143 may have any maximum allowable pressure rating but may be filled only to at or below the maximum allowable pressure rating of the mobile storage vessels 122, 142.

As shown in FIG. 16, each vessel 143 has a dedicated inlet valve 1610. During unloading of such stationary storage vessels 143 to the end user (e.g., the user's supply line 630), all vessel 143 valves are open, and as such all vessels 143 are at the same pressure. The pressure in the vessels 143 prior to refilling from the mobile transport system 120 may be relatively low (e.g., less than 500, 400, 300, 200, 150, and/or 100 psig).

However, when the mobile storage system 120 is unloaded into the vessels 143, the vessels' valves 1610 are separately opened or closed so as to selectively be separately filled from separate ones of the pods 1600, which likewise have discrete valves 1620. Each pod 1600 may comprise a single vessel 122, 142 or a group of parallel vessels 122, 142.

Figures 17A, 17B:
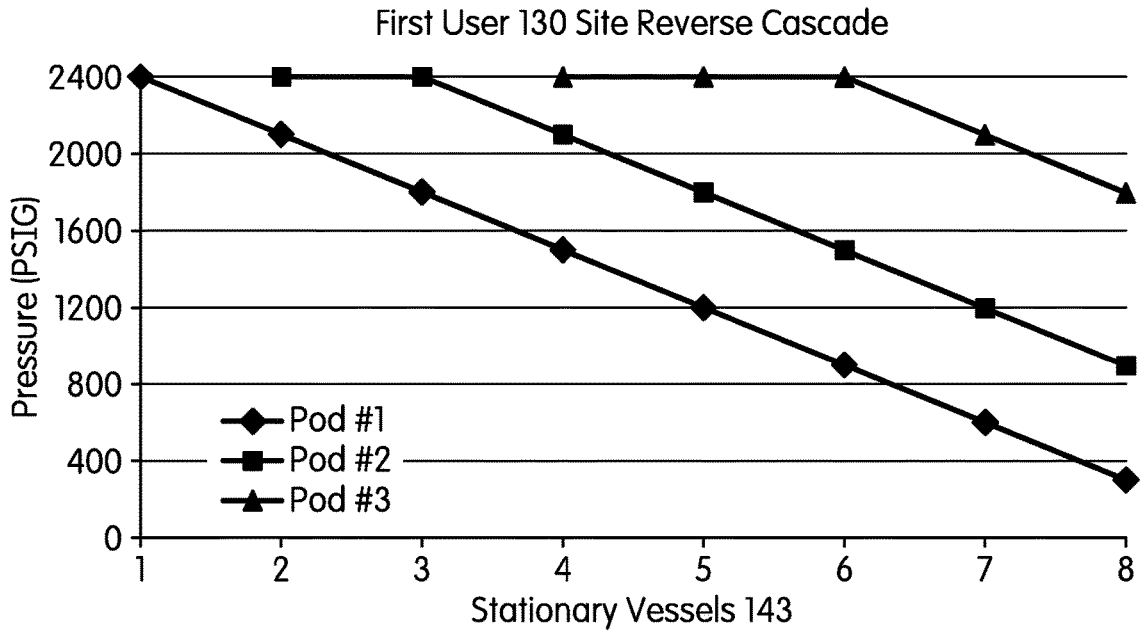
FIGS. 17*a-d* illustrate an embodiment of the reverse cascade unloading method of FIG. 16.

As illustrated in FIGS. 17*a-b*, at each discrete step, the valves 1610, 1620 are controlled so that a pod 1600 is connected to a discrete vessel 143 until the pressure equalizes therebetween or the vessel 143 reaches its rated or desired pressure (e.g., 2,400 psig). Unloading from the system 120 to the vessels 143 then progresses to the next step. As shown in FIGS. 17*a* and *b*, a first pod 1600 is used to fill sequential vessels 143 until depleted (e.g., pod 1600 pressure below a predetermined threshold (e.g., 1000, 800, 600, 500, 400, 300, 200, 100 psig) or at a pressure at or below the pressure of all receiving vessels 143. As shown in FIG. 17*b*, the first pod 1600 may fill the first vessel 143 to its rated/design pressure (e.g., 2,400 psig), and fill sequential second through eighth vessels 143 to a progressively lower pressure as the first pod 1600 is depleted. Thereafter, the next pod 1600 is unloaded in the same manner. In the illustrated embodiment, the $9^{th}$ cascade step completes the filling of the second vessel 143 from the second pod 1600. The sixteenth through nineteenth steps fill the third through sixth vessels 143 to their rated/desired pressure or mass. Although not shown, the fourth pod 1600 may then be used in the same manner to top off the seventh and eighth vessels 143 to their rated/desired capacity.

In the embodiment illustrated in FIG. 16, only one filling step (e.g., flow path from one pod 1600 to one vessel 143) occurs at a time. However, according to various alternative embodiments, the reverse cascade unloading process may be sped up by simultaneously engaging in multiple filling steps. For example, by providing additional sets of supply lines 630, valves 1620, valves 1610, and associated pipes (e.g., duplicate, parallel sets of the connections and lines shown in FIG. 16 between the pods 1600 and vessels 143), one of the pods 1600 (e.g., pod 1) may unload gaseous fuel into one vessel 143 (e.g., vessel 3), while a second pod 1600 (e.g., pod 2) independently unloads gaseous fuel into a second one of the vessels 143 (e.g., vessel 2). Further sets of duplicate, parallel connections, or manifolds that enable multiple discrete flow paths between multiple discrete combinations of pods 1600 and vessels 143 may be used to facilitate 2, 3, or more simultaneous unloading steps. Using the step numbers shown in FIG. 17*a*, steps 3 and 9 may occur simultaneously. Similarly, all of the steps disposed along any upwardly and rightwardly extending diagonal in the table in FIG. 17*a* may occur simultaneously. For example, steps 16, 11, and 5 may occur simultaneously. According to other embodiments, as illustrated in FIG. 17*a*, any step positioned below and at least one column to the left of a given step may occur simultaneously with that given step (e.g., steps 16, 13, and 8 may occur simultaneously).

Figures 17C, 17D:
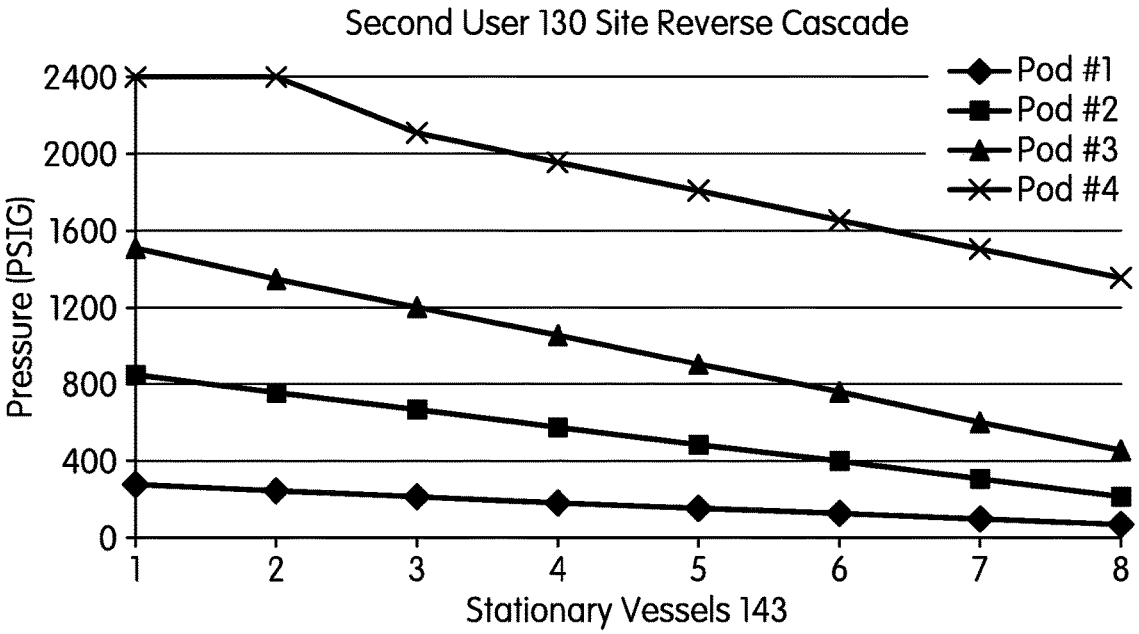

As shown in FIGS. 17*c-d*, the same mobile transport system 120 can then move onto a second user site 130 and use the same reverse cascade system to fill vessels 143 at the second user site 130. As shown in FIG. 17*d*, this reverse cascade unloading process results in the pods 1600 being substantially emptied (e.g., to about 100, 200, 500, and 1400 psig, respectively) before returning to the mother station 110 for loading.

During the reverse cascade unloading from the pods 1600 to the vessels 143, the valves 1610, 1620 may be controlled in any suitable manner (e.g., manual valves 1610, 1620 with human interaction, actuated valves 1610, 1620 operated by a programmable logic controller (e.g., the unload controller 694), and/or actuated valves with an electro-pneumatic or electro-hydraulic valve control mechanism). The controller (e.g., controller 694) may sense the pressure, temperature, and/or flow rate out of the pods 1600 via suitable sensors so as to determine when to switch to the next loading step. The controller may be programmed to carry out the unloading algorithm shown in FIGS. 17*a-d*. According to various embodiments, the controller may stop a step and move to the next unloading step in response to a predetermined condition. According to various embodiments, the predetermined condition may be one or more of a predetermined amount of time after beginning the step, the sensed mass or volumetric flow rate from the source pod 1600 to the vessel 143 falling below a threshold rate, and/or the pressure differential between the pod 1600 and vessel 143 falling below a predetermined threshold. The threshold(s) chosen may be optimized to satisfy or balance chosen prioritized criteria such as minimized unloading time, maximized unloading volume/mass of gaseous fuel, etc.

In the embodiment illustrated in FIG. 16, a user site main valve 1630 is turned off and a mobile transport system valve 672 is turned on in order to facilitate loading of gas from the mobile transport system 120 to the vessels 143. The valve 672 is then turned off and the valves 1610, 1630 turned on to restart the supply of gas from the vessels 143 to the supply line 630 of the user 130. In such an embodiment, the user site 130 may include a further back-up vessel 143 (not shown) downstream from the valve 1630 to provide gas to the user 130 during unloading. Alternatively, the valves 1610 of the vessels 143 may be multi-way valves that selectively connect the vessel 143 to (a) the mobile transport system 120 for loading, (b) the user supply line 630 for use by the user, and/or (c) an OFF state to prevent flow between a high-pressure vessel 143 and a lower pressure vessel 143. At any given point during the reverse cascade unloading process, one or more vessels 143 may be connected to the user's supply line 630 to ensure continuous supply of gas to the user site 130.

The numbers of pods 1600 and vessels 143 illustrated is for example only. The mobile transport system 120 may include greater or fewer pods 1600 without deviating from the scope of the present invention. Similarly, the user site 130 may include greater or fewer vessels 143 without deviating from the scope of the present invention. Similarly, the pressures illustrated in FIG. 17 are illustrative only, and are non-limiting.

According to various embodiments, the use of a reverse cascade system may:

- eliminate the compressor 113, thereby reducing CAPEX and OPEX;
- eliminate the compressor 113, thereby increasing a weight of other components (e.g., gas) that can be carried on the mobile transport system 120 without exceeding a predetermined maximum weight (e.g., a weight limit of the trailer 124 and/or regulatory weight limits imposed on road-based vehicles/trailers);
- reduce a cost per mile transported for the gas (e.g., by improving the transport efficiency by loading more gas onto the mobile transport system 120, using vessels 122, 142 with a higher capacity/weight ratio but likely a higher cost/capacity) while, according to various embodiments, reducing the costs required on the receiving vessel 143 (as a stationary vessel 143 weight is typically less of an important factor, such that cost/capacity is instead typically a primary focus for stationary vessels 143);

facilitate more complete depletion of the mobile transport system 120 (e.g., pods 1600, vessels 122, 142); and/or reduce the operating pressure of the vessels 143, which may reduce a cost per unit of capacity in the vessels 143.

Although the above-discussed reverse cascade system is described with respect to unloading gaseous fuel from a multi-pod mobile transport system 120 to a plurality of stationary user vessels 143, such a reverse cascade system may alternatively be used to unload/load gaseous fuel (or other gaseous fluids) from any set of source vessels (e.g., pods 1600) to any set of one or more destination vessels (e.g., 143). For example, a reverse cascade may be used to load gaseous fuel from a plurality of mother station vessels/pods 141 to one or more mobile transport systems 120 (or discrete vessels 122, 142 or sets of vessels 122, 142 that form a part of a mobile transport system 120).

Distribution Methods for Delivering Compressed Gas to Multiple User Sites

Figure 19:
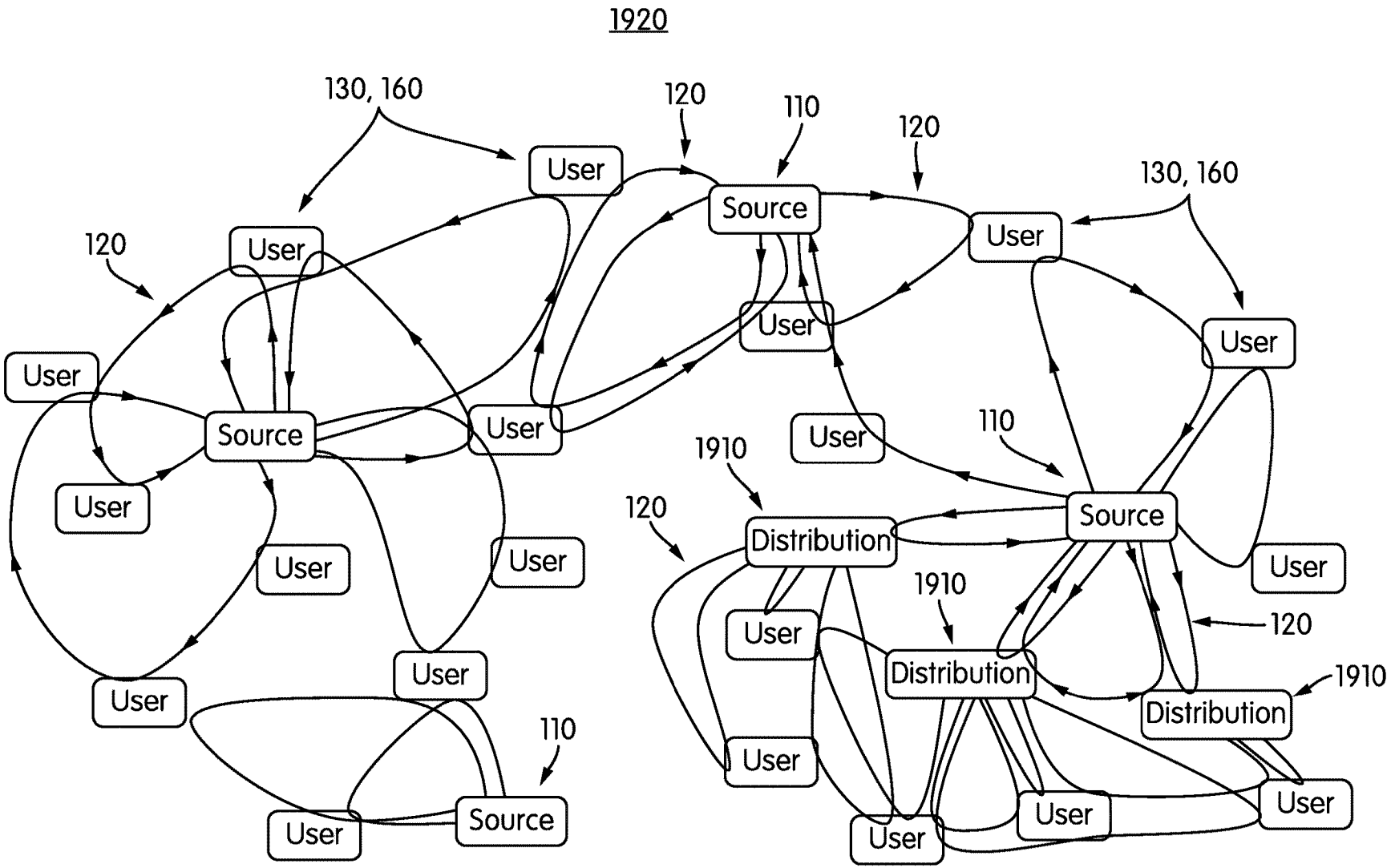
FIGS. 19 and 20*a-b* schematically illustrate various methods for using a virtual pipeline to distribute compressed gas from mother site(s) to user(s).

As illustrated in FIG. 19, improving the efficiency and speed of delivery of gas from one or more mother sites 110 (or sources) to multiple users 130 using mobile transport systems 120 in a distribution network 1920 can improve various business objectives of the virtual pipeline business (e.g., a temporary or permanent reduction in working capital (e.g., number of mobile transport systems 120), increased supply/delivery efficiency, and higher customer satisfaction). The ability to increase asset turns may be a differentiator that facilitates success according to various embodiments.

Managing changing demand within the network 1920 (e.g., at user sites 130, 160) and changing supply at different mother sites 110, 1910 within the network 1920 can be part of a business method according to various embodiments. A diverse combination of mother sites 110, 1910, mobile transport systems 120, and user sites 130 at different locations can also be considered. Various sites 110, 130, 1910 may be static or time-variable (e.g., mobile ship- or rail-based mother site 110, CNG vehicle user 160, vehicle-mounted daughter station 130*c*). The various users 130, 160 may have predictable and/or unpredictable changes in demand. Similarly, the mother sites 110, 1910 may have predictable and/or unpredictable changes in supply. The challenge can be even greater when the locations are situated in different radius.

In this multi-site variable demand and supply network 1920, a distribution model could include using one mobile transport system 120 in a single distribution run from source 110 to user 130 and back (e.g., as shown in FIG. 9). As the users 130, 160 vary in number, location and demand, the distribution model can evolve, as shown, for example, in FIGS. 19 and 20.

The model/method may involve a central distribution point (e.g., a mother site 110) distributing to one or more users 130, 160 in a single distribution trip. The distribution trip by the mobile transport systems 120 may be managed based on demand, geography and/or distributor capacity.

The number of user 130, 160 points a single mobile transport system 120 can supply within the network 1920 may be a function of the demand (e.g., in terms of gas mass/volume, depletion rate, etc.) of each user 130, 160, the capacity of the system 120, and/or the geographical locations and distances between the source 110 and users 130, 160.

Figure 20B:
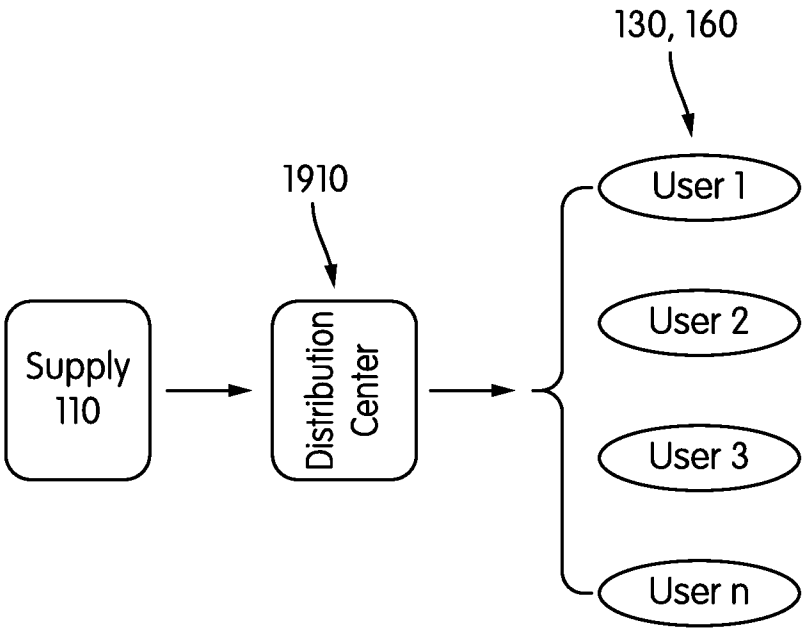
Figure 20A:
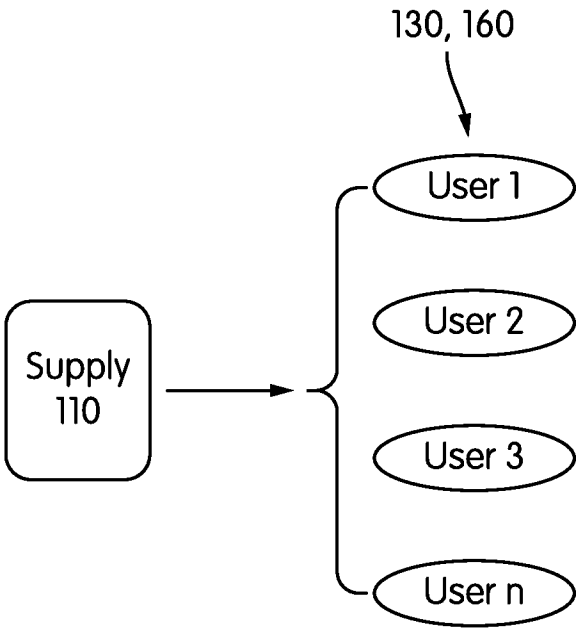

As shown in FIGS. 19 and 20, distribution within the network 1920 may be daisy-chained from a mother site 110 to multiple intermediate distribution sites 1910 (e.g., sites with storage vessels 122, 142, 141, 143 that can be loaded from mobile transport systems 120 and load mobile transport systems 120 for further distribution). Although not illustrated, the network 1920 may be further daisy chained from the intermediate distribution sites 1910 to further intermediate distribution sites 1910.

The distribution within the network may also comprise a combination of direct mother/user distribution and stepwise mother/distribution-site/user distribution.

Various users 130, 160 may be served by a combination of mobile transport systems 120 that receive compressed gas from multiple mother sites 110, 1910.

Any of the mother, intermediate, or user sites 110, 1910, 130, 160 may be temporary or mobile sites. The intermediate distribution site 1910, for example, may be vehicle, trailer, or rail-based and move based on mother 110 supply and user 130, 160 demand to be more efficiently positioned between the supply and demand. Intermediate distribution sites 1910 may be positioned at user sites 130, 160 if the user sites 130, 160 provide a useful distribution point to further user sites 130, 160.

Systems 120 with different capacities may be used at different or overlapping positions within the network 1920. For example, a larger capacity mobile transport system 120 may fill an intermediate distribution site 1910, while a lower capacity mobile transport system 120 may fill users 130, 160 with smaller gas demands.

Using dynamic distribution within the network 1920, distribution trips may respond to demand and logistics, and may incorporate variations in logistics—in particular from different sources 110, 1910 and/or different users 130, 160.

As shown in FIG. 19, a first mobile transport systems 120 may transport gas between different combinations of sources 110, 1910 and users 130, 160 at different times. For example, a mobile transport system 120 may service first and second users 130, 160 in one run/distribution trip from the source 110, 1910, and then service third and fourth users 130, 160 in the next run and/or to the first and third users 130, 160, and/or to any combination of different users 130, 160. Second through Nth mobile transport systems 120 may also service the first through fourth (or Nth) users 130, 160.

Mobile transport systems 120 may distribute to a combination of user(s) 130, 160 and intermediate distribution source(s) 1910 in a single run.

Mobile transport system 120 may unload to multiple users 130, 160 before returning to the source 110, 1910 for loading. For example, using the reverse cascade method discussed above and shown in FIGS. 17*b-e*, the system 120 may sequentially unload to a first user 130 (see FIGS. 17*b-c*) and then to a second user 130 (see FIGS. 17*c-d*) before returning to the source/mother site 110, 1910 when the system 120 is sufficiently depleted. As shown in FIG. 19, depending on the demand at each user 130, a mobile transport system 120 may unload to at least 2, 3, 4, 5, and/or 6 or more users 130 before returning to the source 110, 1910 for reloading. The above discussed reverse cascade method may be used to enable many or all of the 2, 3, 4, 5, 6 or more users 130, 160 serviced during a single system 120 trip to be filled or topped off to a relatively high pressure/mass despite partial depletion of the system 120 at earlier user sites 130, 160 in the run.

Appropriate algorithms can be used in the network 1920 to improve the efficiency of the distribution to improve desired parameters. The coordination and distribution parameters of the overall distribution network 1920 may depend on a variety of variables: demand, supply, location and stages, timing, safety margins, and/or other variables, each of with may be different for different ones of the sources 110, 1910 and/or users 130, 160. Real time usage and available supply at the sites 110, 1910, 130, 160 may be accounted for to optimize or improve the operation of the distribution network 1920 in real time. Additionally and/or alternatively, the distribution algorithm may rely on historical records, short-term weather forecasts, long term weather forecasts, etc. to estimate/extrapolate the expected supply and demand at different sites 110, 130, 160, 1910.

Tilting Structure for ISO Containers and/or CNG Containers

In mobile transport, vehicle/trailer/mobile compressed gaseous fuel module configurations may not be optimized for footprint and are typically arranged on a horizontal axis. However, the footprint (e.g., available square footage/real estate) may be limited in retail/end user sites 130. To overcome this, a tilting mechanism may use ISO corners or other connection points to secure the containers, and can reduce the footprint by 80% or more by shifting the orientation of the vessels 122, 141, 142, 143 and/or associated containers 730 from horizontal to vertical. This may have particularly high value in distribution locations that are limited in space due to not being originally planned for delivered gas (e.g. a mobile compressed gaseous fuel module). The mobile compressed gaseous fuel modules, in turn, may be constructed so that the flammable gas releases and connections stay in the vertical portion, leading to the near-ground locations to be unclassified.

Conventional tilt-up trailers have been designed to reduce footprint when stored at tight worksites. They have been marketed as sand haulers for frac site sand storage. Such trailer-tilting systems may be used in connection with the mobile transport system 120 according to various embodiments of the present invention. For example, As shown in FIGS. 5*i*-*k*, a mobile transport system 520 (which is otherwise similar or identical to the previously discussed systems 120) includes a trailer 510 that is pivotally connected to the container 730 that houses the vessels 122, 142. A tilt mechanism 530 (e.g., hydraulic cylinder(s) extends between the trailer 510 and container 730 to tilt the system 520 from its usual horizontal orientation to a position balanced vertically on its back end 730*a*. FIG. 5*i* shows the initial horizontal position. As shown in FIG. 5*j*, to move into the vertical position, the tilt mechanism 510 is actuated while the trailer 510 is attached to a tractor 540 until the container 730 is vertical with its back end/base 730*a* resting on the ground. The trailer 510 is then detached from the tractor 540, and the tile mechanism 510 is retracted to pull the trailer 510 into a vertical position along with the container 730 and vessels 122, 142. The system 520 can be returned to its horizontal position by reversing these steps.

According to various embodiments, the footprint of the system 520 is at least 2, 2.5, 3, 3.5, and/or 4 times smaller (and/or less than 10, 8, 7, 6, and/or 5 times smaller) in the vertical position (FIG. 5*k*) than in the horizontal position (FIG. 5*i*).

In addition to or in the alternative to footprint reduction, tilting vessels 122, 142 and/or the entire mobile transport system 520 may improve heat equalization within the vessels 122, 142 during loading and/or unloading so as to reduce temperature gradients within the vessel 122, 142. For example, a vertically oriented vessel 122, 142 (i.e., with their elongated, axial directions oriented vertically) may result in greater induced mixing of different temperature gases within the vessel 122, 142. During loading, the relatively warmer end/portion of the vessel 122, 142 (e.g., near the ports 331 as shown in FIG. 3*a*) may be positioned below the relatively cooler end/portion of the vessel 122, 142 (e.g., near the ports 330 as shown in FIG. 3*a*) so as to induce gas mixing as the warmer gas tends to rise toward/past the cooler gas in the vessel 122, 142. Accordingly, the vessels 122, 142 are filled from the top such that cooled gas enters the vessels 122, 142 from the upper end of the vessel 122, 142.

According to alternative embodiments, it is desired to avoid temperature equalization during loading, such that cooled gas can be injected into the bottom or lower portion of the vessels 122, 142 through ports 330. This results in temperature stratification with the temperature being significantly higher at or near the top of the vessels 122, 142 than at or near the bottom of the vessel 122, 142 where cooled gas is being injected. Such stratification can be useful if the gas is removed from the top of the vessel 122, 142 through ports 331 and cooled via an external recycle loop and heat exchanger before being reintroduced to the input flow at the bottom through ports 330, as discussed above. This stratification allows the external heat exchanger to be smaller, more effective and less expensive as a result of the larger temperature gradients experienced within the heat exchanger or refrigeration unit 152.

Similarly, vertically orienting the vessels 122, 142 during unloading may facilitate improved distribution of heat added by the unload heater(s) 152, 153. According to various embodiments, heat is added exclusively or predominantly to the bottom end of the vertically upright vessel 122, 142, which may easier or cheaper to do. Vertical mixing of the gas within the vessels 122, 142 tends to equalize the temperature or reduce the temperature gradient present in the vessel 122, 142.

Although discussed in connection with a trailer-based mobile transport system 520, vessels 122, 142 may similarly be vertically oriented in connection with a ship or barge based mobile transport system 120. In such alternative embodiments, the vessels 122, 142 may be permanently vertically mounted to the ship or barge.

Modular CNG Station Construction

Another cost for CNG station construction involves permitting and complying with regulatory requirements. By following a modular/standardized approach to capacity adjustment/increases, the virtual pipeline designs could be validated at the state and federal level in order to fast-track any local approvals for construction and permitting. In addition, while a station's permits are being finalized, a temporary operation could be set up to encourage the adoption of demand, for example by having all the equipment to be trailer mounted and set up on private contracts for fueling. By keeping power level low, the units could be engine powered and kept outside of the EPA permitting requirements, further allowing for an inexpensive and fast installation by eliminating the need for electrical configurations on site. An additional advantage of modular construction, according to one or more embodiments, is the manufacturing of the systems in a centralized location with a continuous basis (e.g., standardized, assembly line construction), eliminating construction risks, local cost variations, and other elements inherent to building onsite.

Low Temperature Storage Combined with Heat-Based Compression

In a cascade mobile compressed gaseous fuel module, a daughter station compressor could be avoided altogether by instead utilizing a heat pump to enhance the storage capacity of the system through cooling the gas stored. At the moment it is needed heat would be added to the vessel to drive the gas to move from the colder vessel to the warmer vessel, leading to "compression" through the addition/removal of heat. The same heat pump could transfer heat out of the receiving vessel and thus allow it to be filled. These could be used for a smaller capacity CNG-refill station, but at a larger scale the same system could be implemented for a mother station using tandem storage vessels that may in turn be filled with adsorbent materials to enhance the pressure/thermal cycling compression effects. This could eliminate or reduce the use of and/or cost of compression at the mother stations. The heat pump may be enhanced with a gas-fired heater to increase the temperature gradients driving the gas from the storage cylinder/vessel.

Interchangeability of Features

Any particular features of any of the above-discussed embodiments may be combined with any other embodiment without deviating from the present disclosure.

For example, any of the mobile transport systems including 120, 120*b*, 120*c*, 120*d*, 120*e*, 220, and/or 420*i* as indicated in FIGS. 1*a*-1*e*, FIGS. 2*a*-2*c*, FIGS. 3*a*-3*g*, FIGS. 4*a*-4*i*, FIGS. 5*a*-5*h*, FIGS. 6*a*-6*g*, FIGS. 7*a*-7*b*, and/or FIGS. 8*a*-8*b*, as well as components therefore, can be interchangeably used, unless otherwise specified, in any of the above-discussed embodiments, as will be appreciated by those skilled in the art.

In addition, connections to any of the mobile transport systems (e.g., the connection system 116 in FIG. 1*a*, the hose attachment 461 shown in FIG. 4*e*, attachment mechanism 463 to a loader or unloader shown in FIG. 4*f*, and/or hitch connection mechanism shown in FIG. 4*f* and/or FIG. 6*a*) can be used interchangeably (unless otherwise specified) in any of the above-discussed embodiments including a mobile transport system, as will be appreciated by those skilled in the art.

In yet another example, any one of the wheels, frames, trailers, mobile storage vessels, mobile gaseous fuel module, tractors, vehicles, trucks, and/or temperature control component in one of the mobile transport systems can be interchangeably used in another mobile transport system in any of the above-discussed various embodiments, as will be appreciated by those skilled in the art.

In yet another example, any of the mobile transport systems in the above-discussed various embodiments can be combined with any of connections in above-discussed various embodiments, which can be used to transport gaseous fuels, e.g., between any of the two "ends" selected from, for example, a gaseous fuel supply station (e.g., a supply pipeline or hub, a flare gas capture station, a gas-producing well, etc.), a mother station, an end user/customer, a gaseous fuel distribution station, e.g., for further gaseous fuel dispensing to other end users or another gaseous fuel distribution station, etc., a gathering point (e.g., a supply pipeline, LNG facility, etc.), a user's pipe line, etc.

In yet another example, vessels or storage vessels 141, 142, 143, 922*a*-*b* and/or 122 in above-discussed embodiments (including all figures) can be interchangeably used unless otherwise specified, as will be appreciated by those skilled in the art.

The foregoing illustrated embodiments are provided to illustrate the structural and functional principles of embodiments of the present invention and are not intended to be limiting. To the contrary, the principles of the present invention are intended to encompass any and all changes, alterations and/or substitutions within the spirit and scope of the following claims.

What is claimed is:

1. A system for transferring compressed gas from a gas supply to a destination storage vessel, the system comprising:

first and second flow paths each extending from the gas supply to the destination storage vessel, wherein the first and second flow paths diverge from each other downstream from the gas supply and then converge with each other upstream from the destination storage vessel;

a refrigeration unit operatively connected to the second flow path at a location between the divergence and convergence, wherein the refrigeration unit is configured to cool compressed gas within the second flow path; and at least one valve configured to control which of the first and second flow paths is used to transfer compressed gas from the gas supply to the destination storage vessel, wherein the at least one valve comprises an automated valve that is configured to shift from transferring a compressed gas along the first flow path to transferring compressed gas along the second flow path in response to a pressure of compressed gas in the destination storage vessel rising above a predetermined pressure.

2. The system of claim 1, further comprising a compressor that is disposed in both the first and second flow paths.

3. The system of claim 1, wherein the first flow path is an uncooled flow path.

4. The system of claim 1, further comprising an uncooled storage vessel disposed in the first flow path.

5. The system of claim 1, wherein the second flow path comprises a cooled storage vessel that is configured to be cooled by the refrigeration unit.

6. The system of claim 1, wherein the at least one valve comprises an automated valve that is configured to shift from transferring a compressed gas along the first flow path to transferring compressed gas along the second flow path in response to a temperature of compressed gas in the destination storage vessel rising above a predetermined temperature.

* * * * *